US007558700B2

(12) United States Patent
Yamashita et al.

(10) Patent No.: US 7,558,700 B2
(45) Date of Patent: Jul. 7, 2009

(54) EQUIPMENT DIAGNOSIS DEVICE, REFRIGERATING CYCLE APPARATUS, FLUID CIRCUIT DIAGNOSIS METHOD, EQUIPMENT MONITORING SYSTEM, AND REFRIGERATING CYCLE MONITORING SYSTEM

(75) Inventors: Koji Yamashita, Tokyo (JP); Masaki Toyoshima, Tokyo (JP); Hiroshi Nakata, Tokyo (JP)

(73) Assignee: Mitsubishi Denki Kabushiki Kaisha, Chiyoda-Ku, Tokyo (JP)

( * ) Notice: Subject to any disclaimer, the term of this patent is extended or adjusted under 35 U.S.C. 154(b) by 214 days.

(21) Appl. No.: 10/585,946

(22) PCT Filed: Dec. 17, 2004

(86) PCT No.: PCT/JP2004/018918

§ 371 (c)(1),
(2), (4) Date: Jul. 11, 2006

(87) PCT Pub. No.: WO2005/071332

PCT Pub. Date: Aug. 4, 2005

(65) Prior Publication Data

US 2007/0156373 A1 Jul. 5, 2007

(30) Foreign Application Priority Data

Jan. 21, 2004 (JP) ..... 2004-013165

(51) Int. Cl.
*G06F 11/30* (2006.01)

(52) U.S. Cl. ..... 702/183

(58) Field of Classification Search ..... 702/183
See application file for complete search history.

(56) References Cited

U.S. PATENT DOCUMENTS 6,658,373 B2 * 12/2003 Rossi et al. ..... 702/185

FOREIGN PATENT DOCUMENTS

EP 0 883 046 A1 12/1998
JP 59-068643 A 4/1984

(Continued)

OTHER PUBLICATIONS

Form PCT/ISA/210 (International Search Report) dated Apr. 12, 2005).

(Continued)

*Primary Examiner*—Drew A Dunn
*Assistant Examiner*—Stephen J Cherry
(74) *Attorney, Agent, or Firm*—Buchanan Ingersoll & Rooney PC

(57) ABSTRACT

In a failure diagnosis apparatus for a refrigerating cycle, a plurality of instrumentation amounts concerning the refrigerant such as the pressure and temperature of the refrigerating cycle apparatus or other instrumentation amounts are detected, the state quantities such as composite variables are acquired by making the arithmetic operation on these instrumentation amounts, and whether the apparatus is normal or abnormal is judged employing the arithmetic operation results. If learning is made during the normal operation, a current state is judged, and if learning is made by compulsorily performing the abnormal operation, or if the abnormal operating condition is operated during the current operation, a failure foretaste such as a critical operation can be made from a change in the Mahalanobis distance. Thereby, the secure diagnosis can be implemented with a simple constitution.

19 Claims, 18 Drawing Sheets

FOREIGN PATENT DOCUMENTS

| | | | |
|---|---|---|---|
| JP | 63-297975 | A | 12/1988 |
| JP | 2-110242 | A | 4/1990 |
| JP | 3-31667 | | 2/1991 |
| JP | 3-199874 | | 8/1991 |
| JP | 4-128610 | | 4/1992 |
| JP | 5-040115 | A | 2/1993 |
| JP | 6-185839 | A | 7/1994 |
| JP | 09-113077 | | 5/1997 |
| JP | 10-103820 | A | 4/1998 |
| JP | 10-103833 | | 4/1998 |
| JP | 10-153179 | A | 6/1998 |
| JP | 10-197031 | | 7/1998 |
| JP | 10-267509 | | 10/1998 |
| JP | 11-248299 | | 9/1999 |
| JP | 11-325632 | | 11/1999 |
| JP | 2000-046701 | | 2/2000 |
| JP | 2000-259222 | A | 9/2000 |
| JP | 2000-304388 | | 11/2000 |
| JP | 2001-166824 | A1 | 6/2001 |
| JP | 2001-343177 | | 12/2001 |
| JP | 2002-081809 | | 3/2002 |
| JP | 2002-195718 | A | 7/2002 |
| JP | 2002-267310 | A1 | 9/2002 |
| JP | 2002-277117 | | 9/2002 |
| JP | 2002-318617 | | 10/2002 |
| JP | 2003-207188 | A | 7/2003 |
| JP | 2003-207188 | A1 | 7/2003 |
| JP | 2003-214735 | | 7/2003 |
| JP | 2003-315211 | A | 11/2003 |

OTHER PUBLICATIONS

Form PCT/ISA/237 (Written Opinion of the International Searching Authority) dated Apr. 12, 2005.

Form PCT/ISA/220 (Notification of Transmittal of the International Search Report and Written Opinion of the International Searching Authority) dated Apr. 12, 2005.

Japanese Office Action (with English language translation) dated Nov. 13, 2007.

Chinese Office Action (with English language translation) dated Nov. 23, 2007.

Japanese Office Action dated Mar. 25, 2008, with English-Language Translation.

Decision of Refusal for Patent Application 2004-013165, Mailing Date Nov. 11, 2008, with English Translation.

Pretrial Reexamination Report for Patent Application 2005-198568, Mailing Date Oct. 21, 2008, with English Translation.

Supplementary European Search Report dated Feb. 16, 2009 in corresponding European Application No. 04 80 7276.

* cited by examiner

EQUIPMENT DIAGNOSIS DEVICE, REFRIGERATING CYCLE APPARATUS, FLUID CIRCUIT DIAGNOSIS METHOD, EQUIPMENT MONITORING SYSTEM, AND REFRIGERATING CYCLE MONITORING SYSTEM

TECHNICAL FIELD

The present invention relates to a technology concerning a failure diagnosis or monitoring of equipment or devices, such as a compressor, a fluid circuit, an air blower and so on for a refrigerating cycle apparatus for use in a refrigeration unit or air conditioner.

BACKGROUND ART

As a failure diagnosis for the air-conditioning machine, a technology for failure diagnosis has been offered in which the control data of a sensor, a set value, and an abnormal signal, etc. are taken in, and a sequence of operating conditions for each failure is memorized in a microcomputer, together with the operating data of pressure and temperature. Refer to patent document 1. On the other hand, many attempts employing the Mahalanobis distance involved in a multivariate analysis method to diagnose the failure have been frequently made. Formerly, the signal of a vibration sensor was compared with the signal at the normal time. Refer to patent document 2. Recently, a symptom of deterioration is detected by using various kinds of sensors. Refer to patent document 3.

In the conventional refrigerating cycle apparatus as described in patent document 4, a liquid reservoir (liquid receiving tank) and an auxiliary tank are communicated through a communication tube to make the liquid refrigerant of the liquid reservoir on the same level as that of the auxiliary tank, whereby the liquid level is detected by a float type level sensor installed in the auxiliary tank, and a refrigerant leakage is sensed depending on whether or not the detected liquid level of the liquid reservoir is above a preset normal liquid level.

Also, in the conventional refrigerating cycle apparatus as described in patent document 5, a sight glass (flow sight) is attached to a liquid draw-off line extending from the lower part of the liquid reservoir (receiver tank), and the light is projected from a light emitter to the refrigerant liquid flowing through the sight glass and received by a light receiver, whereby an air bubble mixed into the refrigerant liquid, namely, a refrigerant leakage, is sensed, based on the level of a detected signal by the light receiver.

Patent document 1: JP-A-2-110242 (FIGS. 4 to 11)

Patent document 2: JP-A-59-68643 (left upper to right upper columns in page 23)

Patent document 3: JP-A-2000-259222 (FIGS. 3 to 9)

Patent document 4: JP-A-10-103820 (claim 1, FIGS. 1, 2 and 4)

Patent document 5: JP-A-6-185839 (claim 1, FIGS. 1 and 3)

DISCLOSURE OF THE INVENTION

Problems that the Invention is to Solve

With the conventional attempt for failure diagnosis in which the control data of a sensor, a set value, and an abnormal signal is taken in and the operating condition of each failure is diagnosed with the operational data such as pressure and temperature, there was a problem that the accuracy was bad although the extremely abnormal condition could be judged. For example, if the measured value exceeds a preset tolerance limit value, an abnormal signal may be raised from warning means, but a minute and composite change of data in the overall refrigerating cycle apparatus could not be grasped because the threshold for specific operational data was only noticed, whereby the possible abnormality could not be sensed at the time of a failure symptom.

Also, if the precision is improved, it is required that a lot of data is taken in, and the judgement is made under various conditions, whereby the costs are increased because of not only the sensor but also an increased capacity of microcomputer or a change of the microcomputer every time the object equipment is changed. Since the threshold for failure determination was decided based on the design values or the test of a specific machine, it took a long time to make this decision, and the individual differences of real machine could not be considered, whereby there was possibility of misdetection.

Also, even if a technique of the multivariate analysis was employed, the judgment for the threshold was insufficient or a large amount of data was necessary for the measures, whereby it could not be put to practical use. Further, since the cause of failure could not be specified, it was not possible to promptly respond to the monitoring and maintenance for the failure.

Also, the conventional refrigerating cycle apparatus had a problem that the apparatus was very expensive, because it was required to measure the liquid level of a liquid reservoir or the air bubble mixed into the refrigerant liquid flowing out of the liquid reservoir, namely, to install a special sensor for specific data.

Also, the conventional refrigerating cycle apparatus had another problem that retrofitting the existing refrigerating cycle apparatus was difficult because a special sensor for necessary data was assembled with the apparatus.

Also, the conventional refrigerating cycle apparatus had another problem that a refrigerant leakage could not be sensed before the refrigerant leakage amount reached the limit capable of keeping the normal cooling power, whereby the refrigerant leakage was not discovered in the early stage, and no measure was taken before the limit.

Also, the conventional refrigerating cycle apparatus had another problem that it was not possible to discriminate between the refrigerant leakage and other abnormalities, because the refrigerant leakage was sensed based on specific data.

This invention has been achieved to solve the above-mentioned problems, and it is an object of the invention to enable the detection of failure in the early stage based on the operated state quantities involving the overall apparatus such as the refrigerating cycle in addition to the equipment, for example, a compressor unit. Also it is another object of the invention to provide a practicable product that absorbs the real machine individual differences in the failure determination, is easy to set the threshold, and usable for everything easily anywhere and anytime. Also, it is a further object of the invention to provide a technique for specifying the cause of failure in the failure determination with high accuracy and reliability.

Moreover, it is another object of this invention to provide a cheap and reliable refrigerating cycle apparatus or a diagnosis or monitoring technique capable of detecting the abnormality in the refrigerating cycle such as refrigerant leakage with only the information of general temperature measurement means and pressure measurement means. Also, it is another object of this invention to provide a refrigerating cycle apparatus or a diagnosis or monitoring technique that can be easily applied to the existing refrigerating cycle apparatus.

Also, it is another object of this inventing to provide a refrigerating cycle apparatus or a diagnosis or monitoring technique capable of detecting the abnormality in the early stage by discriminating each abnormality such as refrigerating cycle by employing the correlation between two or more data, in which the abnormality can be forecast practically.

Means for Solving the Problems

An equipment diagnosis device of the present invention comprises instrument means for measuring a plurality of instrumentation amounts for the equipment sucking and discharging the fluid, arithmetic means for performing the arithmetic operation on the correlation between the plurality of instrumentation amounts that are measured, and normal state quantity storage means for storing the state quantities including at least the operated correlation between the plurality of instrumentation amounts as the state quantities in the normal condition of the equipment, the state quantities being arithmetic values such as a mean value obtained from the instrumentation amounts measured when the operation is judged to be normal, wherein the state quantities of the abnormal condition are obtained by making the arithmetic operation from the state quantities of the normal condition stored in the normal state quantity storage means.

Also, an equipment diagnosis device of the invention comprises instrument means for measuring a plurality of instrumentation amounts for the equipment sucking and discharging the fluid, arithmetic means for performing the arithmetic operation on the correlation between the plurality of instrumentation amounts that are measured, state quantity storage means for storing the state quantities including at least the operated correlation between the plurality of instrumentation amounts as the state quantities in the normal condition of the equipment, the state quantities being arithmetic values such as a mean value obtained from the instrumentation amounts measured when the operation is judged to be normal, or storing the state quantities including at least the correlation between the plurality of instrumentation amounts operated by the arithmetic means from the plurality of instrumentation amounts measured when the equipment is judged as the abnormal condition or set to achieve the abnormal condition as the state quantities in the abnormal condition of the equipment, and judgement means for inferring the extent or cause of abnormality if it is judged that the current operating condition is not the normal state by comparing the current state quantities including at least the state quantity in which the arithmetic means makes the arithmetic operation on the correlation between the plurality of instrumentation amounts for the fluid as the variables during the current operation of the equipment and at least one of the state quantities of the normal state and the state quantities of the abnormal state which are stored in the state quantity storage means.

A refrigerating cycle apparatus of the invention comprises a refrigerating cycle formed by connecting a compressor, a condenser, expansion means and an evaporator via a pipeline, and flowing a refrigerant through the inside thereof, high pressure side measurement means that is high pressure measurement means for measuring the high pressure of a refrigerant pressure at any position on a flow passage leading from the discharge side of the compressor to the expansion means or condensation temperature measurement means for measuring the saturation temperature at the high pressure, low pressure side measurement means that is low pressure measurement means for measuring the low pressure that is the pressure of refrigerant at any position on the flow passage leading from the expansion means to the suction side of the compressor or evaporation temperature measurement means for measuring the saturation temperature at the low pressure, refrigerant temperature measurement means that is liquid temperature measurement means for measuring the temperature at any position on the flow passage leading from the condenser to the expansion means, discharge temperature measurement means for measuring the temperature at any position on the flow passage leading from the compressor to the condenser, or suction temperature measurement means for measuring the temperature at any position on the flow passage leading from the evaporator to the compressor, arithmetic means for performing the arithmetic operation on the composite variables from the measured values of the high pressure side measurement means, the low pressure side measurement means and the refrigerant temperature measurement means, and judgement means for judging the abnormality of the refrigerating cycle based on the comparison result by comparing the values stored in the past and the current measured values or arithmetic values, as well as storing each of the measured values or the arithmetic values.

A refrigerating cycle apparatus of the invention comprises a refrigerating cycle formed by connecting a compressor, a condenser, expansion means and an evaporator via a pipeline and flowing a refrigerant through the inside thereof, normal state quantity storage means for storing, as the state quantities of a normal operating condition, the state quantities including at least the state quantity obtained by making the arithmetic operation on the correlation between a plurality of measured values as a plurality of variables when the refrigerating cycle is normally operating, abnormal state quantity storage means for storing, as the state quantities of an abnormal operating condition, the state quantities including at least the state quantity obtained by making the arithmetic operation on the correlation between the plurality of measured values as the plurality of variables when there is an abnormality in the refrigerating cycle, comparison means for comparing the distances between the current operating state quantities including at least the state quantity obtained by making the arithmetic operation on the correlation between the plurality of measured values in the current operating condition of said refrigerating cycle as the plurality of variables and the plurality of state quantities stored in the normal state quantity storage means or the plurality of state quantities stored in the abnormal state quantity means, and judgement means for judging a degree of normality, an degree of abnormality or a cause of abnormality of the refrigerating cycle from the distances compared by the comparison means or a change in the distance.

A refrigerating cycle apparatus of the invention comprises a refrigerating cycle formed by connecting a compressor, a condenser, expansion means and an evaporator via a pipeline and flowing a refrigerant through the inside thereof, high pressure side measurement means that is high pressure measurement means for measuring the high pressure of a refrigerant pressure at any position on a flow passage leading from the discharge side of the compressor to the expansion means or condensation temperature measurement means for measuring the saturation temperature at the high pressure, low pressure side measurement means that is low pressure measurement means for measuring the low pressure that is a pressure of refrigerant at any position on the flow passage leading from the expansion means to the suction side of the compressor or evaporation temperature measurement means for measuring the saturation temperature at the low pressure, refrigerant temperature measurement means that is liquid temperature measurement means for measuring the temperature at any position on the flow passage leading from the condenser to the expansion means, discharge temperature measurement means for measuring the temperature at any position on the flow passage leading from the compressor to the condenser, or suction temperature measurement means for measuring the temperature at any position on the flow passage leading from the evaporator to the compressor, judgement means for judging the abnormality of the refrigerating cycle including a refrigerant leakage by storing the measured values of each measurement means or the arithmetic values calculated from the measured values, and comparing the stored values and the current measured values or arithmetic values, and output means for outputting the refrigerant leakage information in preference to other abnormalities of the refrigerating cycle, when the refrigerant leakage is judged.

A fluid circuit diagnosis method of the invention includes a measurement step of measuring a plurality of measurement amounts from the physical quantities of a fluid flowing through a circuit in the equipment sucking and discharging the fluid, an arithmetic operation step of making the arithmetic operation on an aggregate in which a plurality of parameters obtained from the measured data are combined as a plurality of variables and associated with each other to calculate the arithmetic operation result, and judgement step of judging whether or not the fluid is in the normal operating condition by comparing the arithmetic operation result with a set threshold.

A fluid circuit diagnosis method of the invention includes a measurement step of measuring a plurality of measurement amounts from the physical quantities of a fluid in the equipment sucking and discharging the fluid that circulates through a fluid circuit, an arithmetic operation step of making the arithmetic operation on an aggregate in which a plurality of parameters obtained from the measurement amounts that are measured are combined as a plurality of variables and associated with each other to calculate the arithmetic operation result, and a failure preview step of presuming the time elapsed before the fluid within the fluid circuit becomes abnormal from at least one of the arithmetic operation result at the normal operating time and the arithmetic operation result at the abnormal operating time, the arithmetic operation results being stored, and the operating time elapsed.

A fluid circuit diagnosis method of the invention includes a measurement step of measuring a plurality of measurement amounts from the physical quantities of a fluid in the equipment sucking and discharging the fluid that circulates through a fluid circuit, an arithmetic operation step of making the arithmetic operation on an aggregate in which a plurality of parameters obtained from said measurement amounts that are measured are combined as a plurality of variables and associated with each other to calculate the arithmetic operation result, and a failure preview step of presuming the time elapsed before the fluid within said fluid circuit becomes abnormal from at least one of the arithmetic operation result at the normal operating time and the arithmetic operation result at the abnormal operating time, the arithmetic operation results being stored, and the operating time elapsed.

A refrigerating cycle monitoring system of the invention comprises an equipment monitoring system for monitoring the operating condition of the equipment during the operation with an equipment diagnosis device, wherein at least one of the instrumentation amounts measured by the equipment diagnosis device, the arithmetic values obtained by arithmetic operation, and the judgement result as to whether or not the equipment is in the normal operating condition by comparing the arithmetic values with a set threshold is transmitted via a communication line or the radio communication to a remote monitoring apparatus for monitoring the operating condition of the equipment.

A refrigerating cycle monitoring system of the invention comprises high pressure side measurement means that is high pressure measurement means for measuring the high pressure of a refrigerant pressure at any position on a flow passage leading from the discharge side of a compressor to expansion means in a refrigerating cycle apparatus that constitutes a refrigerating cycle by connecting the compressor, a condenser, the expansion means and an evaporator via a pipeline and flowing a refrigerant through the inside thereof or condensation temperature measurement means for measuring the saturation temperature at the high pressure, low pressure side measurement means that is low pressure measurement means for measuring the low pressure that is a pressure of refrigerant at any position on the flow passage leading from the expansion means to the suction side of the compressor or evaporation temperature measurement means for measuring the saturation temperature at the low pressure, refrigerant temperature measurement means that is liquid temperature measurement means for measuring the temperature at any position on the flow passage leading from the condenser to the expansion means, discharge temperature measurement means for measuring the temperature at any position on the flow passage leading from the compressor to the condenser, or suction temperature measurement means for measuring the temperature at any position on the flow passage leading from the evaporator to the compressor, arithmetic means for acquiring the composite variables from the measured values of the high pressure side measurement means, the low pressure side measurement means and the refrigerant temperature measurement means, storage means for storing the measured value of each measurement means and the arithmetic values such as the composite variables by making the arithmetic operation on the measured values, judgement means for judging the abnormality of the refrigerating cycle based on the comparison result by comparing the values stored in the past by the storage means and the current measured values or arithmetic values, and transmission means, formed by wire or radio, for transmitting at least one of the measured values or the arithmetic values or the judgement result of the judgement means to a remote monitoring apparatus provided at a site away from the refrigerating cycle apparatus.

Effect of the Invention

In this invention, since the operating condition is diagnosed from the general instrumentation amounts of the fluid, it is possible to detect the abnormality and foresee the abnormality time through a simple and secure diagnosis. Also, the invention provides a precise and practical diagnosis technique capable of specifying the cause of failure. Also, with the invention, it is possible to monitor the equipment and the refrigerating cycle reliably.

EXPLANATION OF REFERENCE NUMERALS

Figure 1:
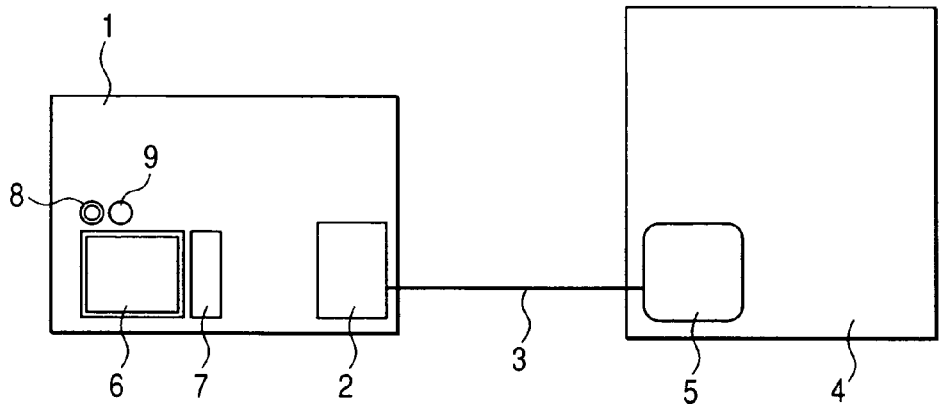
FIG. 1 is an overall conceptual view of an embodiment 1 of the invention.

1 refrigerating cycle apparatus
2 microcomputer
3 telephone line or LAN
4 remote monitoring room
5 computer
6 display device
7 input device
8 alarm lamp
9 speaker
10 accumulator
11 compressor
12 condenser
13 expansion valve
14 evaporator
35 liquid reservoir
36 flow passage opening/closing means
37 sub-cooling means
38 liquid pipe temperature detection means
41 data collection means
45 air blower for condenser
48 oil separator
53 office
54 alarm unit
55 data sending/receiving means
56 network or public line
61 blow-off temperature detection means
62 suction temperature detection means

BEST MODE FOR CARRYING OUT THE INVENTION

Embodiment 1

Referring to FIGS. 1 to 8, the configuration of an embodiment 1 of the present invention will be described below. FIG. 1 is an overall conceptual view of the invention. Reference numeral 1 denotes a refrigerating cycle apparatus such as a refrigerator or an air conditioner, 2 denotes a board containing a detecting circuit for the operating state quantity of the refrigerating cycle apparatus 1, an arithmetic unit on the detection result, a storage, an output unit to a display screen or a warning lamp, or a sending or receiving component of data to the outside, or a microcomputer, 3 denotes communication means for communicating with the outside via the telephone line or LAN or by radio, 4 denotes a remote monitoring room for making the centralized control such as remote monitoring and control of the refrigerating cycle apparatus 1, 5 denotes a computer that is remote monitoring means installed within the remote monitoring room 4 and having a display and arithmetic function for transmitting and receiving the data with the refrigerating cycle apparatus 1, 6 denotes a display device such as a liquid crystal display provided in the refrigerating cycle apparatus 1, 7 denotes an input device such as a touch panel or button, 8 denotes a warning lamp for informing an occurrence of abnormality, and 9 denotes a speaker for producing the sound informing the occurrence of abnormality. The refrigerating cycle apparatus 1 such as a refrigerator or an air conditioner maybe the air conditioning equipment installed in the building, a freezer or an air conditioning system installed in the supermarket or large shop, a refrigerating/air conditioning apparatus for the small shop, or an air conditioner for each home in the collective housing. The remote monitoring room may monitor a plurality of installations or an individual installation. Or it may be connected to a monitoring computer or a monitoring apparatus within each residence such as a detached house. Though the display device 6, the input device 7, the warning lamp 8 and the speaker 9 are contained within the refrigerating cycle apparatus 1 in FIG. 1, it is natural that all or a part of them may be installed outside the refrigerating cycle apparatus 1, or a part or all of them may not be provided if any alternative means, for example, a computer connected via communication means 3 to the remote site, is installed.

Figure 2:
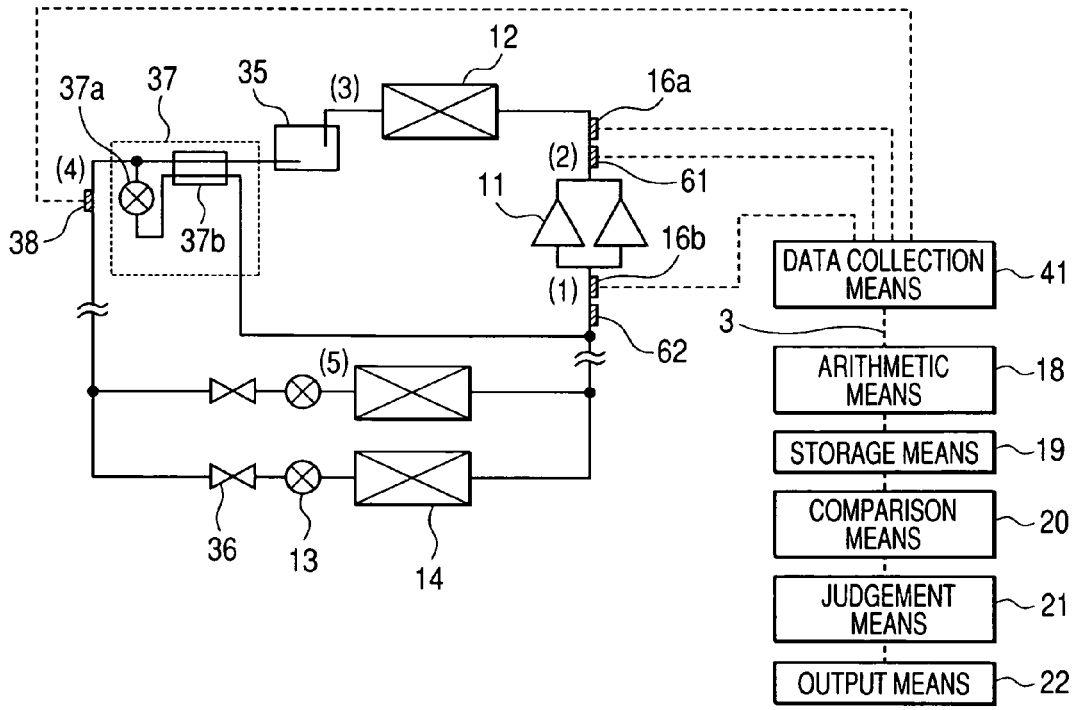
FIG. 2 is a block diagram of a refrigerating cycle apparatus according to an embodiment 1 of the invention.
Figure 3:
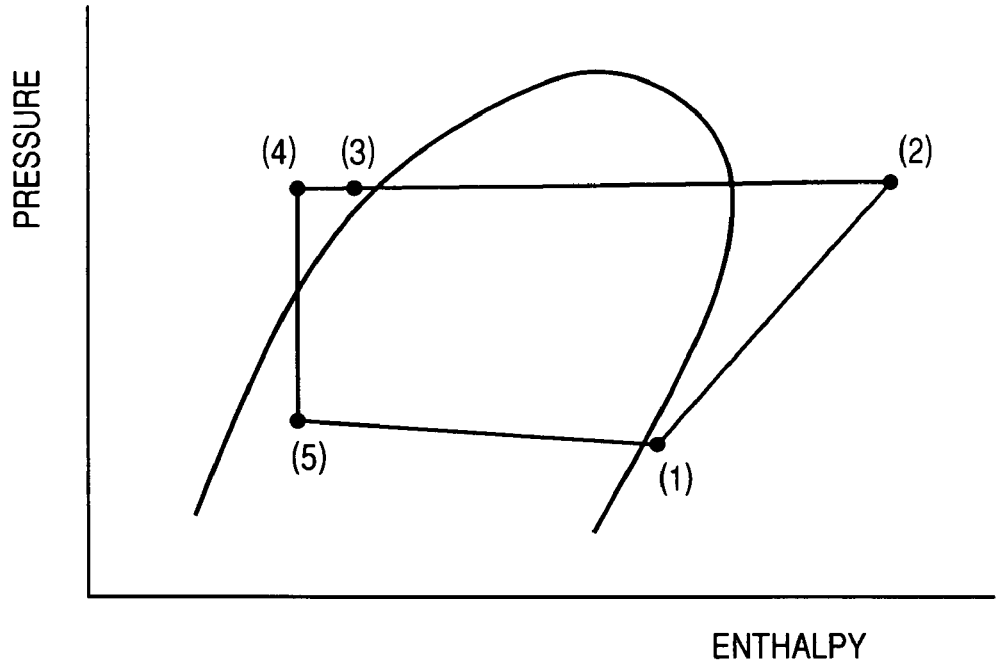
FIG. 3 is a Mollier chart showing the action of a refrigerating cycle according to the embodiment 1 of the invention.

FIG. 2 is a block diagram showing the details of the refrigerating cycle apparatus 1 according to the invention as shown in FIG. 1. Reference numeral 11 denotes a compressor, 12 denotes a condenser, 35 denotes a liquid reservoir, 37 denotes sub-cooling means, 36 denotes flow passage opening/closing means, 13 denotes expansion means, and 14 denotes an evaporator. A refrigerating cycle is constituted by connecting them via a pipeline, and flowing a refrigerant through the inside thereof. Each of the compressor 11, the flow passage opening/closing means 36, the expansion means 13, and the evaporator 14 is provided singly or plurally. The condenser 12 is installed in a machine room or outdoors, and the evaporator 14 is contained in a showcase, for example. Reference numeral 16 is refrigerant instrumentation amount detection means for detecting the refrigerant condition such as pressure and temperature of the refrigerating cycle apparatus 1, 16*a* denotes high pressure detection means for the refrigerant, 16*b* denotes low pressure detection means for the refrigerant, 38 denotes liquid pipe temperature detection means, 61 denotes discharge temperature detection means for the refrigerant, 62 denotes suction temperature detection means for the refrigerant, 41 data collection means, 18 denotes arithmetic means for performing various arithmetic operations based on the detection result of the refrigerant state quantity detection means 16, 19 denotes storage means for storing the arithmetic operation result in the past and the reference value, 20 denotes comparison means for comparing the arithmetic operation result with the stored content, 21 denotes judgement means for making the judgement based on the comparison result, and 22 denotes output means for outputting the judgement result to the display means or remote site. FIG. 3 is a Mollier chart representing the action of the refrigerating cycle in the refrigerating cycle apparatus. In FIG. 3, the transverse axis represents the enthalpy and the longitudinal axis represents the pressure, in which a cycle of compression, condensation, expansion and evaporation is shown where the reference signs (1) to (5) correspond to those of FIG. 2. Though not shown in FIG. 2, the condenser 12 and the evaporator 14 are provided with an air blower for cooling. Also, the compressor 11 may be a scroll type, a rotary type, a reciprocating type, or a screw type, but most compressors are driven by a motor (not shown) directly coupled to a compression mechanism inside its housing. This motor may be an induction motor that rotates at almost constant rate by a commercial power from the AC power source, or a DC brushless motor that converts the commercial power into DC, adjusts the frequency by an inverter, and changes the number of rotations for the compressor. A voltage is applied to the motor for driving this compressor, and a current according to a load flows through the motor. The data collection means 41 detects and collects not only the physical quantities of the fluid, but also the current for the motor driving the equipment for circulating the fluid through this refrigerating cycle apparatus, namely, the quantity of electricity driving the equipment driving means, as the data.

In FIG. 2, the arithmetic means 18 makes the arithmetic operation on the composite variables, based on the state quantities such as pressure and temperature of each part in the refrigerating cycle, in which the state quantities are detected by each detection means and collected by the data collection means 41. And the information is conveyed to the storage means 19 for storing the past data and the preset threshold value, the comparison means 20 for comparing the current value with the stored data, the judgement means 21 for making the comprehensive judgement based on the comparison result, the out put means 22 for out putting the judgement result, the display means 6 for displaying the output determination result and the remote monitoring means 5 for monitoring the operating condition at the remote site. In the explanation of FIGS. 1 and 2, a refrigerant circuit for making the air conditioning of heating or cooling by circulating the refrigerant and the refrigeration or freezing in the refrigerator or freezer, the sensors for sensing the operating condition of the refrigerant circuit, a microcomputer required for the control or arithmetic operation, and the boards are accommodated within the refrigerating cycle apparatus, in which the operating condition is measured and judged through the arithmetic operation and comparison. However, though the instrumentation by the sensors is provided near the refrigerating cycle, the arithmetic means 18 and the following parts may be provided in the remote monitoring room 4.

Referring to FIG. 2, the operation of the refrigerating cycle apparatus will be described below. The refrigerant is enclosed into the refrigerant circuit of the refrigerating cycle apparatus 1. The refrigerant is compressed and pressurized by the compressor 11. The refrigerant of high temperature and high pressure is cooled and liquefied by an air cooling fan or a liquid cooling system (not shown) such as water cooling in the condenser 12, and reduced in pressure and expanded by the expansion valve 13 so that the refrigerant has low temperature and low pressure. Further, the refrigerant is evaporated at the evaporator 14 by heat exchange with an air cooling fan or a liquid heating medium (not shown) such as water, and heated and gasified. And the gasified refrigerant returns to the suction side of the compressor 11, and transfers to a compression/pressurization process again. At this time, the air or liquid having exchanged heat with the refrigerant in the condenser 12 is heated to the high temperature to be employed as a heat source for heating or exchange heat with the outside. The air or liquid having exchanged heat with the refrigerant in the evaporator 14 is cooled to the low temperature to be employed as a heat source of refrigeration or freezing, or exchange heat with the outside. The usable refrigerants include natural refrigerants such as carbon dioxide, hydrocarbon, helium, alternative refrigerants such as HFC410A and HFC407C, refrigerants not containing chlorine, and Freon refrigerants such as R22 and R134a used for existent products. The fluid equipment such as the compressor for circulating the refrigerant may be a reciprocating, rotary, scroll or screw type. The determination for abnormality in this invention can be implemented for not only the new products but also the existent products already placed in the operating condition by additionally installing a deficient sensor later.

The constitution from the data collection means 41 to the output means 22 as shown in FIG. 2 is contained within the refrigerating cycle apparatus 1 with each means built on the board. Besides, the computer 5 within the remote monitoring room 4 of FIG. 1 may be provided with the functions from the arithmetic means 18 to the output means 22 to perform the processing of each means. Also, both the refrigerating cycle apparatus 1 and the computer 5 within the remote monitoring room 4 maybe provided with the functions separately or commonly. Also, each of the refrigerating cycle apparatus and the computer may be provided with the storage means 19, in which the data of the storage means in the refrigerating cycle apparatus 1 with less storage area may be rewritten on the corresponding data within the computer 5 with large storage capacity. This method is effective when it is desired to employ different data depending on the season. Also, the function of each means may be placed in the main body of the refrigerating cycle apparatus 1 or the remote monitoring room 4, as long as its function can be fulfilled. The computer 5 is provided within the remote monitoring room 4 to be suitable for the centralized monitoring for a plurality of apparatuses. However, when the specific apparatus is treated, a moving monitoring apparatus such as a mobile may be employed for the serviceman to move for monitoring at any time, or a simple monitoring apparatus within the home may be provided.

Referring to FIG. 2, the operation for diagnosis and abnormality determination of the refrigerating cycle apparatus according to the embodiment of the invention will be described below. The instrumentation amounts collected by each detection means of the refrigerating cycle apparatus are the instrumentation amounts such as pressure and temperature of each part for the refrigerant flowing through the refrigerant circuit required to grasp the operating condition of the refrigerating cycle. Various kinds of data are detected by the refrigerant instrumentation amount detection means 16, and collected by the data collection means 41. To grasp the operating condition of the refrigerating cycle, the refrigerating cycle apparatus 1 comprises a refrigerating cycle formed by connecting the compressor 11, the condenser 12, the expansion means 13 and the evaporator 14 via the pipeline and flowing the refrigerant through the inside of a circulation circuit, high pressure side measurement means 16*a* that is high pressure measurement means for measuring the high pressure of a refrigerant pressure at any position on the flow passage leading from the discharge side of the compressor 11 to the expansion means 13 in this refrigerating cycle apparatus 1 or the condensation temperature measurement means for measuring the saturation temperature at this high pressure, low pressure side measurement means 16*b* that is low pressure measurement means for measuring the low pressure that is the pressure of refrigerant at any position on the flow passage leading from the expansion means 13 to the suction side of the compressor 11 or evaporation temperature measurement means for measuring the saturation temperature at the low pressure, refrigerant temperature measurement means that is liquid temperature measurement means 38 for measuring the temperature at any position on the flow passage leading from the condenser 12 to the expansion means 13, discharge temperature measurement means 61 for measuring the temperature at any position on the flow passage leading from the compressor 11 to the condenser 12, or suction temperature measurement means 62 for measuring the temperature at any position on the flow passage leading from the evaporator 14 to the compressor 11, and measurement means for measuring the physical quantity of refrigerant at each part, as shown in FIG. 2. It is simple to employ these measurement means usually disposed in the refrigerating cycle, but some measurement means may be added externally later, as needed.

The state quantities indicating the features of data can be obtained arithmetically from the measured values of the high pressure side measurement means, the low pressure side measurement means and the refrigerant temperature measurement means. For example, the arithmetic means 18 makes the arithmetic operation on the composite variables, which are plural measured values of each measurement means or the arithmetic values with features obtained from the measured amounts, whereby the measured values and the arithmetic values are stored in the storage means 19. The abnormality of the refrigerating cycle can be judged based on the comparison result of comparing the current measured values or arithmetic values with the past values stored in the storage means. The pressure is measured employing a pressure transducer for converting the pressure of refrigerant into an electric signal, and the temperature is measured employing temperature detection means such as a thermistor or a thermocouple. The pressure and temperature measuring positions may be changed or expanded in accordance with the constitution and operation characteristics of the refrigerating cycle of interest to grasp more exactly the refrigerating cycle operating condition. The state quantity is measured at certain intervals, for example, in a unit of minute or hour, and the information is passed to the data collection means 41.

The physical quantity of refrigerant is measured by each measurement means in a state associated with the fluid of refrigerant flowing through the refrigerant circuit that is the fluid circuit, from which the data is collected, wherein the data is measured in the same time zone or related time zone. Though the state quantity is obtained arithmetically from plural measured data, the arithmetic operation is performed by coordinating the measurement intervals to treat each of the measured data as the same rank, or the arithmetic operation is performed at regular time intervals. Accordingly, the state quantity is obtained from the related data.

A method for combining plural measured data into the composite variables and a method for detecting the abnormality in the equipment such as compressor or the system such as refrigerating cycle employing the composite variables will be described below. As an exemplary method for processing plural instrumentation amounts, a Mahalanobis distance is generally well known. The Mahalanobis distance was described in "Easy multivariable analysis" published from Tokyo Tosho, Oct. 26, 1992, and is employed in the field of multivariable analysis. In the following, a method for detecting the abnormality in the compressor employing the Mahalanobis distance will be described. For the leakage, deterioration or failure, the operation quantities, data and the phenomenon appearing on the surface are more complex in the earlier stage, except for the final stage where the breakage or insulation short-circuit clearly appears on the surface. The data is the combination of complex factors, and grasped not unitarily but in multi-dimensions to simplify the complex structure, whereby the multivariable analysis method is employed. However, the intended result, for example, a malfunction in the early stage cannot be found by simply employing the multivariable analysis. This invention provides a practical diagnosis technique from the correlation between the variables.

Supposing that the total number of measured data representing the refrigerating cycle operating condition is m, each instrumentation amount or state quantity is assigned to the variable X, whereby m operating state quantities X1 to Xm are defined. Then, in the normal operating condition as the reference, for example, the condition where an air conditioner is installed and confirmed to be normal as a result of trial run, or where the air conditioner attaining the fairly set output capability is operated, the reference data corresponding to a total of n (2 or more) combinations of the operating state quantities X1 to Xm are collected.

And the mean value mi and the standard deviation σi (dispersion of reference data) for each of X1 to Xm are obtained from the following expressions (1) and (2). Where i is the number of items (parameters), and set from 1 to m to indicate the value corresponding to X1 to Xm. Herein, the standard deviation is obtained by taking the square of the difference between each variable and its mean value and calculating the positive square root of the expected value.

[Numerical expression 1] (1)

$$m_i = \frac{1}{n}\sum_{j=1}^{n} X_{ij}$$

[Numerical expression 2] (2)

$$\sigma_i = \sqrt{\frac{1}{n-1}\sum_{j=1}^{n}(X_{ij} - m_i)^2}$$

Then, the original X1 to Xm are normalized into x1 to xm, employing the mean value mi and the standard deviation σi that are the calculated state quantities representing the features, in accordance with the following expression (3). That is, the variable is converted into the random variable having a mean value of 0 and a standard deviation of 1. In the following expression (3), j is from 1 ton, corresponding to the measured values.

[Numerical Expression 3]

$$X_{ij}=(X_{ij}-m_i)/\sigma_i \tag{3}$$

Then, to analyze the variables with the data standardized into the mean value of 0 and the standard deviation of 1, a variance/covariance matrix is defined as the correlation of X1 to Xm, namely, a correlation matrix R indicating the correlation between the variables and an inverse matrix R−1 of the correlation matrix by the following expression (4). In the expression (4), k is the number of items (parameters), and assumed m here. Also, i or p denotes the value of each item, and takes the value of 1 to m.

[Numerical expression 4] (4)

$$R=\begin{bmatrix} 1 & r_{12} & \cdots & r_{1k} \\ r_{21} & 1 & \cdots & r_{2k} \\ . & . & . & . \\ r_{k1} & r_{k2} & \cdots & 1 \end{bmatrix}$$

$$R^{-1}=\begin{bmatrix} a_{11} & a_{12} & \cdots & a_{1k} \\ a_{21} & a_{22} & \cdots & a_{2k} \\ . & . & . & . \\ a_{k1} & a_{k2} & \cdots & a_{kk} \end{bmatrix}$$

$$=\begin{bmatrix} 1 & r_{12} & \cdots & r_{1k} \\ r_{21} & 1 & \cdots & r_{2k} \\ . & . & . & . \\ r_{k1} & r_{k2} & \cdots & 1 \end{bmatrix}^{-1}$$

$$r_{ip}=r_{pi}=\frac{1}{n}\sum_{j=1}^{n} x_{ij}x_{pj}$$

After such arithmetic processing, the Mahalanobis distance that is the state quantity representing the feature is obtained in accordance with the following expression (5). In the expression (5), j is from 1 to n, corresponding to n measured values. Also, k is the number of items (parameters), and assumed m here. Also, all to akk are factors of the inverse matrix of the correlation matrix in the expression (4). The Mahalanobis distance is about 1 for the reference data, namely, in the normal operating condition, and falls within a range of 4 or less. However, the numerical value is greater in the abnormal condition, in which there is the property that the Mahalanobis distance is increased depending on the degree of abnormality (degree of separation from the normal condition) Herein, the Mahalanobis distance is employed as the dissimilarity or the distance required for the cluster analysis, but other multivariable analysis methods such as a shortest distance method and a longest distance method with the standardized Euclid distance or Minkowski's distance may be employed.

[Numerical expression 5] (5)

$$D_j^2=\frac{1}{k}(x_{1j}, x_{2j}, \ldots x_{kj})\cdot\begin{bmatrix} a_{11} & a_{12} & \cdots & a_{1k} \\ a_{21} & a_{22} & \cdots & a_{2k} \\ . & . & . & . \\ a_{k1} & a_{k2} & \cdots & a_{kk} \end{bmatrix}\cdot\begin{bmatrix} x_{1j} \\ x_{2j} \\ \cdots \\ x_{kj} \end{bmatrix}$$

$$=\frac{1}{k}\sum_{i=1}^{k}\sum_{p=1}^{k} a_{ip}x_{ij}x_{pj}$$

Figure 4:
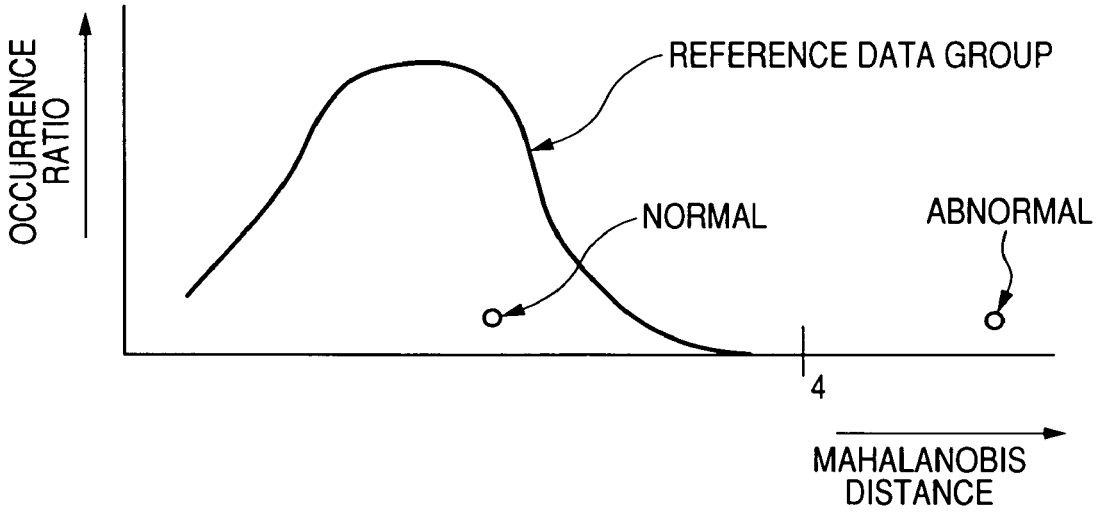
FIG. 4 is an explanatory chart for explaining the relationship between the Mahalanobis distance and its occurrence ratio according to the embodiment 1 of the invention.
Figure 5:
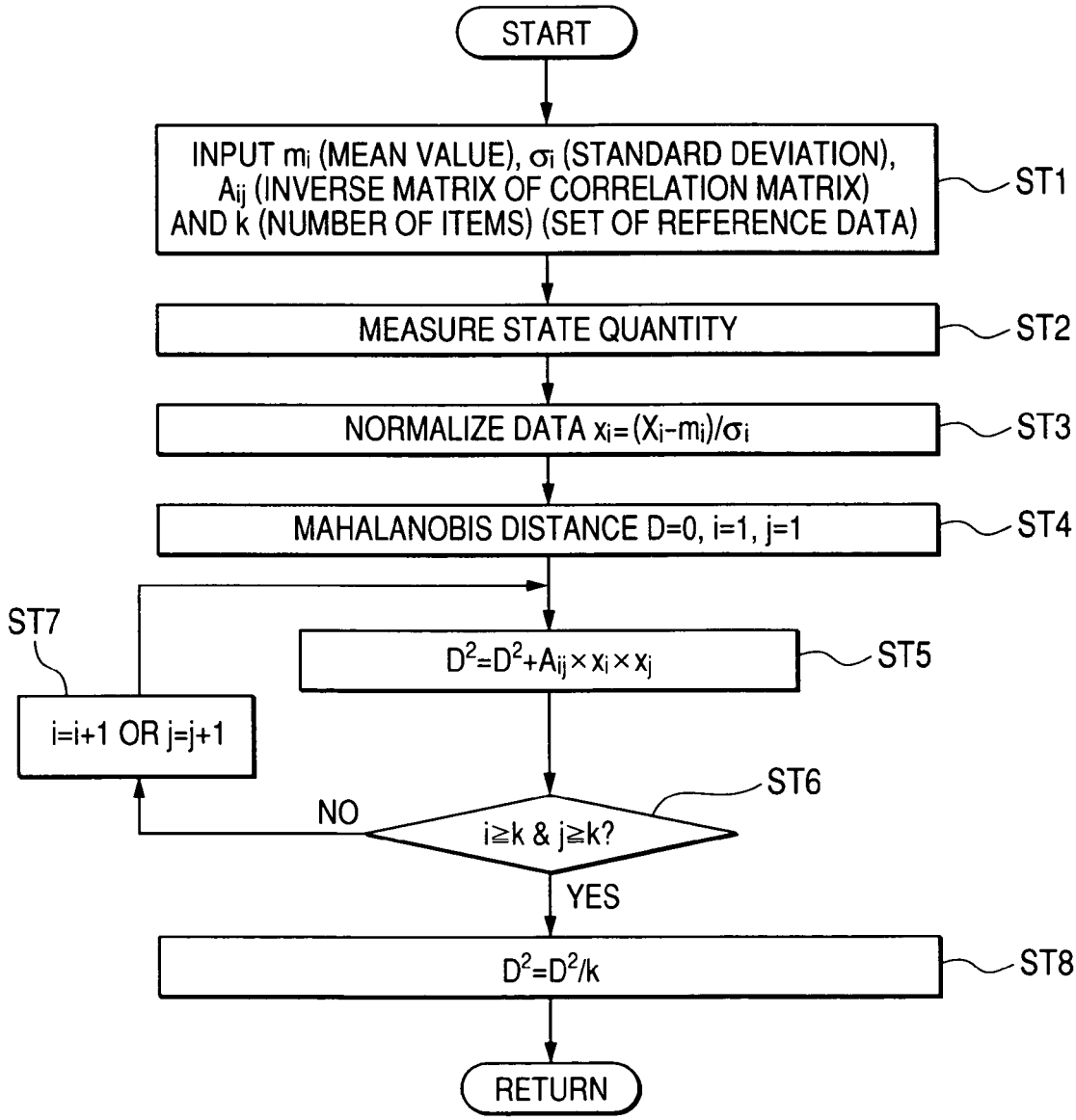
FIG. 5 is a flowchart for computing the Mahalanobis distance according to the embodiment 1 of the invention.

Referring to FIGS. 4 and 5, the concept of the Mahalanobis distance and the computation flow will be described below. FIG. 4 is a chart showing the relationship between the occurrence ratio and the Mahalanobis distance in which the Mahalanobis distance is taken along the transverse axis and the occurrence ratio is taken along the longitudinal axis. As shown in FIG. 4, when there are any number of parameters, the positional relationship between the calculated Mahalanobis distance and a reference data group is judged, whereby the failure condition of the refrigerating cycle apparatus is confirmed. For the reference data group, the Mahalanobis distance has the mean value of about 1, and is 4 or less in consideration of the dispersion.

FIG. 5 is a computation flowchart of the Mahalanobis distance. Firstly, the mean value, the standard deviation, the inverse matrix of the correlation matrix, and the number of items for the reference data are set (ST1), and the state quantities measured and calculated during the refrigerating cycle operation are acquired (ST2). The acquired data is normalized in accordance with the expression (3) (ST3). Then, the Mahalanobis distance is set to the initial value 0 and the counters i, j are set to the initial value 1 (ST4). And the Mahalanobis distance D2 is obtained by repeatedly performing the arithmetic operation according to the expression (5) while the counters i, j are changed till the number k of items at ST5 to ST7 and by dividing the integral value by the number k of items at ST8.

Referring to FIG. 2, the diagnosis of refrigerant leakage including the operation of the refrigerating cycle and an abnormality inferring method will be described below. First of all, the refrigerant amount within the refrigerating cycle will be described. For example, in a refrigeration unit for cooling a showcase in the supermarket, the showcase is installed in the food salesroom, in which the number, size, kind and arrangement of showcases are different depending on the shop where the showcases are installed, and the content volume of the evaporator 14 placed within the showcase is varied. Also, the places where the compressor 11, the condenser 12 and the liquid reservoir 35 are installed are different depending on the structure of the shop. For example, the showcase may be installed in the back of the food salesroom, or on the roof, whereby the length of a pipeline connecting the evaporator 14, the compressor 11, the condenser 12 and the liquid reservoir 35 to constitute a conning tower cycle is different. To allow the refrigerating cycle to exhibit a predetermined performance, the refrigerant amount suitable for the content volume of the refrigerating cycle is required. If the content volume of the evaporator or the length of the pipeline is different, the refrigerant amount required by the overall refrigerating cycle is different, whereby the refrigerant of the refrigeration unit is filled after the equipment is installed in the actual place. Also, since there required refrigerant amount of the refrigerating cycle is different depending on the condition of the refrigerating cycle, which is varied depending on the outside air temperature or the operating condition of the load side equipment such as the showcase. Therefore, when the refrigerant is filled, the refrigerant is usually filled a little excessively so that the refrigerant amount required for each component such as the condenser or evaporator may be apportioned, regardless of the operating condition, whereby the excess refrigerant after each component of the refrigerating cycle reaches the proper refrigerant amount is reserved in the liquid reservoir 35.

Of the refrigerant filled in the refrigerating cycle, the refrigerant amount required by each component changes from time to time, depending on the condition of the refrigerating cycle, so that the amount of excess refrigerant in the liquid reservoir 35 also changes. And if the refrigerant amount required by each component of the refrigerating cycle is fully greater than the refrigerant filled amount, the excess refrigerant can not be left within the liquid reservoir 35, so that the two phase refrigerant containing gas flows out of the liquid reservoir 35. If more or less gas is mixed, it is liquefied owing to heat exchange of liquid pipe heat exchanging means 37*b* via branch expansion means 37*a* in sub-cooling means 37 (including cooling the liquid pipeline by surrounding air), without causing serious trouble. However, if the entrained amount of gas into the refrigerant flowing out of the liquid reservoir 35 is further increased, the two phase refrigerant flows into the expansion means 13, resulting in an uncooled condition where the required cooling power can not be secured to elevate the surrounding air temperature around the refrigerated or frozen food, and degrade the quality of food.

To prevent this situation, the liquid reservoir 35 for reserving the excess refrigerant is installed, whereby the refrigerant is enclosed in anticipation of a variation of refrigerant required by the refrigerating cycle. However, because of a secular change such as a looseness in the connection portion between the pipeline and the valve due to a faulty work in the early stage of installation or the vibration, a refrigerant leakage in which the refrigerant leaks from the refrigerating cycle may occur. If the refrigerant leakage occurs, the refrigerant within the refrigerating cycle gradually decreases, finally resulting in the uncooled condition.

However, since the refrigerant leaks through a minute interstice of the pipeline, mostly a slow leak occurs in which the refrigerant leaks at very slow rate. In the slow leak, since the refrigerant leaks gradually over several weeks or several months, no blowing sound of refrigerant occurs, and it is very difficult to find a change of the refrigerating cycle due to decreasing refrigerant because the daily variation amount is small. Also, since the liquid reservoir 35 holds the excess refrigerant in the refrigeration unit, even if the refrigerant leaks a little, the refrigerant level within the liquid reservoir 35 only drops, but there is no change of the refrigerating cycle, whereby it is further difficult to find the refrigerant leakage. And if the refrigerant level within the liquid reservoir 35 reaches a refrigerant output port at the lower part of the liquid reservoir, the two phase refrigerant containing gas flows out of the liquid reservoir 35, ultimately resulting in the uncooled condition. The refrigerant leakage is difficult to find because the leakage amount evaporates and is not left. Also, since the uncooled condition suddenly occurs, the number of claims in the market is greatest, whereby it is very meaningful to find the refrigerant leakage and take some measures such as refilling the refrigerant before the uncooled condition occurs. The states of refrigerant leakage in the refrigerating cycle are divided into three stages in order.

First of all, in an initial state of refrigerant leakage, the refrigerant level within the liquid reservoir 35 is fully high, so that the refrigerating cycle is not changed. This is the first stage. And if the refrigerant leakage progresses, the liquid level within the liquid reservoir 35 falls, and the refrigerant flowing out of the liquid reservoir 35 becomes the two phase refrigerant containing gas, which is then cooled and liquefied by the sub-cooling means 37 (including cooling the liquid pipeline due to the surrounding air). Consequently, the two phase refrigerant returns to the liquid refrigerant before coming to the expansion means, whereby the cooling power is fully secured. This is the second stage. And if the refrigerant leakage further progresses, the entrained amount of gas into the refrigerant flowing out of the liquid reservoir 35 increases, and the refrigerant can not be fully cooled by the cooling power of the sub-cooling means 37 (including cooling the liquid pipeline with the surrounding air), so that the two phase refrigerant containing gas flows into the expansion means, resulting in the uncooled condition because the required cooling power is not attained. This is the third stage in which the air conditioner or the refrigeration unit becomes useless. Since it is too late if the refrigerant leakage is found at this stage, the refrigerant leakage must be detected at the first stage and the second stage.

To detect the refrigerant leakage at the first stage, a special sensor for measuring the liquid level within the liquid reservoir 35 is requisite, but can not be applied to the existing machine, and may be different among individual products. However, since it is intended to detect the refrigerant leakage to be useful for the practical, cheap and standard refrigeration unit, a method for detecting the refrigerant leakage not at the first stage but at the second stage is considered here. At the second stage, since the refrigerant flowing into the sub-cooling means 37 is the two phase refrigerant, the cooling power of the sub-cooling means 37 is lower than at the time of full liquid refrigerant, and the sub-cool (degree of sub-cooling) of the refrigerant at the entrance of the expansion means 13 is smaller than in the condition without refrigerant leakage or at the first stage of the refrigerant leakage. Thus, if a change of this sub-cool (a difference between the condensation temperature and the liquid pipe temperature) is grasped, the refrigerant leakage can be specified.

However, if the outside air temperature is different, the amount of heat exchange in the condenser 12 is different in the refrigeration unit. Also, the surrounding air temperature around the evaporator 14 contained in the load side equipment such as the showcase or refrigerator is always controlled by opening or closing the flow passage opening/closing means 36 and a divergence of the expansion means 13. Further, the compressor 11 is placed under the volume control, installation number control or ON/OFF control, so that the refrigerating cycle may normally operate. In the refrigeration unit, the refrigerant is circulated through the pipeline to constitute the refrigerating cycle, whereby the state quantities of the refrigerating cycle are changed in correlation with each other. When the operating condition changes, the state quantities of the refrigerating cycle such as high pressure, low pressure and sub-cool (a difference between the condensation temperature and the liquid pipe temperature) are varied.

That is, the sub-cool (difference between the condensation temperature and the liquid pipe temperature) of the refrigerating cycle is changed by any of the heat exchange amount of the condenser 12, the control state of the flow passage opening/closing means 36 or the expansion means 13, the control state of the compressor 11, and the refrigerant leakage amount. Similarly, the other state quantities of the refrigerating cycle such as high pressure and low pressure than the sub-cool are also changed by any of the heat exchange amount of the condenser 12, the control state of the flow passage opening/closing means 36 or the expansion means 13, the control state of the compressor 11, and the refrigerant leakage amount. Accordingly, even if only a change of the sub-cool (difference between the condensation temperature and the liquid pipe temperature) of the refrigerating cycle is measured, it is not possible to specify whether the change of the sub-cool is caused by the refrigerant leakage or the changed operating condition of the refrigerating cycle.

However, since other change factors than the refrigerant leakage occur in the normal operation of the refrigeration unit, a plurality of state quantities including the sub-cool for the refrigerating cycle may be measured in the operating condition where there is no refrigerant leakage, and treated as an aggregate having the correlation with each other. Thereby, if the refrigerant leakage occurs, it can be specified out of the aggregate. In this manner, the method for grasping the plurality of state quantities as the aggregate employs the Mahalanobis distance as previously described.

When the method of the Mahalanobis distance was employed to detect the refrigerant leakage in the refrigerating cycle, it was found as a result of examination that the feature amounts of the refrigerant leakage from the refrigeration unit are high pressure, low pressure and sub-cool. The feature amount means the state quantity to be changed, when the phenomenon occurs. Now, assuming that the high pressure of the refrigerating cycle is X1, the low pressure is X2 and the sub-cool is X3, a total of n (2 or greater) combinations are produced by changing X1 and X2 in the condition where there is no refrigerant leakage, and X1 to X3 are measured for each combination. The measured values are made the reference data. And the mean value and the standard deviation (dispersion of data) of X1 to X3 have been already explained in the expressions (1) and (2). The original X1 to X3 are normalized into x1 to x3 as shown in the expression (3) employing these values. Herein, j is any number from 1 to n, corresponding to the n measured values. The correlation matrix R representing the correlation of x1 to x3 and the inverse matrix R−1 of the correlation matrix are obtained as shown in the expression (4).

Employing the mean value, the standard deviation and the matrix representing the correlation, the data can be treated as the aggregate having a certain distribution. This aggregate of data is called a unit space. And the unit space for the normal state which is based on for the judgement, or no refrigerant leakage state herein, is called a reference space. Also, the data constituting this reference space is called the reference data.

The Mahalanobis distance D2 is defined by the expression (5). In the expression (5), j is any number from 1 to n, corresponding to n measured values. Also, k is the number of items (parameters), or 3 here. Also, all to akk are factors of the inverse matrix of the correlation matrix. The Mahalanobis distance is about 1 in the reference space, namely, when there is no refrigerant leakage. And the high pressure X1, the low pressure X2 and the sub-cool (difference between the condensation temperature and the liquid pipe temperature) X3 corresponding to the refrigerant leakage amount to be detected are measured, and the Mahalanobis distance in the refrigerant leakage state is obtained and stored as a threshold. At this time, the inverse matrix of the correlation matrix is obtained in the no refrigerant leakage state as the reference.

Figure 6:
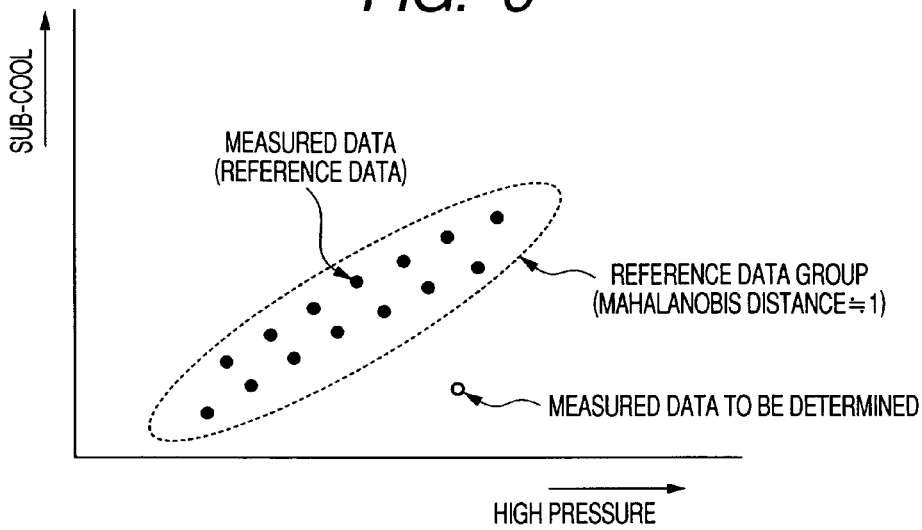
FIG. 6 is a view showing the concept of the Mahalanobis distance according to the embodiment 1 of the invention.

The concept of the Mahalanobis distance is shown in FIG. 6. FIG. 6 shows the correlation between two parameters in which the high pressure is taken along the transverse axis and the sub-cool (difference between the condensation temperature and the liquid pipe temperature) is taken along the longitudinal axis. That is, if the high pressure is increased, the sub-cool is increased. Though the measured data has some dispersion depending on the operating condition or a difference in the control of the apparatus, it falls within a certain range in the no refrigerant leakage state, because there is the correlation between the high pressure and the sub-cool. The reference space is created from these measured data as the reference data. There is also the correlation between other state quantities, such as between the high pressure and the sub-cool. And it is judged, based on the Mahalanobis distance, whether the data for judgement is normal or abnormal for the reference space (reference data).

Also, it can be judged whether the Mahalanobis distance and its occurrence ratio are normal or abnormal, for any number of parameters, depending on the positional relation between the computed Mahalanobis distance and the reference space, as already described with FIG. 4. In the reference space, there is the property that the Mahalanobis distance has the mean value of about 1, and is 4 or less in consideration of dispersion. And in the real machine, measurement means for measuring each instrumentation amount of the refrigeration unit is provided, the measured values being processed in accordance with the previous expressions to acquire the state quantities and the Mahalanobis distance. Then, the magnitude of the Mahalanobis distance corresponds to the refrigerant leakage amount, whereby the refrigerant leakage can be known from the magnitude of the Mahalanobis distance. The Mahalanobis distance is usually 4 or less in the reference space (normal space), in which the operation is normal within this threshold, or the operation is regarded as abnormal beyond this threshold. In practice, however, since there is a detection error problem, the threshold for judging the refrigerant leakage is set to an appropriate value greater than 4, for example, 50. The threshold is set to the value equivalent to the refrigerant amount at the second stage of refrigerant leakage before the refrigerating cycle becomes in the uncooled state.

Figure 7:
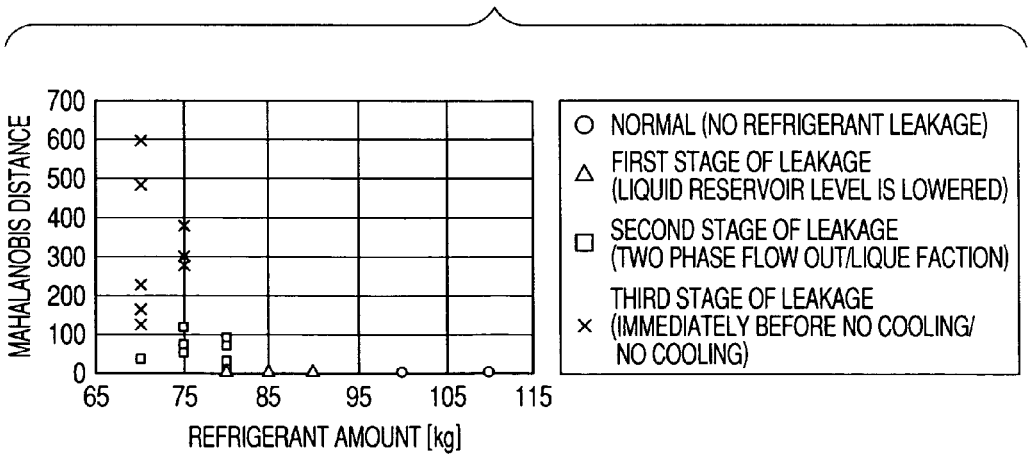
FIG. 7 is a view showing the relationship between the refrigerant leakage degree and the Mahalanobis distance according to the embodiment 1 of the invention.

In FIG. 7, the refrigerant amount within the refrigerant circuit is taken along the transverse axis, and the Mahalanobis distance is taken along the longitudinal axis. That is, FIG. 7 is an example representing the relationship between the refrigerant leakage amount and the Mahalanobis distance in the real machine. In FIG. 7, the circle normal indicates that the reference space is created using the data in the no refrigerant leakage state, the triangle indicates the first stage where the liquid level of the liquid reservoir is lower, the square indicates the second stage where the two phase refrigerant flows out and is liquefied, and the cross indicates the third stage that is immediately before uncooled state and the uncooled state. In the no refrigerant leakage state and the first stage of refrigerant leakage, the Mahalanobis distance is not changed, but in the second and third stages, the Mahalanobis distance is gradually increased. Since the feature amounts are the high pressure, the low pressure and the sub-cool here, it is not possible to distinguish between the normal state and the first stage. However, if a sensor for sensing a change in the liquid level of the liquid reservoir (refrigerant amount within the liquid reservoir) is mounted, and the refrigerant amount within the liquid reservoir is added to the feature amounts, the Mahalanobis distance is changed between the normal state and the first stage, thereby making it possible to distinguish between the normal state and the first stage. Accordingly, the normal range can be set more strictly by increasing the instrumentation amounts. Other than this normal stage and the abnormal stage of failure or close failure, an intermediate stage may be provided between the normal stage and the abnormal stage. Thereby, the time elapsed before the failure occurs is inferred by detecting the intermediate stage, and the failure is foreseen. Thus, the reliable operation of the equipment or the apparatus can be assured. At this intermediate stage, a characteristic deterioration phenomenon for the electric parts is captured, a partial abnormal contact of mechanical parts or a change in the surface roughness or deterioration may be captured.

Figure 8:
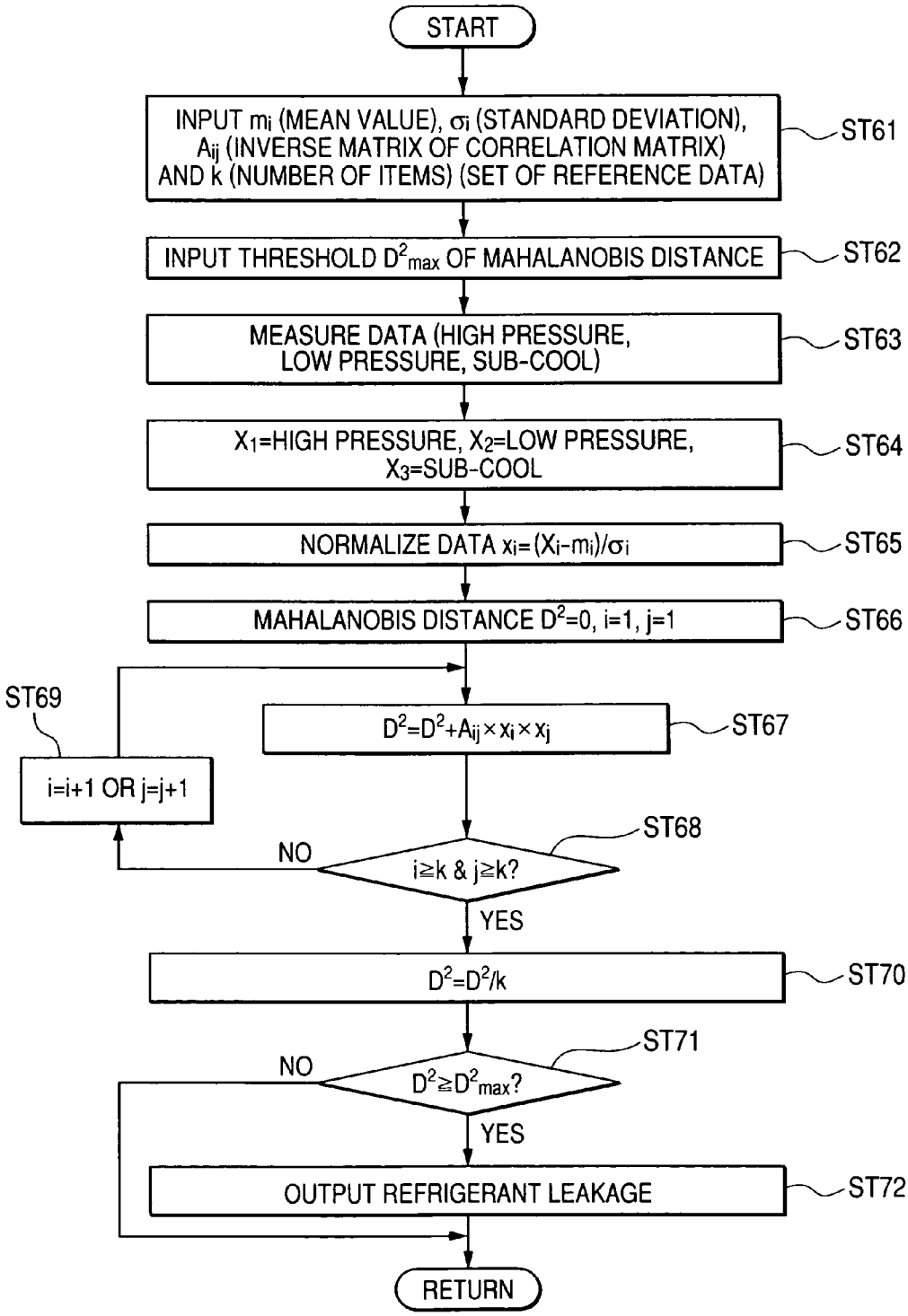
FIG. 8 is an operation flowchart according to the embodiment 1 of the invention.

Referring to a flowchart of FIG. 8, the operation will be described below. First of all, the mean value, the standard variation, the inverse matrix of the correlation matrix, and the number of items for the reference data are set (ST61), and the threshold for the Mahalanobis distance is set (ST62). Then, the high pressure, the low pressure and the liquid pipe temperature are measured, and the sub-cool is calculated from the high pressure and the liquid pipe temperature (ST63), and the high pressure, the low pressure and the sub-cool are put into X1 to X3 in order (ST64). And the data is normalized in accordance with the expression (9) (ST65), and the Mahalanobis distance is set to the initial value 0 and the counters i and j are set to the initial value 1 (ST66). Then, the counters i and j are changed until the number k of items is reached, and the expression (5) is computed (ST67 to ST70). The above computation is performed by arithmetic means. And the computed Mahalanobis distance and the threshold are compared by comparison means, and whether or not the Mahalanobis distance exceeds the threshold is judged by judgement means (ST71). If the answer is YES, the occurrence of refrigerant leakage is regarded, and outputted to the output means. For example, an indication of the refrigerant leakage or the output of voltage is made (ST72).

Though the refrigerant leakage is inferred from three instrumentation amounts or state quantities of the high pressure, the low pressure and the sub-cool (a difference between the condensation temperature and the liquid pipe temperature) for the refrigerating cycle in the above example, the invention is not limited to the above example. The condensation temperature (saturation temperature of the evaporator) may be employed, instead of the high pressure, or the evaporation temperature (saturation temperature of the evaporator) may be employed instead of the low pressure. Also, more than three state quantities may be employed to acquire the Mahalanobis distance, whereby the detection precision is improved. Also, though the liquid pipe temperature detection means 38 is installed at an outlet pipe of the sub-cooling means in the above example, the invention is not limited to the above example. The liquid pipe temperature detection means may be installed anywhere in the liquid pipeline to achieve the same effect. The sub-cool (difference between condensation temperature and liquid pipe temperature) at the position where the liquid pipe temperature detection means is installed should be as great as possible, because the detection precision of refrigerant leakage is enhanced. It is preferable that the liquid pipe temperature detection means is installed on the high pressure side and at the position as close as possible to the expansion means.

Though the refrigeration unit having the liquid reservoir 35 is described in the above example, other apparatuses such as an air conditioner having the liquid reservoir 35 may achieve the same effect based on the same principle, as far as the excess refrigerant is reserved in the liquid reservoir 35. Also, if the excess refrigerant is reserved in the liquid reservoir, the same thing can be said for the other different constitution of the equipment. For example, in the refrigeration unit having the liquid reservoir and an accumulator, because the excess refrigerant is reserved in the liquid reservoir, the same effect can be achieved with the same principle.

Figure 9:
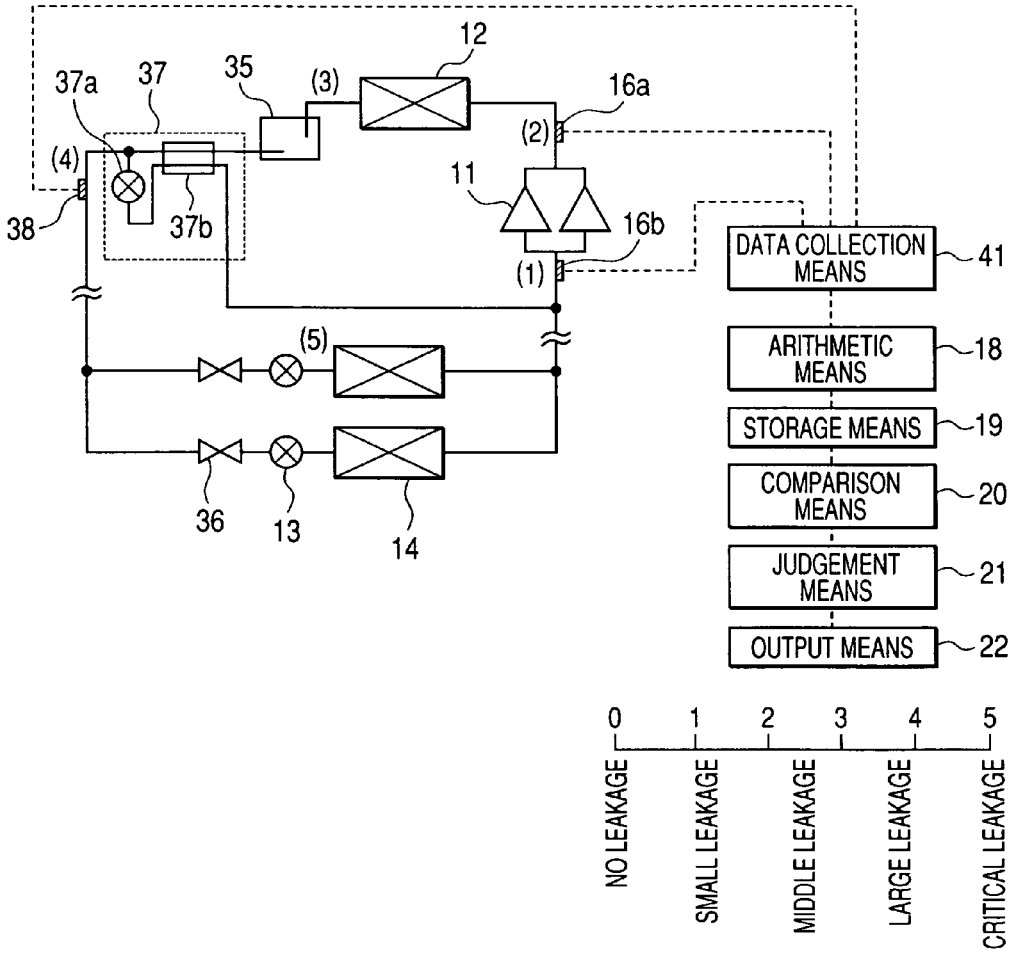
FIG. 9 is another block diagram of the refrigerating cycle apparatus according to the embodiment 1 of the invention.

Also, the Mahalanobis distance may be directly outputted as the refrigerant leakage amount. The square root of the Mahalanobis distance is called a D value. The D value equivalent to the critical refrigerant leakage amount is obtained and associated with the maximum output voltage, for example, 5V. The D value maybe associated with the voltage from no refrigerant leakage, small leakage, middle leakage, large leakage to the critical refrigerant leakage amount, as shown in FIG. 9, and outputted from the output means 22. FIG. 9 shows the constitution of the refrigerating cycle apparatus in the same manner as shown in FIG. 2, in which the voltage indicating the large or small level of leakage amount is outputted from the output means 22, as shown in FIG. 9. The Mahalanobis distance as described so far is proportional to the square of the deviation of each state quantity, but the D value, which is the square root of the Mahalanobis distance, is proportional to the deviation of each state quantity, and easy to treat in association with the voltage.

Figure 10:
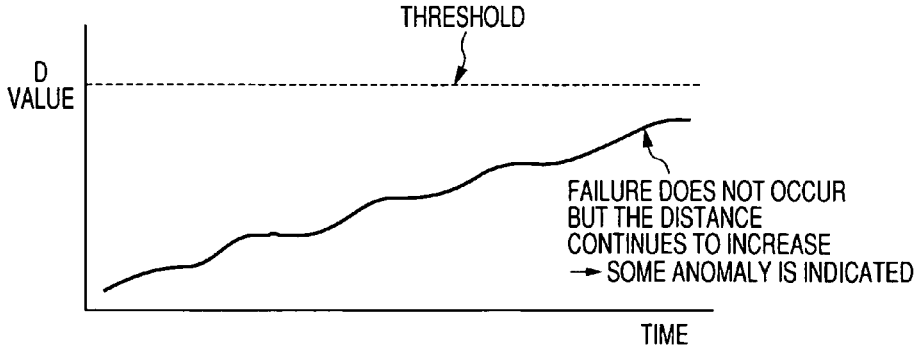
FIG. 10 is an explanatory view showing the time transition of the Mahalanobis distance according to the embodiment 1 of the invention.

FIG. 10 is a graph representing a transition of the D value from the normal state with the passage of time, when a certain abnormality occurs, in which the time is taken along the transverse axis and the D value is taken along the longitudinal axis (square root of the Mahalanobis distance). The D value is the value of 2 or less in the normal state. As shown in the graph, the D value gradually changes to a larger value with the passage of the time upon the certain abnormality. Accordingly, the time elapsed before the failure occurs can be inferred from the relationship between the increasing tendency of the D value and the threshold of failure, whereby it is possible to prevent the apparatus from being abnormally stopped by making proper maintenance before the inferred failure time. For example, if one month is spent for the D value to reach half the threshold from the normal state at the initial time, it is expected that one more month is taken for the D value to reach the threshold, resulting in the failure state. Also, when the D value changes less proportionally, for example, when the increasing speed of the D value for one week recently is larger, the failure time can be foreseen employing the changing speed of the D value for the one week, whereby the more accurate failure prediction can be made. Instead of the D value, the Mahalanobis distance may be employed to achieve the same thing.

An example of refrigerant leakage will be described in more detail. Once the refrigerant leakage occurs, the expanding refrigerant leakage is not stopped unless the refrigerant leakage portion is closed or the refrigerant is refilled, whereby the Mahalanobis distance and the D value has a continuously increasing tendency. Accordingly, when the Mahalanobis distance or the D value has a continuously increasing tendency, there is possibility of the refrigerant leakage, whereby the refrigerant leakage is judged, even if the Mahalanobis distance or the D value does not reach the threshold. The time elapsed before the threshold is reached, namely, the time elapsed before the refrigerant leakage reaches the critical amount, can be foreseen from the changing speed of the distance. Since the state quantities of the refrigerating cycle are always changing, the Mahalanobis distance and the D value change even if the refrigerant leakage amount is not varied. Accordingly, the increasing tendency as used herein means not the monotonous increase at any time but the increasing tendency as a whole, except for the minute increase or decrease. And the time when the critical refrigerant leakage amount is reached may be outputted by voltage from the output means, based on the predicted time elapsed before the refrigerant leakage reaches the critical amount.

Figure 11:
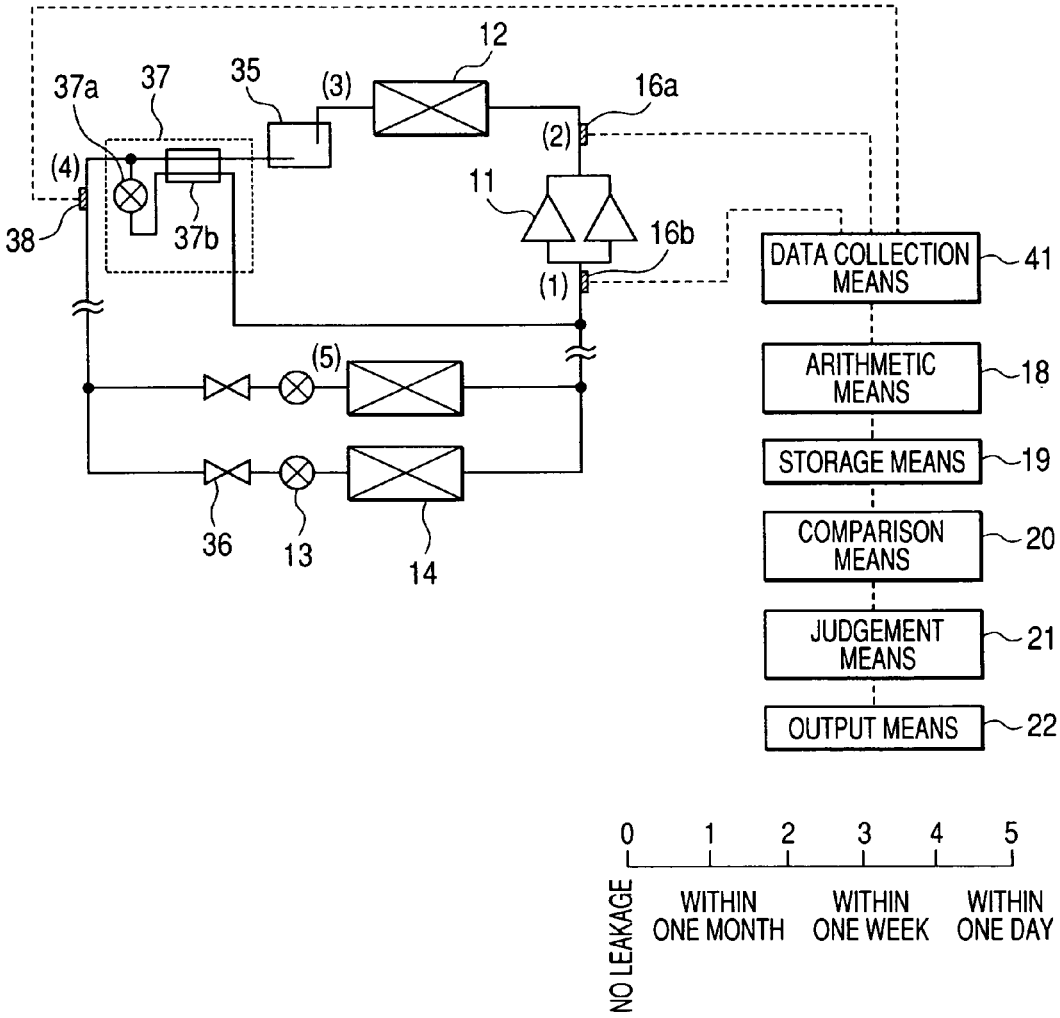
FIG. 11 is another block diagram of the refrigerating cycle apparatus according to the embodiment 1 of the invention.

FIG. 11 shows another configuration of the refrigerating cycle. The configuration of FIG. 11 is the same as that of FIGS. 2 and 9, except that the refrigerant leakage situation can be set from the output means 22 with the time proportional to the distance, such as within one day for 5V, within one week for 3V, within one month for 1V, and no refrigerant leakage for 0V.

Also, though the data measured by each detection means and employed by the arithmetic means is the fixed value, the data may be similarly treated by taking the mean value of the data over a certain period of time, even if the data is varied, whereby the same effect can be achieved. The physical quantities of the fluid such as pressure and temperature are treated here. Since those physical quantities are varied with a time lag to be treated as the stationary data even if there is a state change in the fluid circuit, the feature data of several tens cycles or several kilocycles are not treated, but the data detection results obtained at regular time intervals over, for example, one minute, ten minutes, several hours or several days, may be averaged, whereby the refrigerant leakage can be detected simply and precisely.

Also, though the method for grasping the plurality of state quantities as an aggregate employing the Mahalanobis distance has been described above, other methods such as the multivariable analysis or making the arithmetic operation on plural correlated detection data may be employed. One of the other methods may involve computing the heat exchange amount in the sub-cooling means. Referring to the block diagram of FIG. 2, a method for making the judgement based on the state quantities resulted from the arithmetic operation other than the distance will be described below.

The heat exchange amount in the sub-cooling means 37 is decided by the flow rate and temperature of the refrigerant flowing through the main circuit, namely, the refrigerant flowing via the flow passage opening/closing means 36 and the expansion means 13, and the flow rate and temperature of the refrigerant flowing through the branch, namely, the refrigerant flowing via the branch expansion means 37*a*. Assuming that the flow rate and temperature of the refrigerant flowing through the main circuit are GMR and TMR, the flow rate and temperature of the refrigerant flowing through the branch are GBR and TBR, the heat exchange amount in the liquid pipe heat exchange means 37*b* is QSC, the heat transfer area of the liquid pipe heat exchange means 37*b* is ASC, and the overall heat transfer coefficient is KSC, the following expression simply holds.

[Numerical Expression 6]

$$D = D \text{ value (Mahalanobis distance to the power of } 1/2) \text{ for space (normal or abnormal)} \quad (6)$$

Herein, the heat transfer area ASC is constant, and the overall heat transfer coefficient KSC is not changed too greatly, but is increased if the refrigerant flow rate is greater. Also, the temperature TMR of refrigerant in the main circuit is the liquid pipe temperature detected by the liquid pipe temperature detection means 38, and has a strong correlation with the condensation temperature that is the saturation temperature at the high pressure detected by the high pressure detection means 16*a*. The refrigerant temperature TBR in the branch is the evaporation temperature that is the saturation temperature at the low pressure detected by the low pressure detection means 16*b*. Accordingly, the heat exchange amount QSC in the liquid pipe heat exchange means 37*b* is changed depending on a difference between the condensation temperature and the evaporation temperature, in which if this difference is greater, the heat exchange amount QSC is increased. The heat exchange amount is the value of the composite variable thereof. And the refrigerant flowing into the liquid pipe heat exchange means 37*b* is usually liquid. If the refrigerant leaks and is smaller in the amount, the refrigerant becomes in the two phase state, whereby most of the heat amount is employed to condense the two phase refrigerant, so that the sub-cool (difference between condensation temperature and liquid pipe temperature) is reduced at the exit of the liquid pipe heat exchange means 37*b*.

Hence, the sub-cool (or liquid pipe temperature) in the normal state is learned and stored in the relationship between the high pressure (or condensation temperature) and the low pressure (or evaporation temperature), or the difference between the high pressure and the low pressure (or difference between condensation temperature and evaporation temperature), whereby the refrigerant leakage is detected by referring to its change. That is, the change of the specific parameter may be taken out and outputted without relying on the Mahalanobis distance as described above.

For all the methods, any kind of refrigerant flowing through the refrigerating cycle of the refrigeration unit may be employed. For example, a one-component refrigerant such as R22 or R32, a ternary system mixed refrigerant such as R407C, a binary system mixed refrigerant such as R410A, HC refrigerant such as propane, or a natural refrigerant such as CO2, may be employed. The refrigerant having adverse influence on the global atmospheric protection can be exchanged if the refrigerant starts to leak even a little. Also, the leakage of the combustible refrigerant can be treated in advance before the problem occurs, if the critical value on safety as defined in the specifications is displayed. Further, in the refrigeration unit employing the combustible refrigerant or the refrigerant containing a considerable amount of combustible component, for example, propane, R32or R410A, or the refrigerant harmful to the human body, the refrigerant leakage is dangerous in the sense of safety. When the refrigerant leakage is detected and outputted as an electric signal of voltage or a communication code, it is outputted prior to the abnormality in other refrigeration units to remarkably enhance the safety.

Figure 12:
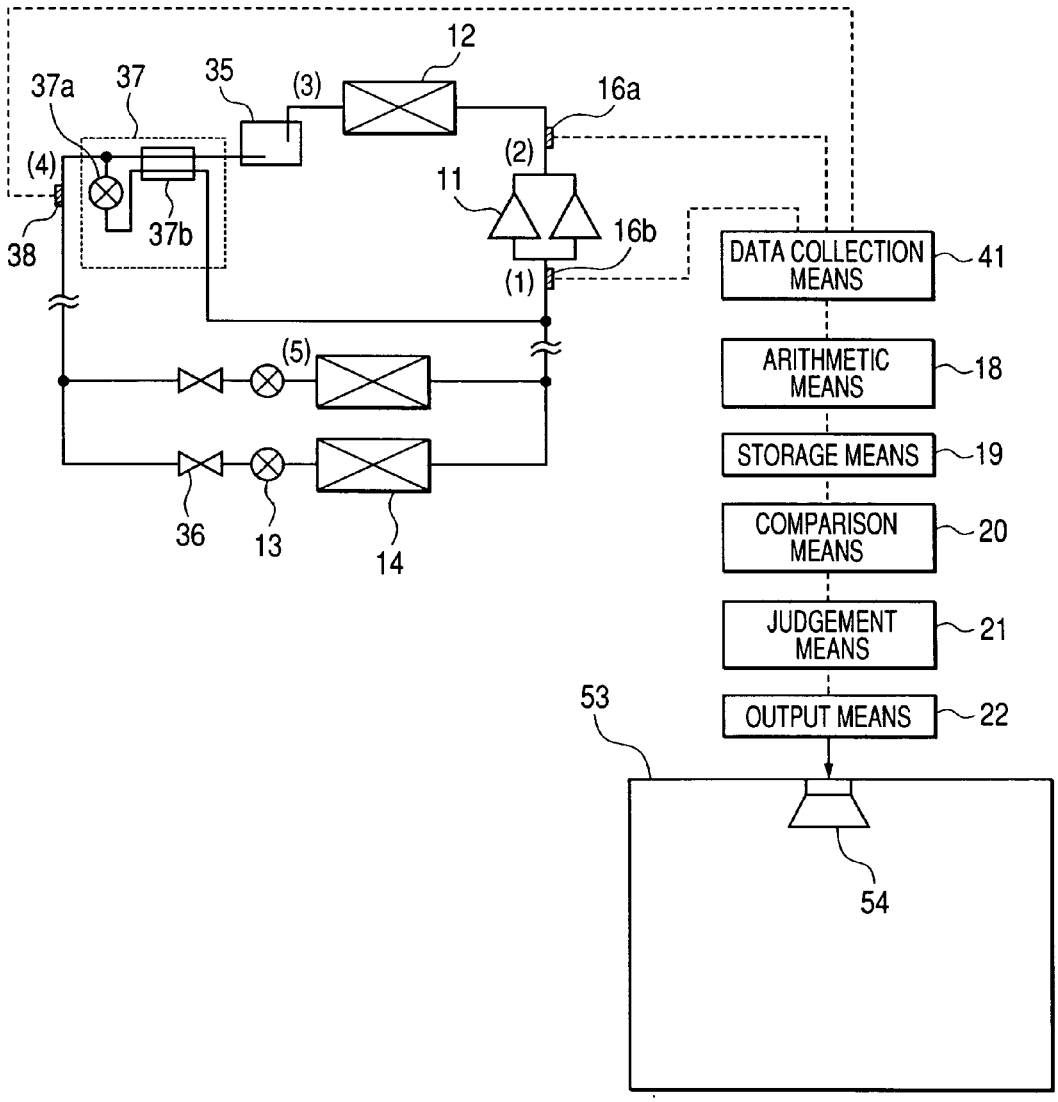
FIG. 12 is another block diagram of the refrigerating cycle apparatus according to the embodiment 1 of the invention.

FIG. 12 shows a block diagram of another refrigerating cycle apparatus. The output means 22 is connected as a voltage output or current output to an alarm unit 54 that raises the alarm by sound or light to notify the refrigerant leakage in its early stage. Since the alarm unit 54 is provided in an office 53, any leakage can be immediately informed. With this configuration, even if the fluid is a combustible gas or a liquid harmful to the human body, for example, a chemical, the leakage can be informed by the alarm unit in the early stage with limited influence.

Also, though the refrigeration unit has the liquid reservoir or the liquid pipe temperature detection means in the above example, the refrigeration unit may be an air conditioner having a mechanism for reserving the excess refrigerant at the high pressure or intermediate pressure, because the abnormality of refrigerating cycle can be likewise judged for any load side equipment in the similar refrigerating cycle. Also, for the fluid in a chemical manufacturing apparatus or a fuel depot, for example, other than the refrigerating cycle, a plurality of instrumentation amounts such as physical quantities of the relevant fluid maybe detected, and the state quantities calculated from these variables at the normal time and the abnormal time are compared, whereby the abnormality can be judged in its early stage.

Figure 13:
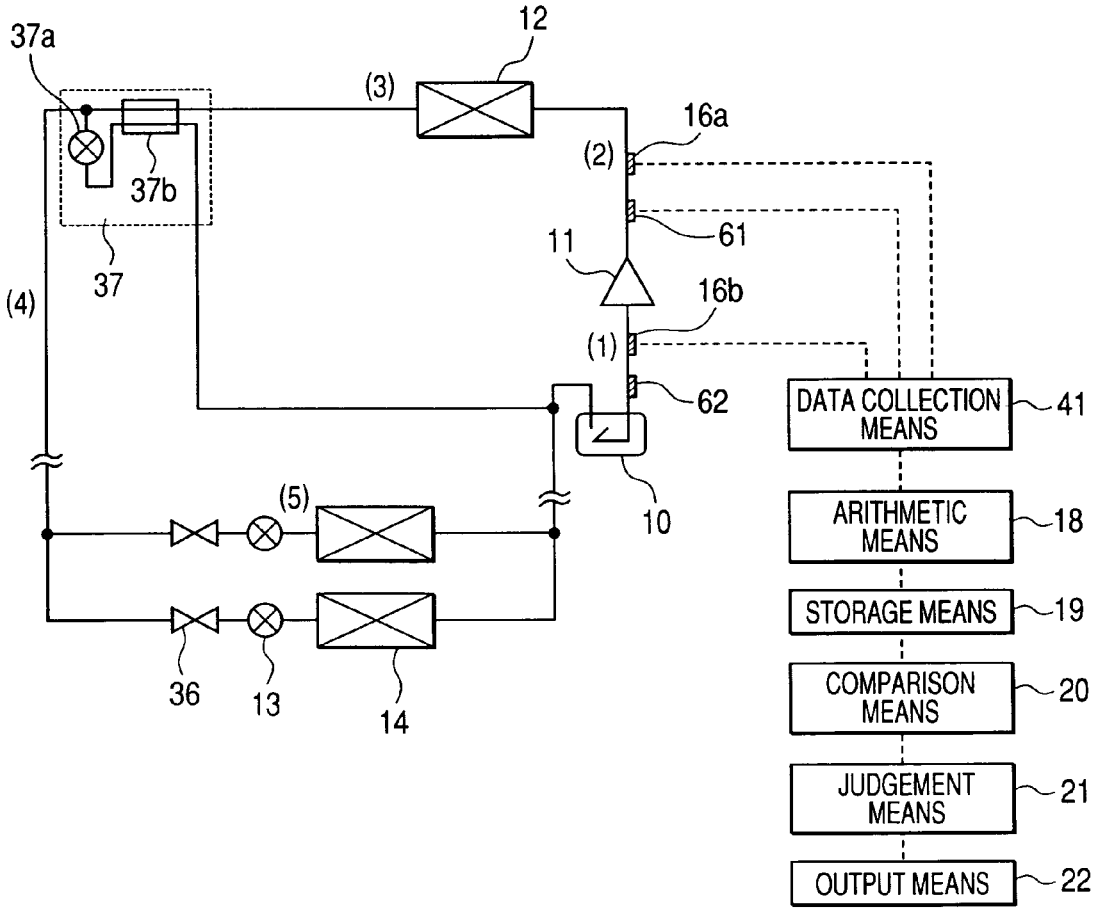
FIG. 13 is another block diagram of the refrigerating cycle apparatus according to the embodiment 1 of the invention.

FIG. 13 shows a block diagram of another refrigerating cycle apparatus. In an air conditioner having the accumulator 10, discharge temperature detection means 61 and suction temperature detection means 62 as shown in FIG. 13, the above explanation can hold in the same manner. In the case of the air conditioner with the configuration as shown in FIG. 13, the excess refrigerant is reserved in the accumulator 10. If any excess refrigerant resides within the accumulator 10, the refrigerant flowing out of the accumulator 10 is the saturated gas refrigerant. However, if the refrigerant leakage occurs, the excess refrigerant is reduced, and the refrigerant level within the accumulator falls below the position of the outlet pipe for the accumulator, the refrigerant gas flows out of the accumulator. Then, since the suction temperature 62 or the discharge temperature 61 of the detection means is increased, the refrigerant leakage can be determined by performing the same processing with the high pressure or condensation temperature, the low pressure or evaporation temperature, or the suction temperature or discharge temperature, as the feature amounts.

Also, in the equipment without the liquid reservoir 35 or the accumulator 10, for example, a room air conditioner, or a chilling unit, though the excess refrigerant is reserved within the condenser, the refrigerant leakage can be determined by the same method, because the change or behavior of the state quantities of the refrigerating cycle when the abnormality occurs can be foreseen by simple computation. That is, the excess refrigerant is usually reserved in apart of the condenser, but if the refrigerant leakage occurs, the refrigerant amount reserved within the condenser is reduced, and the area contributing to the heat transfer of the condenser is increased, so that the high pressure slightly falls and the sub-cool decreases. Accordingly, the refrigerant leakage can be determined by performing the same processing with the high pressure or condensation temperature, the low pressure or evaporation temperature, or the liquid pipe temperature as the feature amounts. Also, since the discharge temperature is lower, the discharge temperature may be selected as the feature amount.

Figure 14:
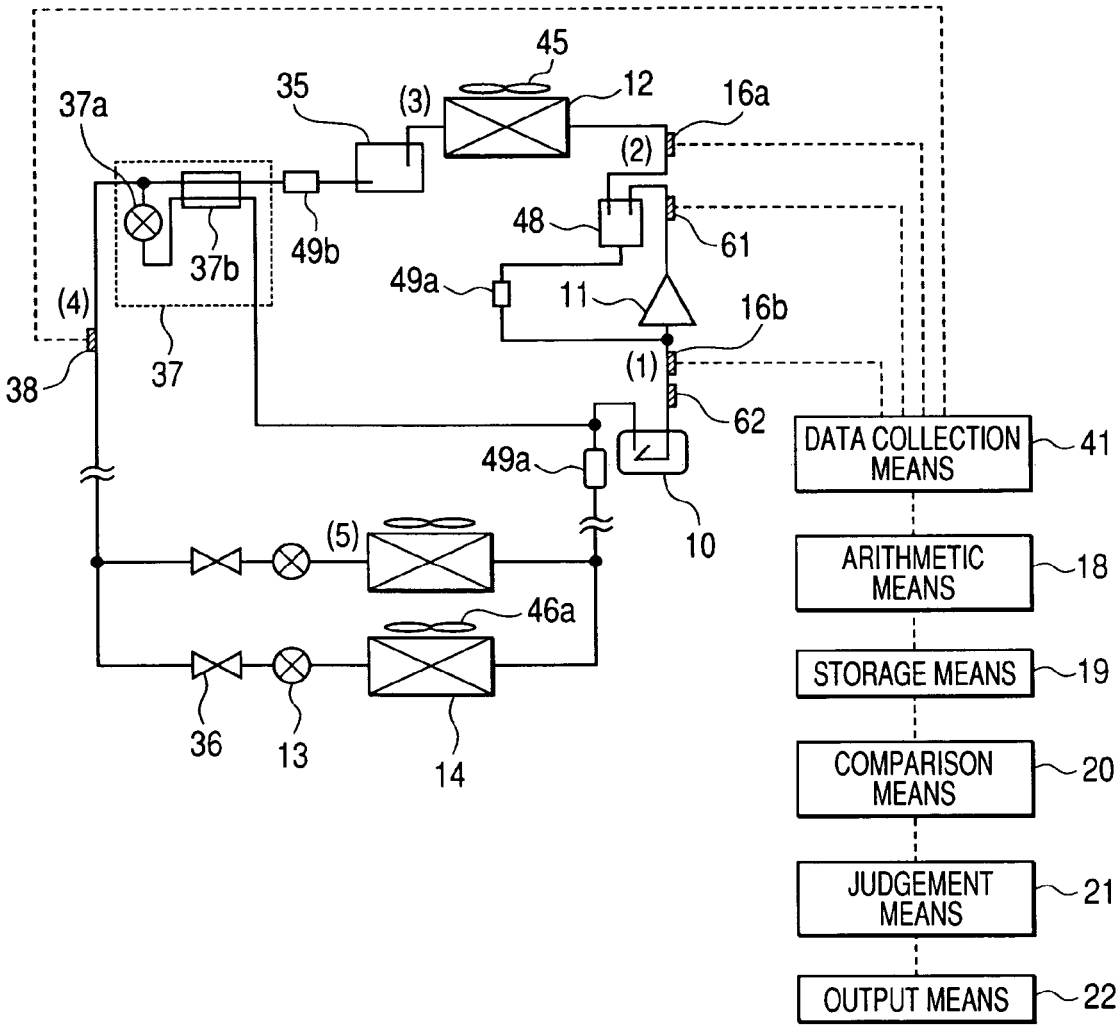
FIG. 14 is another block diagram of the refrigerating cycle apparatus according to the embodiment 1 of the invention.
Figure 15:
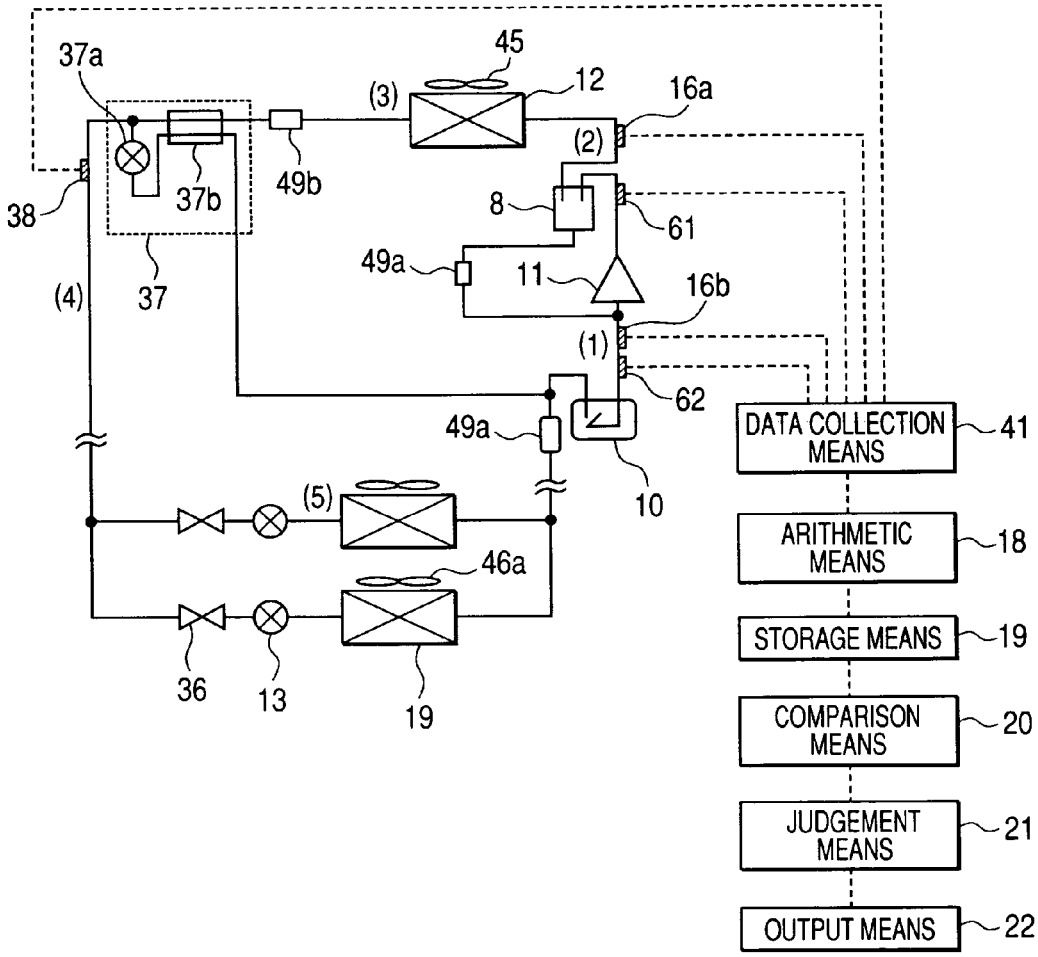
FIG. 15 is another block diagram of the refrigerating cycle apparatus according to the embodiment 1 of the invention.

Also, though the refrigerant leakage as the refrigerating cycle abnormality has been described in the above example, the abnormality discrimination can be made for other abnormalities, because the behavior of the refrigerating cycle when the abnormality occurs can be foreseen by simple computation. The abnormality as used herein means not only the failure of the equipment, but also a secular change such as a deterioration of the equipment, in which any abnormality can be detected if the operating condition changes. FIGS. 14 and 15 are block diagrams of another refrigerating cycle apparatus. In the refrigeration unit having the liquid reservoir 35 as shown in FIG. 14 or the air conditioner having the accumulator as shown in FIG. 15, it is possible to detect or discriminate, with the same configuration, a deterioration or liquid back-flow due to the lifetime of the compressor 11, a blemish or breakage on the surface of heat exchange of the heat exchanger for the condenser 12 or the evaporator 14, a deterioration or failure of the air blower unit 45 of the condenser 12 or the air blower unit 46*a* of the evaporator, a clogging of a strainer 49*a* for removing the contaminant inside where the refrigerant of fluid is circulated or a dryer 49*b* for preventing the humidity of the refrigerant, a bend, rupture or clogging of the pipeline, or a deterioration of the refrigerator oil used for the compressor 11 (which is detected by clogging of the pipe, false lubrication of the compressor, or a change of the heat transfer amount).

Also, the unit space on the arithmetic operation is composed of the mean value, the standard deviation and the correlation coefficients of each feature amount, but they are stored in a memory on the board in the refrigerating cycle apparatus. When all or a part of them are learned on the real machine, it is required that they are stored in the rewritable memory. Also, if the unit space is set, an intermediate stage can be grasped in the distance between the normal and abnormal conditions. By providing this intermediate stage, it is possible to capture the gradually changing characteristic such as the refrigerant leakage as already described, whereby the failure can be predicted. It is possible to make the diagnosis for accurately distinguishing the degree of abnormality for a malfunction in the middle stage, which is not reasoned out by the normal state and the abnormal state, such as a liquid back-flow phenomenon where the compressor has a large or small liquid return amount, a gradual decrease in the electrical characteristics due to deteriorated electric parts, a partial deformation of the mechanical parts, a gradual coarseness of the contact surface, a bad condition of the relevant equipment or connection part, an expansion or deformation due to high temperatures, or a malfunction due to low temperatures, other than the leakage.

As will be apparent from the above explanation, with the configuration of the invention, the refrigerating cycle abnormality such as refrigerant leakage can be detected precisely by comprising the high pressure measurement means for measuring the high pressure of the refrigerating cycle apparatus or the condensation temperature measurement means for measuring the saturation temperature at the high pressure, the low pressure measurement means for measuring the low pressure or the evaporation temperature measurement means for measuring the saturation temperature at the low pressure, and the liquid temperature measurement means, the discharge temperature measurement means or the suction temperature measurement means, and further comprising the arithmetic means for performing the arithmetic operation on the composite variables from the measured values, the storage means for storing the measured values of each measurement means or the arithmetic values such as the composite variables arithmetically obtained from the measured values, the comparison means for comparing the value stored in the past in the storage means with the current measured value or the arithmetic value, and the judgement means for judging the refrigerant leakage based on the comparison result. The presentation data measurement means such as temperature measurement may be of any other type, for example, based on the source current for the driving motor. The measured data taken into the composite variables may be changed, or more measured data may be employed for the composite variables, whereby the precision is further increased.

Also, the degree of abnormality such as the refrigerant leakage amount in the refrigerating cycle is calculated by the arithmetic means, and the time at which the abnormality limit capable of keeping the predetermined cooling power is reached is predicted from the value of the degree of abnormality, whereby the refrigerating cycle abnormality can be found in the early stage. Further, if output means for outputting the predicted time at which the abnormality limit is reached by an electric signal with the magnitude of voltage or current is provided, the found abnormality can be conveyed in the early stage. Also, if the refrigerant contains not a little combustible component, and the output means is connected to an alarm unit that raises the alarm by sound or light, the found abnormality such as deterioration can be conveyed in the early stage.

The abnormality of the refrigerating cycle apparatus can be grasped to some extent by a change of the Mahalanobis distance or the D value, as already described. However, it is very difficult to specify what the cause of abnormality is, or infer the degree of abnormality such as refrigerant leakage amount on the real machine. Next, in the invention, a method for specifying the cause of abnormality and inferring the degree of abnormality or the degree of normality will be described below. In the following explanation, the refrigerant leakage in the refrigeration unit principally having the liquid reservoir in the same manner as already described will be exemplified. First of all, three reasons why it is difficult to specify the cause of abnormality are listed below.

The first reason is that there are a variety of abnormalities. For the normal state where no abnormality occurs, the reference space is created. Since the Mahalanobis distance or the D value takes a small value in the reference space, the abnormal state, namely, abnormality can be grasped by its change. However, there are a variety of abnormalities, including the refrigerant leakage, a liquid back-flow to the compressor, a blemish of the condenser or the evaporator, a deterioration or failure of the air blower unit of the condenser or the evaporator, clogging of the pipeline, a dryer or a strainer, a bend, rupture or clogging of the pipeline, or a deterioration of the refrigerator oil, where by even if any of the abnormalities occurs, the Mahalanobis distance and the D value are increased. Accordingly, it is difficult to specify the cause of abnormality only by seeing the Mahalanobis distance or the D value.

The second reason is that the Mahalanobis distance or the D value does not represent the degree of abnormality itself. Even if the cause of abnormality can be inferred from the Mahalanobis distance or the D value, the larger value of the Mahalanobis distance or the D value indicates that the degree of abnormality is surely increased. However, taking the refrigerant leakage as an example, it is not possible to know, from the Mahalanobis distance alone, what percent of the refrigerant leaks when the Mahalanobis distance is 10. To specify this percent, it is required to clarify the correspondence between the Mahalanobis distance and the degree of abnormality, for example, such that the Mahalanobis distance of 50 is the critical refrigerant leakage amount. However, it is very difficult to regenerate all the abnormalities in advance and quantify them.

The third reason is that an installation work for the refrigerating cycle apparatus or the like is performed on the actual place. For example, taking the refrigeration unit installed in the supermarket as an example, since the refrigeration unit and the showcase are not necessarily made from the same marker, it is not possible to grasp which showcase is connected to the refrigeration unit, how much content volume the showcase has, and how many showcases are connected. Also, the distance between the refrigeration unit and the showcase is quite different depending on whether or not the shop is one-storied, or whether the shop is in the high building, and thereby the length of an extension pipeline connecting the refrigeration unit and the showcase is varied, where by the filled refrigerant amount is different. Accordingly, the refrigerant of the refrigeration unit is filled in such an amount that the refrigerating cycle may be appropriately operated after the refrigeration unit, the load side equipment and the extension pipeline are connected on the actual place. Accordingly, the reference space created in the state without refrigerant leakage can not be made at the factory shipment stage of the refrigeration unit, but must be made after the system is connected on the actual place. Accordingly, it is more difficult to obtain the correspondence between the Mahalanobis distance or D value and the refrigerant leakage amount.

Figure 16:
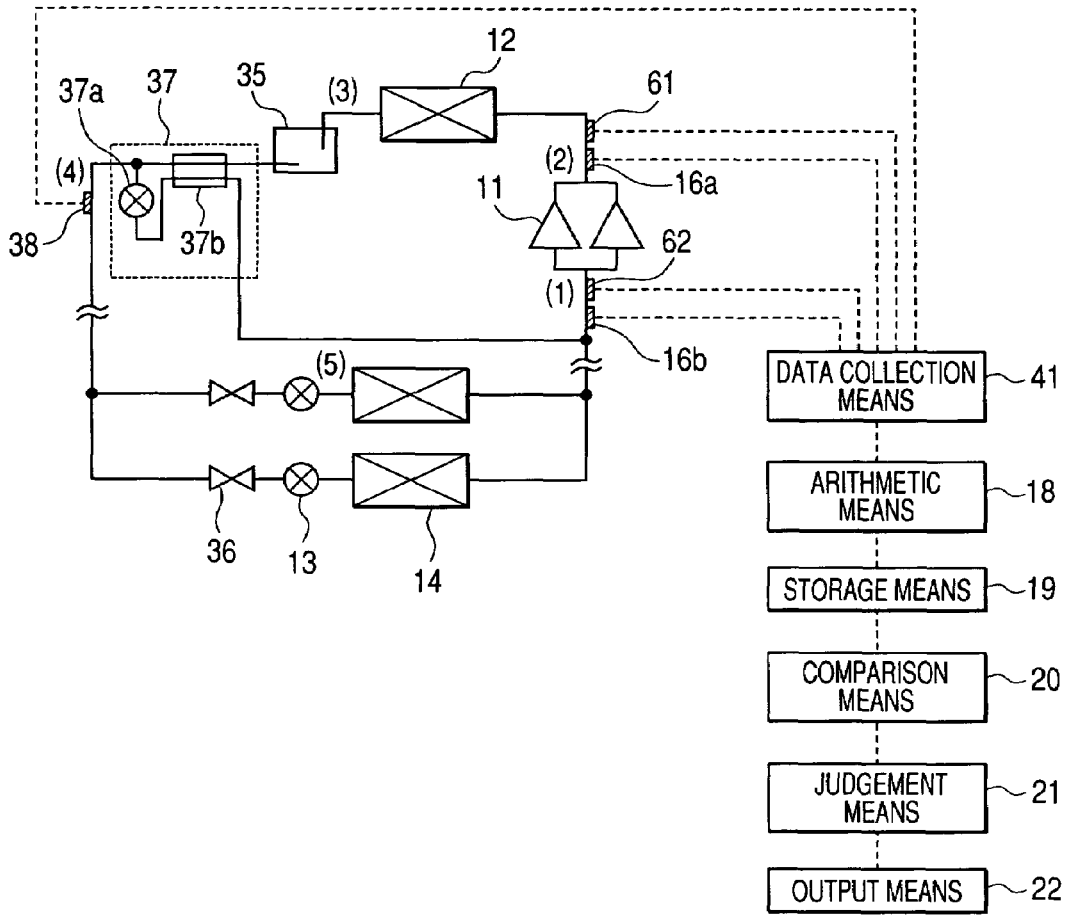
FIG. 16 is another block diagram of the refrigerating cycle apparatus according to the embodiment 1 of the invention.

A method for solving the above problem will be described below. FIG. 16 is a block diagram of the refrigerating cycle apparatus. Reference numeral 16*a* denotes high pressure detection means, 16*b* denotes low pressure detection means, 38 denotes liquid pipe temperature detection means, 61 denotes discharge temperature detection means, and 62 denotes suction temperature detection means. The sub-cool is calculated from the high pressure detection means 16*a* and the liquid pipe temperature detection means 38, and the superheat is calculated from the low pressure detection means 16*b* and the suction temperature detection means 62. The other configuration is the same as in the explanation of FIG. 2 and so on.

Figure 17:
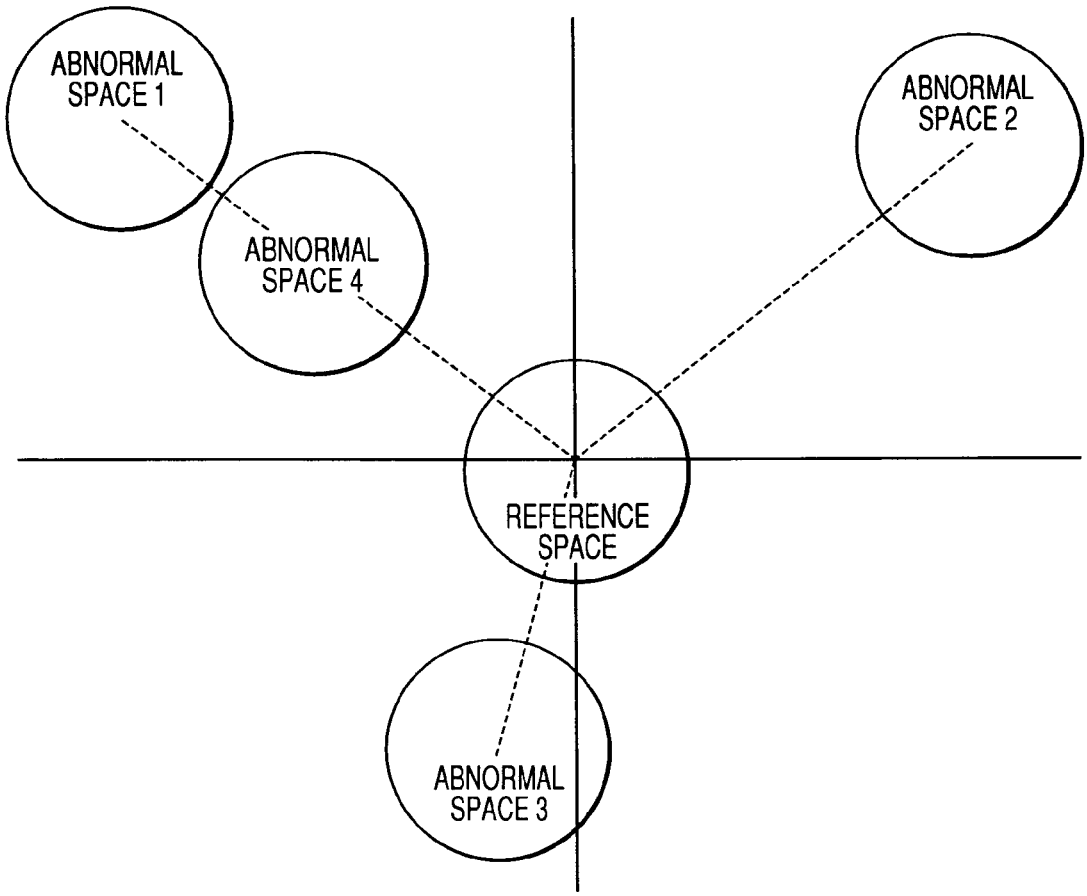
FIG. 17 is a view showing the relationship between the reference space and the abnormal spaces according to the embodiment 1 of the invention.

FIG. 17 is a view showing the relationship between the reference space and the abnormal space obtained from the Mahalanobis distance. Herein, the reference space represents a unit space in which the refrigerating cycle apparatus corresponds to the normal state. The abnormal spaces 1 to 3 represent the unit spaces corresponding to the states where another cause of abnormality arises, and the abnormal space 4 represents a unit space corresponding to the state where the degree of abnormality is smaller than in the abnormal space 1, when the same cause of abnormality as in the abnormal space 1 occurs. Though the definition of the unit space has been already described, the data can be treated as an aggregate with a certain distribution by the mean value, the standard deviation and the matrix representing the correlation, whereby the aggregate of data is called the unit space.

As for the five state quantities of high pressure, low pressure, discharge temperature, superheat and sub-cool, the mean value of data, the standard deviation, and the matrix representing the correlation between each state quantity as in the expressions 1 to 4 are obtained from the operating data over a certain period of time in the normal state, and stored as the reference space. Now, the refrigerant leakage, the liquid back-flow and the pipeline clogging are considered as the abnormalities of the refrigerating cycle apparatus. And it is supposed that the feature amounts of each abnormality are three variables of high pressure, low pressure and sub-cool for the refrigerant leakage, four variables of high pressure, low pressure, discharge temperature and superheat for the liquid back-flow, and three variables of high pressure, low pressure and sub-cool for the pipeline clogging.

Next, a method for creating the abnormal space will be described below. An example of refrigerant leakage in the refrigeration unit is employed. In the refrigeration unit, when the refrigerant leakage occurs, three states from the first stage to the third stage according to the leakage amount are considered, owing to existence of the liquid reservoir 35. In the second stage, the high pressure and the low pressure hardly change and only the sub-cool is smaller. Accordingly, of the mean value, the standard deviation and the matrix representing the correlation between state quantities for the high pressure, low pressure and sub-cool stored in the normal state, only the mean value of the sub-cool is processed into a smaller value, and these are defined as the abnormal space 1. For example, the sub-cool in the refrigerant leakage state is made 0.2 times that of the normal time. In this manner, the unit space of the abnormal space 1 for the refrigerant leakage in consideration of the distribution of refrigerant is created.

Likewise, the high pressure, the low pressure, the discharge temperature and the superheat stored in the normal state at the time of liquid back-flow, or the high pressure, the low pressure, and the sub-cool stored in the normal state at the time of pipeline clogging, are processed to regenerate respective states, and defined as the abnormal space 2 or the abnormal space 3. And the distance (the Mahalanobis distance or the D value that is its square root) from each abnormal space is obtained from the subsequent actual operating data. Then, when the refrigerant leakage occurs, for example, the distance (the Mahalanobis distance or the D value) from the abnormal space 1 is gradually smaller, but the distance from other abnormal spaces does not decrease, whereby the cause of abnormality is specified as the refrigerant leakage. Likewise, the liquid back-flow and the piping clogging can be discriminated.

Next, a processing procedure for judging the cause of abnormality will be described below in accordance with an operation flowchart of FIG. 18. First of all, it is judged whether or not the initial learning is required from the number of days elapsed since the refrigerating cycle apparatus is installed, and the learning condition (ST81). If the initial learning is required, the reference space is learned from the operating condition in the normal state (ST82). The reference space is defined as the mean value, the standard deviation and the matrix representing the correlation between state quantities for all data required to discriminate each abnormality, as shown in FIG. 17 and already described. Then, the state where each abnormality occurs is estimated, and the data of the reference space is compulsorily processed to create the abnormal space (ST83). For example, in view of the refrigerant leakage of the refrigeration unit, when the refrigerant leaks, only the sub-cool is compulsorily reduced to obtain the correlation coefficients. Also, if the abnormal state is regenerated on the real machine, the compulsory abnormal operation may be practically performed to learn the abnormal space. Next, the distance (D value) between the reference space and each abnormal space is calculated, and stored as the initial D value (ST84). The Mahalanobis distance may be employed as the distance, but because the D value at the first order is easier to treat, the D value is employed here. If the enough data to constitute each unit space is arranged through the above operation, the initial learning is ended.

Next, the arithmetic operations from the state quantities in the current operating condition on the real operation are performed by the above-described method. First of all, each data is measured at every moment (ST85). These data are normalized (ST86), and the D value (square root of the Mahalanobis distance) for each abnormal space is calculated (ST87). And the occurrence probability of each abnormality is calculated employing the following expression (8) (ST88).

The suffix in the expression (8) indicates the value for each abnormal space.

[Numerical Expression 7]

$$Q_{SC}=A_{SC}\cdot K_{SC}\cdot(T_{MR}-T_{BR})$$

$$K_{SC}=f(G_{MR},G_{BR}) \quad (7)$$

And the presence or absence of abnormality, and the cause of abnormality are judged by comparing these abnormality occurrence probabilities, and the cause of abnormality is displayed or outputted (ST89). FIG. 19 is a view for explaining the results of actually making a refrigerant leakage test for the refrigeration unit in accordance with the operation processing flowchart of FIG. 18 in which the operation time elapsed of the refrigerating cycle apparatus is taken along the transverse axis. The test was made by connecting an empty s bomb via a valve to the refrigeration unit, and by manipulating the valve to gradually withdraw the refrigerant into the bomb, whereby the simulation of refrigerant leakage was made. The distance as represented along the longitudinal axis of FIGS. 19(1) and 19(2) is the D value (square root of the Mahalanobis distance). Also, the abnormal space was created beforehand by assuming the refrigerant leakage state. From this drawing, it can be found that as the refrigerant leakage amount is increased with the passage of the time along the transverse axis, the distance from the reference space is larger, the distance from the abnormal space created due to refrigerant leakage is smaller, and the refrigerant leakage occurrence probability as shown in FIG. 19(3) is greater, whereby the abnormality is discriminated as the refrigerant leakage. In the drawing, the D value or the abnormality occurrence probability is fluctuated, because the refrigerating machine performs the automatic control to stabilize the temperature on the load side, where by the refrigerant leakage can be detected in this practical operating condition.

Though the abnormal spaces are created for different causes of abnormality in this example, two stages having different degree of abnormality may be adopted for the same abnormality to create each abnormal space, as shown in FIG. 17. In this manner, when the abnormal spaces created for different causes of abnormality are proximate to each other, there is the effect that the discrimination precision of abnormality is improved. Though there are four abnormal spaces in this example, the number of abnormal spaces is not limited to four, but any number of abnormal spaces can be obtained by the method of the invention.

Figure 20:
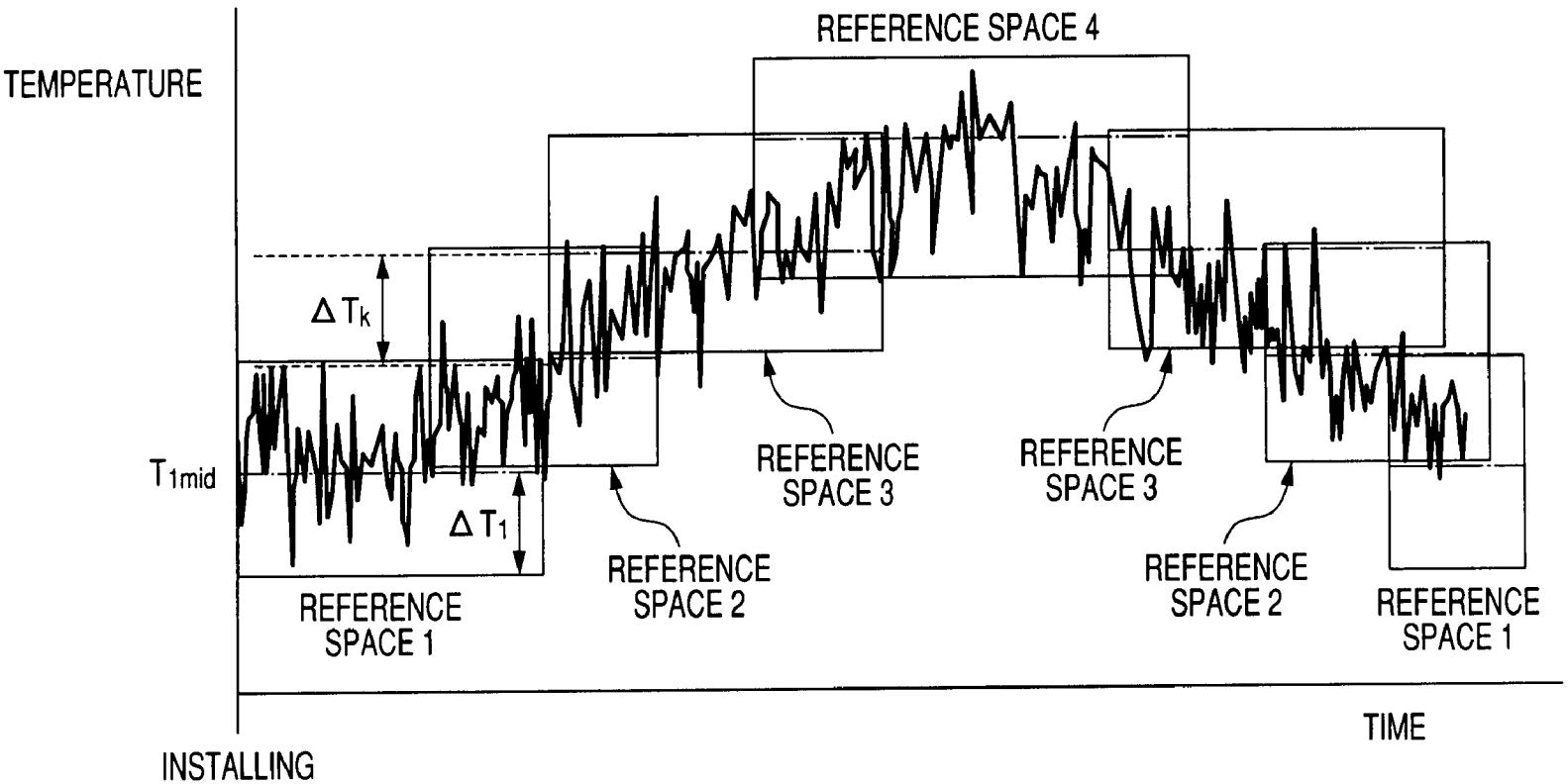
FIG. 20 is a view showing a method for dividing the reference space for a year according to the embodiment 1 of the invention.

Also, though five data of the high pressure, low pressure, discharge temperature, superheat and sub-cool are provided in the above example, the invention is limited thereto. Also, in the refrigerating cycle apparatus, since it is not preferable that the high pressure is too low, in terms of the reliability of the equipment, high pressure maintaining means may be provided. In this case, the high pressure maintaining means may be different, viz., operable or inoperable, between the summer-time in which the high pressure is high and the winter-time in which the high pressure is low, whereby the operation of the refrigerating cycle is varied. Therefore, if the same reference space and abnormal spaces are employed throughout the year, the discrimination precision of abnormality may be worsened. In this case, a plurality of reference spaces are used properly, as shown in FIG. 20, in which a plurality of reference space and abnormal spaces are provided for the year and used properly depending on the season. The proper use of season maybe practiced depending on the outside air temperature, but outside air temperature detection means is not often provided on the real machine, in which the desirable reference space is used properly, judging from the range of detected high pressure. In FIG. 20, the out side air temperature is taken along the longitudinal axis, and the time elapsed throughout the year is taken along the transverse axis, in which a plurality of reference spaces are provided according to changes in the outside air temperature, such that the reference space when installed in the winter time is 1 and the reference space when the outside air temperature in the summer time is hot is 4.

Though the refrigeration unit having the liquid reservoir has been described above, other apparatuses without the liquid reservoir such as the air conditioner or chiller can also detect the abnormality occurrence such as refrigerant leakage, foresee the abnormal critical time, or discriminate the cause of abnormality by the same method, although the estimation method for the abnormal condition is more or less different. Also, the invention may be applied to any other apparatuses constituting the refrigerating cycle to achieve the same effects. Since the cause of abnormality can be discriminated, the priority of countermeasure may be set beforehand according to the cause of abnormality. For example, in a plant employing the fluid harmful to the human body, the countermeasure against refrigerant leakage is taken prior to other troubles, whereby firstly the measurement for the cause of abnormality, the arithmetic operation, the judgement and the notification are made more frequently than other failures. In the case where there is no special container for reserving the refrigerant, like a home air conditioner, the high pressure, low pressure, sub-cool, superheat or discharge temperature are measured, whereby an aggregate of them is acquired as the feature amounts, namely, state quantities. Since the excess refrigerant is reserved inside the condenser alone based on the judgement at this time, the physical quantities measured through the overall refrigerating cycle are changed depending on the refrigerant amount within the circuit. At this time, if the refrigerant leaks, all the state quantities are affected, whereby the judgement is made in view of all changes.

Figure 21:
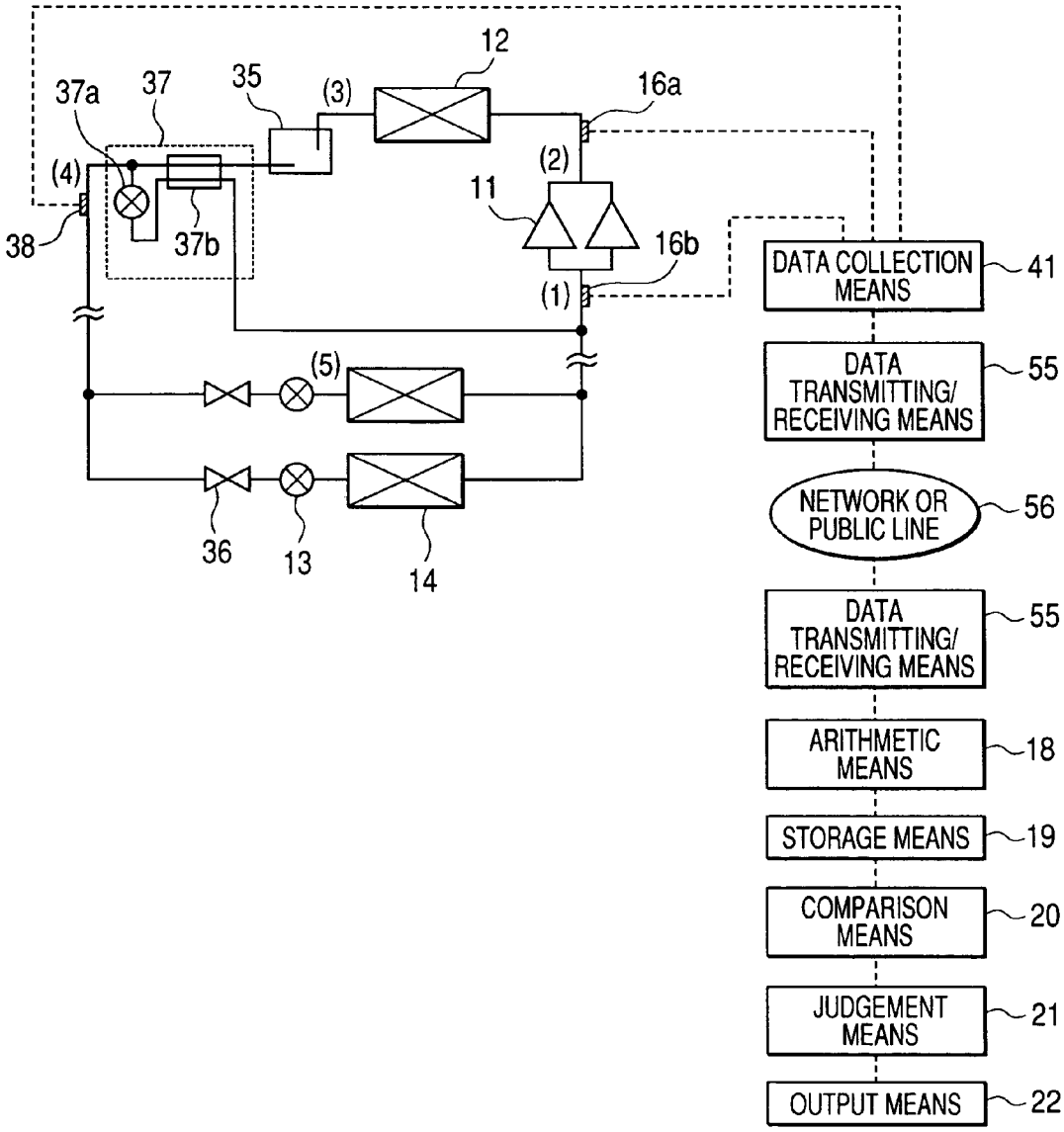
FIG. 21 is another block diagram of the refrigerating cycle apparatus according to the embodiment 1 of the invention.

FIG. 21 is a block diagram of a remote monitoring system. Reference numeral 11 denotes the compressor, 12 denotes the condenser, 35 denotes the liquid reservoir, 37 denotes sub-cooling means, 36 denotes flow passage opening/closing means, 13 denotes expansion means, and 14 denotes the evaporator. These are connected via a pipeline, and the refrigerant is circulated through the pipeline to constitute a refrigerating cycle in the same manner as in FIG. 2 and so on. Each of the compressor 11, the flow passage opening/closing means 36, the expansion means 13 and the evaporator 14 is provided singly or plurally. The condenser 12 is installed in a machine room or outdoors, and the evaporator 14 is contained in a showcase, for example. Reference numeral 16*a* denotes high pressure detection means, 16*b* denotes low pressure detection means, 38 denotes liquid pipe temperature detection means, 41 denotes data collection means, 18 denotes arithmetic means, 19 denotes storage means, 20 denotes comparison means, 21 denotes judgement means, 22 denotes output means, 55 denotes data transmitting/receiving means, and 56 denotes a network or the public line.

The operation of the refrigerating cycle and the method for inferring the abnormality are the same as described in FIG. 1 and so on, and not described here. In the configuration of FIG. 21, the data is communicated between the data collection means 41 and the arithmetic means 18 via the data transmitting/receiving means 55 and the network 56. The physical quantities of the refrigerant are obtained by measuring the high pressure and the low pressure employing a pressure sensor or a temperature sensor and computing the saturated pressure. The sub-cool is obtained by calculating the condensation temperature that is the saturation temperature from the measured values of the high pressure sensor, or measuring the condensation temperature and subtracting the condensation temperature from the temperature of the liquid pipe. The superheat is obtained by calculating the evaporation temperature that is the saturation temperature from the measured values of the low pressure sensor, or measuring the evaporation temperature and subtracting the evaporation temperature from the suction temperature measured near the suction port of the compressor.

The abnormalities of the refrigerating cycle that can be detected with the configuration of FIG. 21 may include the failure and a deterioration (a change with the passage of time) of various kinds of equipment. If the operating condition is changed, any abnormality can be detected from the physical quantities of the fluid, or the stationary data of the drive current of a motor for driving the compressor or the fan. For example, a deterioration or liquid back-flow due to the lifetime of the compressor, a blemish or breakage of the condenser or the evaporator, a deterioration or failure of an air blower unit of the condenser or an air blower unit of the evaporator, a clogging of a strainer or a dryer, a bend, rupture or clogging of the pipeline, or a deterioration of the refrigerator oil (which is detected by clogging of the pipe, false lubrication of the compressor, or a change of the heat transfer amount) can be detected and discriminated. Further, the detected data may be transmitted via the data transmitting/receiving means 55 and the network 56, whereby a maintenance center where a centralized monitoring apparatus is installed can simply make the supervision.

With this configuration, the abnormality (failure and deterioration) of the equipment can be monitored remotely. Therefore, it is unnecessary to go to the site to find the abnormality of the equipment, whereby the abnormality can be detected in the early stage. And conventionally, there are two stages of firstly grasping the cause of abnormality on the site, and taking a countermeasure some day. However, with the configuration of this invention, since the cause of abnormality can be specified remotely without going to the site, it is possible to shorten the time up to recovery by making the preparations before going to the site. For example, when the refrigerant leakage occurs, it can be known remotely, whereby a refrigerant bomb or the maintenance tools can be prepared before going to the site.

In FIG. 21, the arithmetic means 18, the storage means 19, the comparison means 20, the judgement means 21 and the output means 22 are illustrated separately, but maybe integrated together. When the remote supervision is made employing a general-purpose computer such as a personal computer, all the functions may be implemented by computer software. In this case, the output is made on the display or passed to an external storage medium such as a hard disk and displayed later.

Also, the unit space is composed of the mean value, the standard deviation and the correlation coefficients of each feature amount. In the remote monitoring system, they are stored in a memory on the board for the refrigerating cycle apparatus or the personal computer installed at a remote site. When all or a part of them are learned on the real machine, the data not required to be learned may be stored either in the memory on the board for the refrigerating cycle apparatus or the personal computer, but the data required to be learned is stored in the hard disk of the personal computer.

The refrigerating cycle apparatus of the invention has the compressor, the condenser, the expansion means and the evaporator that are connected via the pipeline, through which the refrigerant is circulated to constitute a refrigerating cycle, and comprises the high pressure measurement means for measuring the pressure of refrigerant or the high pressure at any position on the flow passage from the discharge side of the compressor to the expansion means or the condensation temperature measurement means for measuring the saturation temperature at the high pressure, the low pressure measurement means for measuring the pressure of refrigerant or the low pressure at any position on the flow passage from the expansion means to the suction side of the compressor or the evaporation temperature measurement means for measuring the saturation temperature at the low pressure, and the liquid temperature measurement means for measuring the temperature at any position on the flow passage from the condenser to the expansion means, the discharge temperature measurement means for measuring the temperature at any position on the flow passage from the compressor to the condenser, or the suction temperature measurement means for measuring the temperature at any position on the flow passage from the evaporator to the compressor, in which there are provided arithmetic means for performing the arithmetic operation on the composite variables from the measured values of the high pressure measurement means or the condensation temperature measurement means, the low pressure measurement means or the evaporation temperature measurement means, and the liquid temperature measurement means, the discharge temperature measurement means or the suction temperature measurement means, the storage means for storing the measured values of each measurement means or the arithmetic values such as composite variables calculated from the measured values, the comparison means for comparing the value stored in the past in the storage means with the current measured value or the arithmetic value, and the judgement means for judging the abnormality of the refrigerating cycle based on the comparison result, whereby the reliable apparatus can be constructed with the simple constitution.

Also, the abnormality of the refrigerating cycle judged by the judgement means is the refrigerant leakage, whereby the apparatus with the high global atmospheric protection and safety can be produced. Also, there is provided means for picking up and learning the condition where the refrigerating cycle apparatus is normally operated from the measured values of each measurement means or the arithmetic values calculated from the measured values, which are stored in the storage means, whereby the secure failure diagnosis is enabled. The contents learned by this learning means include the numerical values indicating the correlation between plural state quantities in the refrigerating cycle.

In the invention, at least one of the measured values of each measurement means or the arithmetic values calculated from the measured values, which are stored in the storage means, is compulsorily converted into another value, the arithmetic operation is newly made for the composite variables after conversion, and the judgement means sets the newly calculated composite variables to the threshold for judging the refrigerant leakage, whereby the condition of refrigerant leakage can be simply set up. The value that is converted into another value may include the measured value by the liquid temperature measurement means, or the arithmetic value calculated from the measured value. One or more values may be converted in to another value.

Since the degree of abnormality of the refrigerating cycle is judged based on the arithmetic value calculated by the arithmetic means of the invention, and the critical time at which the refrigerating cycle cannot continue the safe operation is foreseen, the more reliable and safe operation is assured. For example, the arithmetic means performs the arithmetic operation on the refrigerant amount within the refrigerating cycle, the refrigerant leakage amount, or their equivalent arithmetic value, and the time at which the critical refrigerant amount capable of keeping the prestored cooling power is reached is foreseen from the calculated refrigerant leakage amount or its equivalent arithmetic value. The output means for outputting the foreseen critical time by an electric signal representing the magnitude of voltage or current is provided, and the electric signal outputted by this output means is the voltage output or current output according to the degree of abnormality in which the critical abnormality value capable of keeping a predetermined cooling power is the maximum value, whereby anyone can know the abnormal condition and easily perform the maintenance.

The refrigerating cycle apparatus of the invention has the compressor, the condenser, the expansion means and the evaporator that are connected via the pipeline, through which the refrigerant is circulated to constitute a refrigerating cycle, the refrigerant containing not a little combustible component, and comprises the high pressure measurement means for measuring the pressure of refrigerant or the high pressure at any position on the flow passage from the discharge side of the compressor to the expansion means or the condensation temperature measurement means for measuring the saturation temperature at the high pressure, the low pressure measurement means for measuring the pressure of refrigerant or the low pressure at any position on the flow passage from the expansion means to the suction side of the compressor or the evaporation temperature measurement means for measuring the saturation temperature at the low pressure, and the liquid temperature measurement means for measuring the temperature at any position on the flow passage from the condenser to the expansion means, the discharge temperature measurement means for measuring the temperature at any position on the flow passage from the compressor to the condenser, or the suction temperature measurement means for measuring the temperature at any position on the flow passage from the evaporator to the compressor, the storage means for storing the measured values of each measurement means or the arithmetic values calculated from the measured values, the comparison means for comparing the value stored in the past in the storage means with the current measured value or the arithmetic value, arithmetic means for performing the arithmetic operation on the refrigerant amount within the refrigerating cycle, the refrigerant leakage amount, or its equivalent arithmetic value, and the output means for outputting the abnormality of the refrigerating cycle as an electric signal or communicating it as a communication code with the other site, in which when the refrigerant leakage is detected, it is outputted prior to other abnormalities of the refrigerating cycle, whereby the safe operation can be performed with the simple constitution, even if any refrigerant is employed. The output means outputs the voltage or current so that an alarm unit for raising the alarm by sound or light may be connected to the output means.

The equipment diagnosis device of the invention comprises means for storing the instrumentation amounts or the arithmetic values from the instrumentation amounts when the equipment is normally operated, means for inferring the state quantities or the arithmetic values from the state quantities in the abnormal condition where the equipment is abnormal or means for regenerating the abnormal condition of the equipment, means for making the arithmetic operation on the distance between the normal condition or the abnormal condition and the current operating condition of the equipment, and means for estimating the normal condition or abnormal condition of the equipment, the degree of abnormality or the cause of abnormality from a change in the distance between the current operating condition of the equipment and the normal condition or the abnormal condition, whereby the precise diagnosis is allowed.

Also, the equipment diagnosis device of the invention comprises a plurality of means for storing the instrumentation amounts or the state quantities that are the arithmetic values from the instrumentation amounts when the equipment is normally operated, means for inferring the instrumentation amounts or the arithmetic values from the instrumentation amounts in the abnormal condition where the equipment is abnormal or means for regenerating the abnormal condition of the equipment, means for making the arithmetic operation for the distance between the normal condition and abnormal condition and the current operating condition of the equipment, and means for estimating the normal condition or abnormal condition of the equipment, the degree of abnormality or the cause of abnormality from the distance between the current operating condition of the equipment and the normal condition, and a change in the distance from the abnormal condition, whereby the reliable abnormal diagnosis is enabled.

Also, a plurality of abnormal conditions are defined in accordance with the degree of abnormality of the equipment for one cause of abnormality, and the degree of abnormality of the equipment is inferred from a change in the distance between the current operating condition of the equipment and two or more abnormal conditions, whereby the diagnosis apparatus having excellent usability for continuing the operation in various conditions can be obtained. Further, means for picking up and learning the normal condition of the equipment from the actual operating data is provided to allow for the secure judgement. Also, in the case of the composite variables or the refrigerating cycle apparatus, the arithmetic value or the distance equivalent to the refrigerant amount is the Mahalanobis distance or the numerical value calculated from the Mahalanobis distance, whereby the precise data for judgement is obtained.

The remote monitoring system of the invention has the refrigerating cycle apparatus in which the compressor, the condenser, the expansion means and the evaporator are connected via the pipeline, through which the refrigerant is circulated to constitute a refrigerating cycle, the refrigerating cycle apparatus comprising the high pressure measurement means for measuring the pressure of refrigerant or the high pressure at any position on the flow passage from the discharge side of the compressor to the expansion means or the condensation temperature measurement means for measuring the saturation temperature at the high pressure, the low pressure measurement means for measuring the pressure of refrigerant or the low pressure at any position on the flow passage from the expansion means to the suction side of the compressor or the evaporation temperature measurement means for measuring the saturation temperature at the low pressure, and the liquid temperature measurement means for measuring the temperature at any position on the flow passage from the condenser to the expansion means, the discharge temperature measurement means for measuring the temperature at any position on the flow passage from the compressor to the condenser, or the suction temperature measurement means for measuring the temperature at any position on the flow passage from the evaporator to the compressor, in which there are provided arithmetic means for acquiring the composite variables from the measured values of the high pressure measurement means or the condensation temperature measurement means, the low pressure measurement means or the evaporation temperature measurement means, and the liquid temperature measurement means, the discharge temperature measurement means or the suction temperature measurement means, the storage means for storing the measured values of each measurement means or the arithmetic values such as composite variables calculated from the measured values, the comparison means for comparing the value stored in the past in the storage means with the current measured value or the arithmetic value, and the judgement means for judging the abnormality of the refrigerating cycle based on the comparison result, near the refrigerating cycle apparatus or remotely via the network or the public line, the measured data or the arithmetic values being transmitted via the network or the public line. Therefore, even if any problem occurs, it is possible to simply cope with the problem, so that the operation can be continued effectively.

The remote monitoring system of the invention has refrigerating cycle apparatus in which the compressor, the condenser, the expansion means and the evaporator are connected via the pipeline, through which the refrigerant containing not a little combustible component is circulated to constitute a refrigerating cycle, the refrigerating cycle apparatus comprising the high pressure measurement means for measuring the pressure of refrigerant or the high pressure at any position on the flow passage from the discharge side of the compressor to the expansion means or the condensation temperature measurement means for measuring the saturation temperature at the high pressure, the low pressure measurement means for measuring the pressure of refrigerant or the low pressure at any position on the flow passage from the expansion means to the suction side of the compressor or the evaporation temperature measurement means for measuring the saturation temperature at the low pressure, and the liquid temperature measurement means for measuring the temperature at any position on the flow passage from the condenser to the expansion means, the discharge temperature measurement means for measuring the temperature at any position on the flow passage from the compressor to the condenser, or the suction temperature measurement means for measuring the temperature at any position on the flow passage from the evaporator to the compressor, in which there are provided the storage means for storing the measured values of each measurement means or the arithmetic values calculated from the measured values, the comparison means for comparing the value stored in the past in the storage means with the current measured value or the arithmetic value, the arithmetic means for performing the arithmetic operation for the refrigerant amount or the refrigerant leakage amount within the refrigerating cycle, or its equivalent arithmetic value, and the output means for outputting the abnormality of the refrigerating cycle as an electric signal or communicating it as a communication code with another apparatus near the refrigerating cycle apparatus or remotely via the network or the public line, the measured data or arithmetic values being transmitted via the network or the public line, and when the refrigerant leakage is detected, it is outputted prior to other abnormalities of the refrigerating cycle, whereby the safe operation is enabled.

Also, there are provided means for storing the instrumentation amounts or the arithmetic values from the instrumentation amounts when the equipment is normally operated, means for inferring the instrumentation amounts or the arithmetic values from the instrumentation amounts in the abnormal condition where the equipment is abnormal or means for regenerating the abnormal condition of the equipment, means for making the arithmetic operation for the distance between the normal condition and the abnormal condition and the current operating condition of the equipment, and means for estimating the normal condition or abnormal condition of the equipment, the degree of abnormality or the cause of abnormality from the distance between the current operating condition of the equipment and the normal condition, and a change in the distance from the abnormal condition, near the refrigerating cycle apparatus or remotely via the network or the public line, the measured data or arithmetic values being transmitted via the network or the public line, whereby the maintenance is easy.

Also, there are provided a plurality of means for storing the instrumentation amounts or the arithmetic values from the instrumentation amounts when the equipment is normally operated, means for inferring the instrumentation amounts or the arithmetic values from the instrumentation amounts in the abnormal condition where the equipment is abnormal or means for regenerating the abnormal condition of the equipment, means for making the arithmetic operation for the distance between the normal condition and the abnormal condition and the current operating condition of the equipment, and means for estimating the normal condition or abnormal condition of the equipment, the degree of abnormality or the cause of abnormality from the distance between the current operating condition of the equipment and the normal condition, and a change in the distance from the abnormal condition, near the refrigerating cycle apparatus or remotely via the network or the public line, the measured data or arithmetic values being transmitted via the network or the public line, whereby the equipment is easy to handle.

Figure 18:
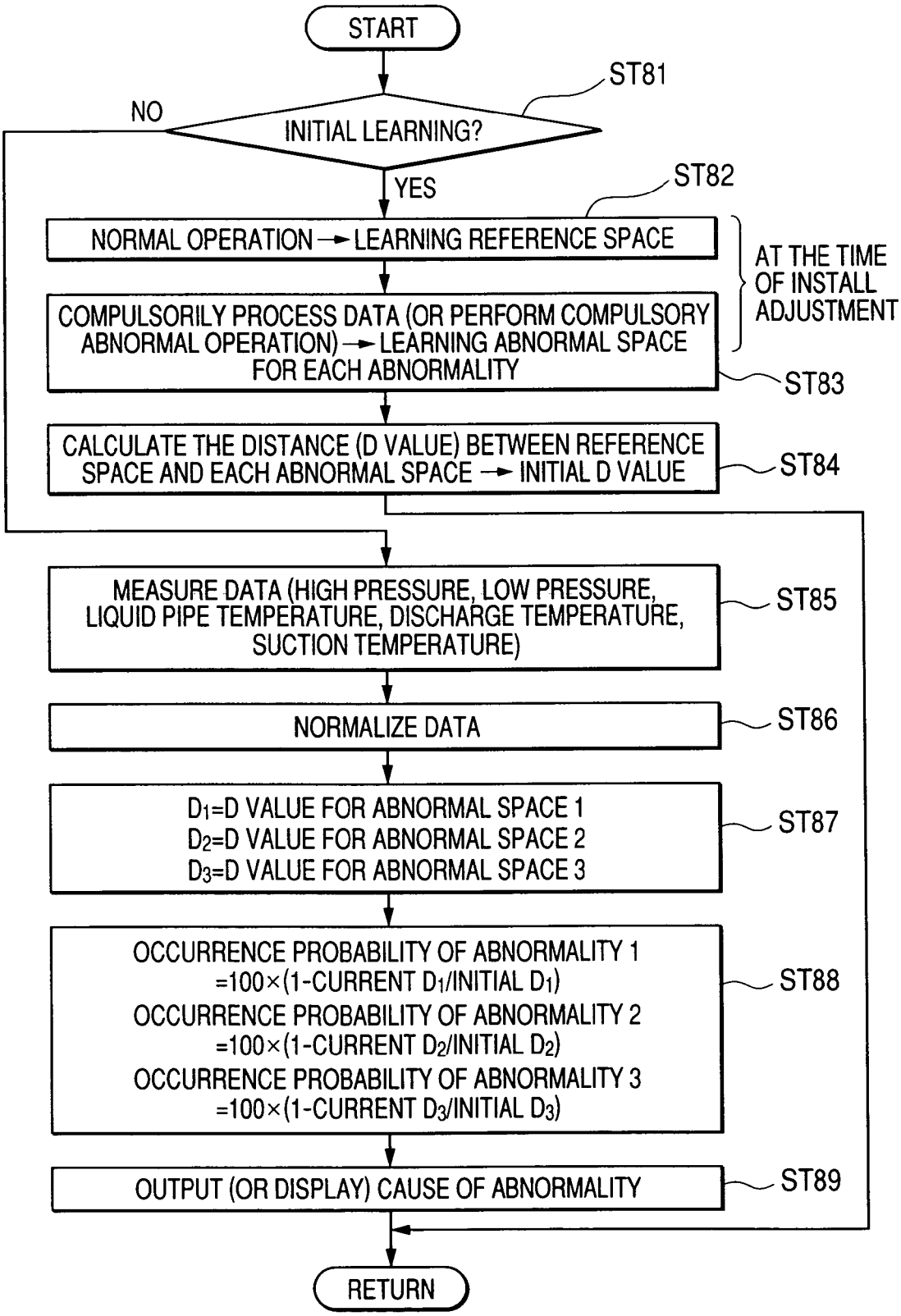
FIG. 18 is an operation flowchart according to the embodiment 1 of the invention.
Figure 19:
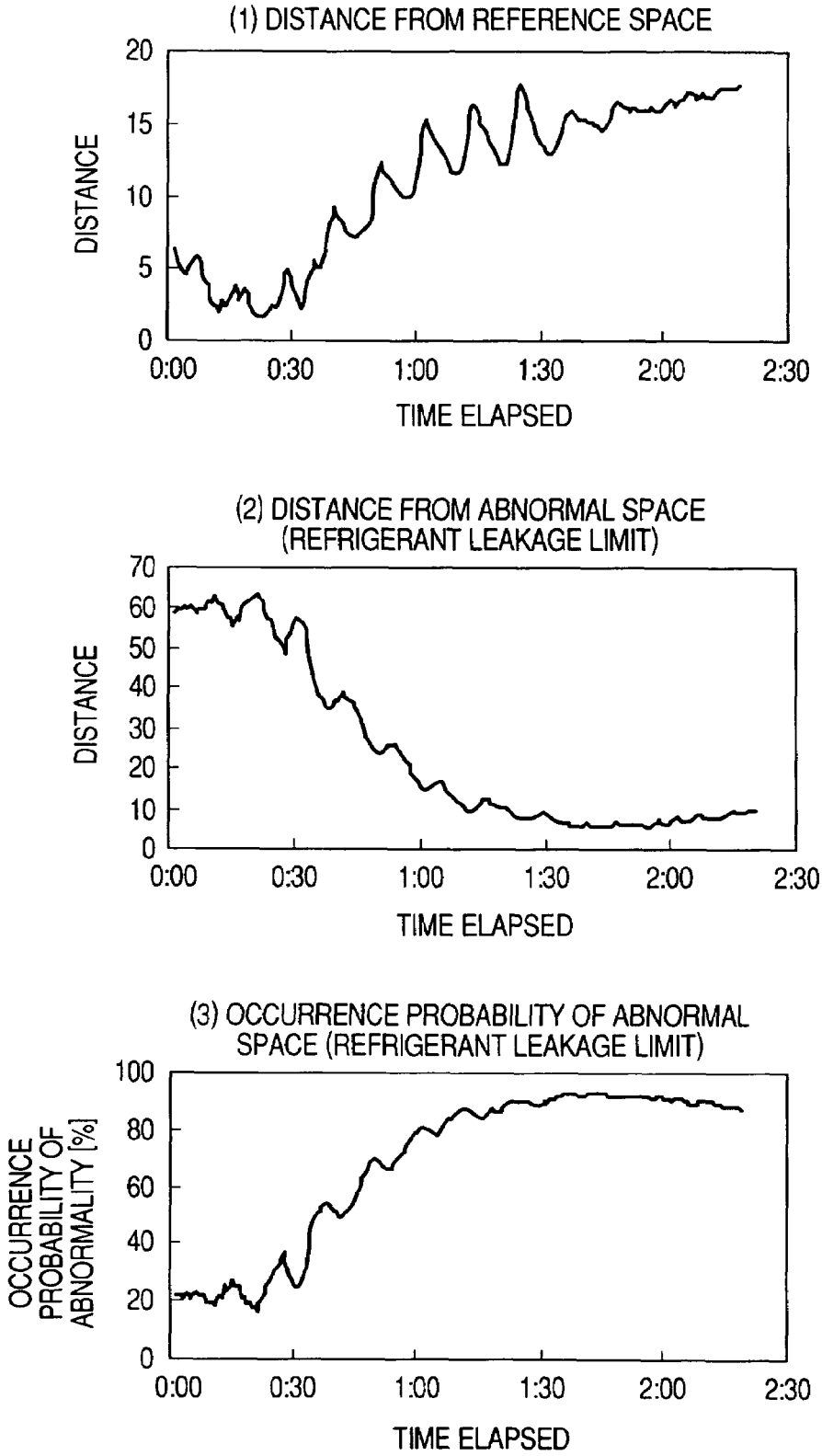
FIG. 19 is a view showing the test results of refrigerant leakage according to the embodiment 1 of the invention.

Though the D value is employed as the distance in the flowchart of FIG. 18, the Mahalanobis distance D2 for each of the reference space and the abnormal spaces is firstly acquired, the square root of D2 is calculated in accordance with the following expression (6), the occurrence probability of each abnormality is calculated in accordance with the expression (8), and the failure cause is assessed and estimated from the occurrence probability of each abnormality. Herein, the reason why the Mahalanobis distance D2 is raised to the power of ½ in the expression (6) is that the distance D2 is the square value which increases quadratically along with the increasing distance, but the square root distance D linearly increases according to the degree of abnormality, the increase of the distance is proportional to the increase of the degree of abnormality, whereby the distance is sensibly easy to handle. Also, in the expression (8), the "initial D" is the Mahalanobis distance when the abnormal space is applied to the initial normal state data, and represents the distance up to the normality on the basis of the abnormality in the initial normal state. The "current D" represents the distance when the abnormal space is applied to the current measured data. The "current D" takes a large value in the initial normal state (due to a large difference between the abnormal state and the normal state), but as the extent of abnormality progresses, the "current D" is smaller (gradually approaching from the normality to the abnormality), whereby the abnormality occurrence probability approaches 100%.

[Numerical Expression 8]

$$\text{Abnormality 1 occurrence probability}=100\times(1-\text{current } D_1/\text{initial } D_1)$$

$$\text{Abnormality 2 occurrence probability}=100\times(1-\text{current } D_2/\text{initial } D_2)$$

$$\text{Abnormality 3 occurrence probability}=100\times(1-\text{current } D_3/\text{initial } D_3) \quad (8)$$

If the condition is not judged to be normal by the judgement means of the invention, viz., from the relationship between the distance and the threshold as shown in the flowchart, the failure is displayed on the screen or notified by sound, or the abnormality is informed to the remote site. And the serviceman who is notified of the failure makes the maintenance of making repairs or overhaul for the failure, whereby the installation is recovered to the normal state. Each process of the flowchart in this explanation is performed by the arithmetic means 18, the storage means 19, the comparison means 20, the judgement means 21 and the output means 22 as shown in FIG. 2 and so on. The initial learning presence or absence determination ST81 is performed by the judgement means 21, the learning associated process ST82 and ST83 is arithmetically performed by the arithmetic means 18, and the results are stored in the storage means 19. The arithmetic operation process ST84, 86 and 87 for the Mahalanobis distance is performed by the arithmetic means 18, based on the data in the reference space and the abnormal spaces stored in the storage means 19. The failure determination ST88 and 89 is performed by the comparison means 20 and the judgement means 21. The output is performed by the output means 22. Naturally, the failure determination may be made from the relationship between the distance of data between the reference space and the abnormal space without employing the threshold.

In the above explanation, a learning operation of learning the reference space for the normal state or the abnormal space for each abnormal state involves calculating the reference value required to compute the Mahalanobis distance from the measured data, and storing the reference value. Specifically, the learning operation involves calculating the mean value m in the expression (1), the standard deviation σ in the expression (2) and the inverse matrix R−1 of the correlation matrix in the expression (4).

For each abnormal space, the mean value and the standard deviation of each parameter, and the correlation coefficients of each parameter are stored. The distance between the reference space and each abnormal space can be obtained by calculating the Mahalanobis distance from the normal reference space, employing the mean value of each parameter in each abnormal space, and set up as the threshold. For example, in the operation of the real machine, the data is firstly measured, and the presence or absence of the failure is determined, in which the distances (square root of the Mahalanobis distance) between each abnormal space and the normal reference space are set as the initial D1 and the initial D2. The current operating state quantity data that are measured, the distance D0 from the normal reference space, and the distances D1, D2 from each abnormal space are obtained. D0 is a value of 2 or less in the initial state. And the degree of approach to each abnormal space is calculated in accordance with the expression (8), and the occurrence probability of each abnormality is calculated. And the failure cause is judged by comparing the abnormality occurrence probabilities.

As described above, the normal reference space and the abnormal spaces are defined, and the occurrence probability of each abnormality is calculated, whereby the degree of abnormality can be grasped according to an increase of the distance from the normal reference space (the Mahalanobis distance or the square roof of the Mahalanobis distance), and the degree of abnormality is specified according to a decrease of the distance from each abnormal space (the Mahalanobis distance or the square roof of the Mahalanobis distance). Though the concept of the Mahalanobis distance between the abnormal space and the normal space has been described in FIG. 17, the normal reference space is located in the center of coordinates, and each abnormal space is located away from the origin in an image view. Practically, since the Mahalanobis distance is involved in a multidimensional space, FIG. 17 is an image view in which the Mahalanobis distance is represented in two dimensions. Each of the normal reference space and the abnormal spaces has an area with dispersion, in which whether the current operating condition is normal or abnormal is judged by determining to which space the data belongs. The distance between each abnormal space and the normal space can be calculated by obtaining the Mahalanobis distance between the representative data (mean value data) of the normal reference space and the abnormal space. For example, when this distance is equal to 1000, the current refrigerating cycle operating state quantities are computed, employing the normal reference space, or when the distance is equal to 1000 and the distance from this abnormal space is close to zero, there is possibility that the abnormality occurs in this abnormal space. The threshold for each abnormality may be set by performing the arithmetic operation for the Mahalanobis distance between the normal reference space and each abnormal space in each abnormality, in which if the abnormality is detected in the early stage, for example, the threshold for the abnormality may be set to 1/10.

Figure 22:
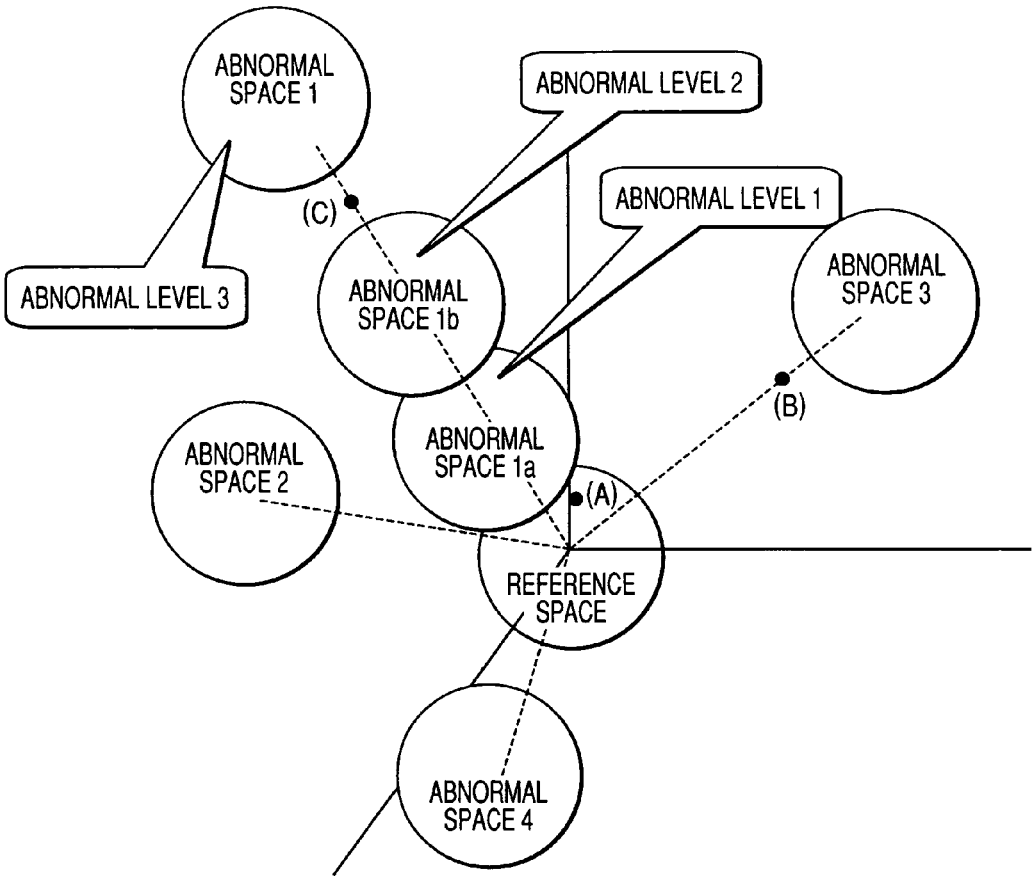
FIG. 22 is an explanatory view showing the concept of the Mahalanobis distance for the abnormal spaces and the normal space according to the embodiment 1 of the invention.

Also, in a failure trial examination in the installing site, since the test can not be made in the extremely bad operating condition where the compressor rupture may occur, the failure states may classified into several levels, whereby the abnormal space is learned according to each level. This level classification will be described with reference to FIG. 22 that is a multidimensional space concept view for the Mahalanobis distance. In FIG. 22, the abnormal space 1 is an example, in which the abnormal levels 1 to 3 are set according to the degree of abnormality in this example. In an installing site test, the abnormal spaces of levels 1 and 2 are learned. At the level 3, a compressor rupture may actually occur, in which this abnormal space is learned by making the measurements beforehand in a laboratory.

In this manner, for an area at the level with a small degree of abnormality where the simulation operation on the real machine is enabled by classifying the abnormality into several levels according to the degree of abnormality, the abnormal space can be created by the real machine gauging on the spot, whereby the abnormality can be found in the early stage in accordance with the real machine.

Also, the degrees of abnormality are classified into levels, and the abnormal space is created at each abnormal level. Thereby, even if the abnormal level is low, the correct failure prediction is enabled, and it is easy to discriminate between failures, whereby the failure prevision and the specification of failure cause are enabled in the early stage before the refrigerating cycle apparatus breaks down due to failure.

Next, the learning of the abnormal space will be described. For the abnormal space, there are provided a method for learning on the real machine after the equipment is installed on the spot of installation, and a method for creating the abnormal space employing the data obtained by simulating beforehand the failure condition for the same type of machine in the laboratory. The former method deals with the failure conditions that can be simulated on the spot of installation, for example, the refrigerant liquid back-flow and refrigerating machine oil exhaustion, besides the refrigerant leakage. For these failures, the refrigerant liquid back-flow condition is simulated by slightly opening an expansion valve of the refrigerating cycle, or the failure condition is simulated on the spot by temporarily draining the oil out of the bottom part of the compressor, whereby the abnormal space is created from these operating conditions. The created abnormal space is stored in the storage means, and employed to determine the abnormal condition.

The latter method of making beforehand the failure trial test in the laboratory deals with the failures in which the failure simulation on the spot of installation is difficult. For these failures, the refrigerating cycle apparatus capable of simulating the abnormal condition is created, the test of the refrigerating cycle apparatus is made in the laboratory, the abnormal operating state quantity data is sampled, and the abnormal space is created employing this data. The abnormal space prepared in this manner is stored beforehand in the storage means when the refrigerating cycle apparatus is shipped, and can be applied on the real machine. Also, a part of the failure trial test may be substituted by simulation.

Another learning method for the abnormal space has been already described, in which in the case where the failure of concern occurs, if the parameter indicating a symptom is clear in advance, the value of the parameter exhibiting the remarkable symptom upon the abnormality occurrence among the data of each parameter used for the normal reference space after learning the normal reference space is compulsorily converted into the estimated value when the failure occurs, and the abnormal operating state quantity data is newly created. One or more values may be converted separately. Thereby, if the parameter exhibiting the symptom when the abnormality occurs is clear in advance, the abnormal space can be created based on the normal state of the real machine, whereby it is possible to completely absorb the individual differences due to dispersion of the real machine.

Figure 23:
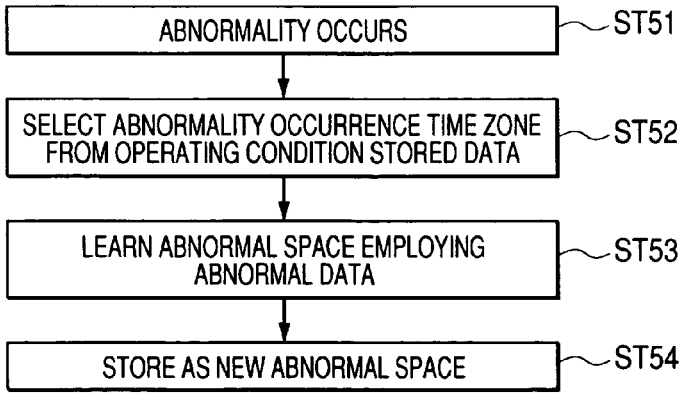
FIG. 23 is a flowchart showing the contents of a new abnormal learning function according to the embodiment 1 of the invention.

On the other hand, an unexpected failure that can not be covered by the abnormal spaces foreseen at the beginning may occur in continuing the operation of the refrigerating cycle apparatus. As a countermeasure against this case, a new abnormality learning function is provided, and its concept is shown in a flowchart of FIG. 23. In FIG. 23, ST51 involves detecting the abnormality occurrence. Though the failure cause is not specified in the failure cause assessment determination flow, the Mahalanobis distance is increased, whereby the refrigerating cycle apparatus is judged as abnormal. In this state, the corresponding time zone where the abnormality occurs is selected from the past time zone displayed on the display means 6 of FIG. 1 by manipulating the input unit 7 of FIG. 1. The data of several days in the past are always stored in the storage means. At ST52, an arbitrary zone is selected from this data. At ST53, the abnormal space is learned, employing the operating data (abnormal data) in the selected time zone. At ST54, the learned abnormal space is stored as the new abnormal space in the storage means. In the failure cause assessment after the new abnormal space is stored, the new abnormal space can be also determined.

Though the learning operation in the operation device of the input means for the refrigerating cycle apparatus on the real machine has been described above, an information terminal such as a remote personal computer in the remote monitoring means may make the same learning operation. Or it is unnecessary that the input means is always provided in the refrigerating cycle apparatus, but when the abnormality occurs, the serviceman may go to the maintenance by carrying a personal computer having installed a maintenance tool capable of sucking up the data from the refrigerating cycle apparatus, analyzing it, and writing the information into the refrigerating cycle apparatus. Employing the learning method as described in connection with FIG. 23, this invention is applicable to the existing machine normally operating at present, though the information at the time of manufacture or installation is already unknown. First of all, the learning at the normal time as described in connection with FIG. 8 is performed, and the abnormal space is learned by processing this data. Then, the operating data is stored and set to perform the new abnormality learning of FIG. 23. That is, the invention is applicable to any apparatus that is already operating. Accordingly, if the remote monitoring apparatus of the invention is provided as shown in FIG. 21, the maintenance maybe executed by transmitting the data from the equipment such as the refrigerating cycle apparatus owned by the contracted user via the Internet.

First of all, the maintenance department or the person in charge accepts a maintenance order from the new maintenance order owner, employing the network 56 of FIG. 21 or the telephone line 3 of FIG. 1. In the fluid circuit of the refrigerating cycle provided on the spot such as the supermarket where the refrigerating cycle apparatus 1 of FIG. 1 for maintenance is installed, the measurement means as already described is mounted. The instrumentation amounts are stored in the storage means provided for the microcomputer 2. The person in charge of maintenance can draw the instrumentation amounts gauged by the measurement means via the communication means. The physical quantities of the fluid in the equipment sucking and discharging the fluid circulated through the fluid circuit are measured by a plurality of measurement means, and the arithmetic operation results can be obtained by making the arithmetic operation on an aggregate in which the stored instrumentation amounts or the plural parameters acquired from the instrumentation amounts are combined as plural variables and associated with each other. If the arithmetic operation is performed on the spot, the arithmetic operation results may be read via the communication means. The current state quantities of the refrigerating cycle apparatus can be grasped by judging whether or not the arithmetic operation results of making the arithmetic operation on the aggregate in which the read arithmetic operation results or the plural parameters obtained from the measured amounts are combined as the plural variables and associated with each other are within a preset range. The current state quantities continue to be accumulated, and the normal state or abnormal state, the degree of abnormality, the time up to a tolerance limit for leakage, and the cause of abnormality are judged from the distinction between the normal state and the abnormal state and the distance between the normal space and the abnormal space in accordance with the flowcharts of FIGS. 8, 18 and 23. Though the judged results are communicated to the maintenance order owner, the judged results include a plurality of proposals concerning the maintenance contents and the time. That is, since the maintenance contents are different depending on the degree of abnormality and the cause of abnormality, the system of the invention capable of abnormality prediction can propose the maintenance contents at each rank by dividing the time up to the tolerance limit into plural ranks. This proposal includes the estimated cost in making the maintenance, and the maintenance order owner can know the extent of abnormality and decide when and how the maintenance is performed from the time, the cost and the contents. If the maintenance system is employed, the operation of the apparatus or equipment can be safely performed without risk. Since the operation history and the trouble contents are automatically recorded, the report may be made simply and anytime, when needed. The existing machine, or the apparatus with unknown specifications existing at the remote site such as abroad can be diagnosed by acquiring the instrumentation amounts via the communication means, or the specifications of the equipment, the installation conditions and the operation history via the communication means, whereby the recommendation and judgement for maintenance is simply made in a short time. The business for diagnosing the failure employing the Internet may be performed independently of the business for operating the installation employing the apparatus or equipment or the business for taking charge of the maintenance. For the precise maintenance including the failure prediction, it is favorable to use the apparatus and have the history, for example, the operation records in the past, the failure records, and the maintenance records. Further, an additional learning function may be added to the new failure, whereby the accurate failure determination can be made through the post processing for the failure unforeseen initially on design. Also, the learned information of the new abnormal space is accumulated in the equipment diagnosis device or the remote monitoring means, whereby these information may be added to the storage means for the apparatus of the same or similar type that is newly shipped, and expanded over various apparatuses of the same or similar type.

Though in the above explanation, the Mahalanobis distance is employed as the abnormality determination means, and the multiple items of parameters are converted into one index to determine the abnormality, the abnormality maybe discriminated by noticing the specific item such as standard deviation, and judging whether or not this item exceeds the threshold, if the item causing the abnormality is specified beforehand. In the above explanation, the state quantities are obtained by arithmetic operation after measuring the physical quantities concerning the refrigerant with a large time lag of change or the current effective value and acquiring the instrumentation amounts such as current without regard to the instantaneous values. By combining many variables acquired from such data, the failure diagnosis is enabled as a whole including mechanical, electrical or other influences not dependent on the accident. The compressor for use in the refrigerating cycle circulates the refrigerant by discharging and sucking the refrigerant flowing through the refrigerating cycle, in which it is effective for the practical diagnosis that the variables include the physical quantities of the refrigerant. Likewise, the hydraulic machines such as an air blower having a driver and concerning the physical quantities of wind flow or a pump concerning the water, food or chemical liquid are treated, and the FAX or printer, or a driving device for an apparatus moving the object on the manufacturing line is also dealt with in the same manner. Especially in a case of the air blower used in the refrigerating cycle, it is apparent that the physical quantities of the refrigerant, other than the flow of wind, as the fluid may be measured in the same manner as above, because the performance and characteristics of the refrigerating cycle are changed.

Though one of the state quantities to be measured as the variables is the driving current for the motor, as previously described, other quantities of electricity, for example, an electromagnetic force between stator and rotor for the motor which is related with a driving torque, an earth current or a noise wave leaking in the surroundings, and a shaft voltage, maybe measured, because the measured data of different phenomena are electrically associated with each other, and to distinguish between the electrical and the mechanical accidents. For example, in the case of an induction motor or a DC brushless motor, the output of higher harmonics varies, so that the stationary earth current, noise wave and shaft voltage are different. Further, when the abnormality is reported on the spot of installation, a method for notifying the abnormality with the warning lamp 8 or the speaker 9 shown in FIG. 1, and a method for displaying the abnormality content on the display unit 6 such as a liquid crystal display, or both, can be employed. When the abnormal situation is urgent and serious, the concurrent use of the warning lamp 8, the speaker 9 and the display unit 6 is effective. In the stage where the abnormality is small or the prediction stage, only the display unit 6 may be employed to make the report, and in maintenance, the serviceman checks an abnormal trend, whereby the suitable maintenance time can be grasped. To make the report to a remote monitoring room, the abnormality content and the degree of abnormality are reported via the communication means such as the telephone line, LAN, or radio to the remote monitoring room. In the remote monitoring room, the serviceman is dispatched based on the abnormal condition, but if the cause of abnormality is grasped remotely, it is possible to prepare the necessary parts to cope with the corresponding abnormality before going to the actual place, whereby the maintenance can be performed quickly. In addition, the information may be notified directly to information receiving means such as a portable telephone of the serviceman at the same time of making the report to the remote monitoring room.

Though the source current for driving the motor is one of the measured amounts as already described, it is natural that the source current itself may not be directly measured. The current flowing through the motor such as a coil around the motor is picked up by the induced voltage, or the unbalanced current flowing through each layer of motor windings may be picked up as the state quantity. The driving torque related with the motor current has a large torque pulsation due to compressed refrigerant in the case of the compressor, and the influence due to the failure is buried. In the compressor, since the torque is greatly changed depending on the compression ratio, namely, the ratio of low pressure to high pressure, it is necessary to measure not only the current but also the high pressure and the low pressure, and make the judgement by performing the arithmetic operation on the correlation between them. For example, the high pressure and the low pressure of the refrigerating cycle are not stabilized for several tens minutes after the compressor is started. Accordingly, when the stationary data is employed as the state quantity as described in this invention, it is recommended to start the measurements after the physical quantities of the refrigerant are stabilized. On the other hand, when the physical quantities of the refrigerant are unstable, the failure such as a tooth contact affected by a signal caused by the torque of the compressor or the torque can be discriminated from the failure of the electrical system such as the condenser unaffected by the torque at that time, because the signal may vary for that time. Also, even if the frequency of the compressor is not changed by controlling the load side equipment opening or closing the electromagnetic valve for the showcase, the state quantities of the refrigerating cycle such as the high pressure and the low pressure are changed so that the torque is fluctuated. On the contrary, the reference state may be stored in relation to the torque or the compression ratio, or the mean value over a fixed period of time may be employed, for example.

A diagnosis method for the refrigerating cycle apparatus according to the invention has a step of extracting and learning a state where the refrigerating cycle apparatus is normally operated from the instrumentation amounts by each instrumentation amount detection means and stored in the storage means or the state feature values calculated from the instrumentation amounts. Also, the diagnosis method for the refrigerating cycle apparatus according to the invention has a step of compulsorily converting any one of the instrumentation amounts by each instrumentation amount detection means during the learned normal operating time or the state feature values calculated from the instrumentation amounts into another value, a step of newly making the arithmetic operation on the composite variables after the conversion, and a step of setting the new composite variables arithmetically obtained to the threshold when the judgement means judges the abnormality of the compressor, whereby the abnormal condition can be conceived and learned, based on the normal condition, without producing and learning the abnormal condition on the real machine. Also, the diagnosis method for the refrigerating cycle apparatus according to this invention has a step of calculating the time elapsed before the degree of abnormality reaches the threshold from the values of the composite variables in the normal condition, the arithmetic values of the current composite variables by the arithmetic means and the threshold, or the threshold preset by the user and the time elapsed, namely, a step of predicting the failure.

The refrigerating cycle apparatus according to this invention comprises the high pressure measurement means for measuring the high pressure of the refrigeration unit or the condensation temperature measurement means for measuring the saturation temperature at the high pressure, the low pressure measurement means for measuring the low pressure or the evaporation temperature measurement means for measuring the saturation temperature at the low pressure, and the liquid temperature measurement means, the discharge temperature measurement means or the suction temperature measurement means, in which there are provided the arithmetic means for acquiring the composite variables from the measured values, the storage means for storing the measured values of each measurement means or the arithmetic values such as composite variables calculated from the measured values, the comparison means for comparing the value stored in the past in the storage means with the current measured value or arithmetic value, and the judgement means for judging the refrigerant leakage based on the comparison result, whereby the refrigerating cycle abnormality such as refrigerant leakage can be detected precisely.

Also, the degree of abnormality such as the refrigerant leakage amount within the refrigerating cycle is calculated by the arithmetic means, and the time at which the abnormality limit capable of keeping a predetermined cooling power is reached is foreseen from the degree of abnormality, whereby the refrigerating cycle abnormality can be found in the early stage. Further, if the output means for outputting the foreseen time at which the abnormality limit is reached by an electric signal with the magnitude of voltage or current is provided, the found abnormality can be conveyed in the early stage. Also, if the refrigerant contains not a little combustible component, and the output means is connected to an alarm unit that raises the alarm by sound or light, the found abnormality can be conveyed in the early stage. Also, the data is monitored and judged remotely, whereby the abnormality can be found in the early stage.

The examples of abnormality of the refrigerating cycle that can be detected in the invention may include the failure and deterioration (change with the passage of time) of various kinds of equipment, and if the operating condition is changed, any abnormality can be detected. For example, a deterioration or liquid back-flow due to the lifetime of the compressor, a blemish or breakage of the condenser or the evaporator, a deterioration or failure of the air blower of the condenser or the air blower of the evaporator, a clogging of the strainer or the dryer, a bend, rupture or clogging of the pipeline, or a deterioration of the refrigerator oil (which is detected by clogging of the pipe, false lubrication of the compressor, or a change of the heat transfer amount) can be detected and discriminated.

In the invention thus constituted, the abnormality (failure or deterioration) of the equipment can be monitored remotely. Therefore, the abnormality of the equipment can be found without going to the actual place, whereby the abnormality can be detected in the early stage. Conventionally, there are two stages of firstly grasping the cause of abnormality by going to the actual place, and taking a countermeasure some day later. However, with the constitution of this invention, since the cause of abnormality can be specified remotely without going to the actual place, it is possible to shorten the time up to recovery by making the preparations before going to the actual place. For example, when the refrigerant leakage occurs, it can be known remotely, whereby a refrigerant bomb can be prepared before going to the actual place.

In the invention as described above, since the refrigerating cycle judged by the judgement means can detect the refrigerant leakage from the flow passage, the safe apparatus can be produced by monitoring the combustible refrigerant or a flow of the fluid harmful to the human body. Also, there is provided means for extracting and learning a state where the refrigerating cycle apparatus is normally operated from the measured values of each measurement means stored in the storage means or the arithmetic values calculated from the measured values, whereby the stable data is always obtained. Further, since the contents leaned by this learning means include the numerical value representing the correlation between a plurality of state quantities for the refrigerating cycle, the precise diagnosis is allowed. Also, there are provided a step of compulsorily converting any one of the measured values of each measurement means stored in the storage means or the arithmetic values calculated from the measured values into another value, a step of newly making the arithmetic operation on the composite variables after the conversion, and a step of setting the new composite variables to the threshold with which the judgement means judges the fluid leakage, whereby the abnormality can be simply settled, and the abnormal condition can be conceived and learned, based on the normal condition, without causing and learning the abnormal condition on the real machine.

The degree of abnormality of the refrigerating cycle is judged from the arithmetic values obtained by the arithmetic means of the invention, and the critical time at which the refrigerating cycle can not continue the safe operation can be foreseen, whereby the reliable apparatus and operation can be provided. Also, the amount of refrigerant or fluid or the refrigerant or fluid leakage amount within the flow passage cycle, or its equivalent arithmetic value, are calculated by the arithmetic means, and the time elapsed before the critical amount capable of keeping the preset cooling power or supply amount is reached is foreseen from the leakage amount or its equivalent arithmetic value, whereby the safe apparatus can be provided. Also, the output means for outputting the foreseen critical time by an electric signal with the magnitude of voltage or current is provided, with the voltage output or the current output according to the degree of abnormality in which the maximum value is the tolerance limit of keeping a predetermined apparatus capability based on the electric signal outputted by this output means, whereby the supervision is easy.

The invention has the compressor, the condenser, the expansion means and the evaporator that are connected via the pipeline, through which the refrigerant is circulated to constitute a refrigerating cycle, the refrigerant containing not a little combustible component, and comprises the high pressure measurement means for measuring the pressure of refrigerant or the high pressure at any position on the flow passage from the discharge side of the compressor to the expansion means or the condensation temperature measurement means for measuring the saturation temperature at the high pressure, the low pressure measurement means for measuring the pressure of refrigerant or the low pressure at any position on the flow passage from the expansion means to the suction side of the compressor or the evaporation temperature measurement means for measuring the saturation temperature at the low pressure, and the liquid temperature measurement means for measuring the temperature at any position on the flow passage from the condenser to the expansion means, the discharge temperature measurement means for measuring the temperature at any position on the flow passage from the compressor to the condenser, or the suction temperature measurement means for measuring the temperature at any position on the flow passage from the evaporator to the compressor, the storage means for storing the measured values of each measurement means or the arithmetic values calculated from the measured values, the comparison means for comparing the value stored in the past in the storage means with the current measured value or arithmetic value, the arithmetic means for performing the arithmetic operation for the refrigerant amount or the refrigerant leakage amount within the refrigerating cycle, or its equivalent arithmetic value, and the output means for outputting the abnormality of the refrigerating cycle as an electric signal or communicating it as a communication code with another apparatus, in which when the refrigerant leakage is detected, it is outputted prior to other abnormalities of the refrigerating cycle, whereby the secure maintenance is allowed, and the cheap and reliable apparatus is obtained.

The refrigerating cycle of the invention comprises means for storing the instrumentation amounts or the arithmetic values from the instrumentation amounts when the equipment is normally operated, means for inferring the instrumentation amounts or the arithmetic values from the instrumentation amounts in the abnormal condition where the equipment is abnormal or means for regenerating the abnormal condition of the equipment, means for making the arithmetic operation for the distance between the normal condition and abnormal condition and the current operating condition of the equipment, and means for estimating the normal condition or abnormal condition of the equipment, the degree of abnormality or the cause of abnormality from the distance between the current operating condition of the equipment and the normal condition, and a change in the distance from the abnormal condition, whereby the failure diagnosis apparatus is precise and easy to use.

In this invention, a plurality of abnormal conditions can be created for one cause of abnormality according to the degree of abnormality of the equipment, and the degree of abnormality of the equipment is inferred from a change in the distance between the current operating condition of the equipment and the plurality of abnormal conditions. Also, the arithmetic value or distance equivalent to the composite variable or the refrigerant amount is the Mahalanobis distance, or the numerical value obtained from the Mahalanobis distance. Also, the invention provides the refrigerating cycle apparatus in which the compressor, the condenser, the expansion means and the evaporator are connected via the pipeline, through which the refrigerant is circulated to constitute a refrigerating cycle, the refrigerating cycle apparatus comprising the high pressure measurement means for measuring the pressure of refrigerant or the high pressure at any position on the flow passage from the discharge side of the compressor to the expansion means or the condensation temperature measurement means for measuring the saturation temperature at the high pressure, the low pressure measurement means for measuring the pressure of refrigerant or the low pressure at any position on the flow passage from the expansion means to the suction side of the compressor or the evaporation temperature measurement means for measuring the saturation temperature at the low pressure, and the liquid temperature measurement means for measuring the temperature at any position on the flow passage from the condenser to the expansion means, the discharge temperature measurement means for measuring the temperature at any position on the flow passage from the compressor to the condenser, or the suction temperature measurement means for measuring the temperature at any position on the flow passage from the evaporator to the compressor, in which there are provided arithmetic means for acquiring the composite variables from the measured values of the high pressure measurement means or the condensation temperature measurement means, the low pressure measurement means or the evaporation temperature measurement means, the liquid temperature measurement means, the discharge temperature measurement means or the suction temperature measurement means, the storage means for storing the measured values of each measurement means or the arithmetic values such as composite variables calculated from the measured values, the comparison means for comparing the value stored in the past in the storage means with the current measured value or arithmetic value, and the judgement means for judging the abnormality of the refrigerating cycle based on the comparison result, near the refrigerating cycle apparatus or remotely via the network or the public line, the measured data or the arithmetic values being transmitted via the network or the public line, whereby the monitoring is cheap.

The invention provides refrigerating cycle apparatus in which the compressor, the condenser, the expansion means and the evaporator are connected via the pipeline, through which the refrigerant containing not a little combustible component is circulated to constitute a refrigerating cycle, the refrigerating cycle apparatus comprising the high pressure measurement means for measuring the pressure of refrigerant or the high pressure at any position on the flow passage from the discharge side of the compressor to the expansion means or the condensation temperature measurement means for measuring the saturation temperature at the high pressure, the lowpressure measurement means for measuring the pressure of refrigerant or the low pressure at any position on the flow passage from the expansion means to the suction side of the compressor or the evaporation temperature measurement means for measuring the saturation temperature at the low pressure, and the liquid temperature measurement means for measuring the temperature at any position on the flow passage from the condenser to the expansion means, the discharge temperature measurement means for measuring the temperature at any position on the flow passage from the compressor to the condenser, or the suction temperature measurement means for measuring the temperature at any position on the flow passage from the evaporator to the compressor, in which there are provided the storage means for storing the measured values of each measurement means or the arithmetic values calculated from the measured values, the comparison means for comparing the value stored in the past in the storage means with the current measured value or arithmetic value, the arithmetic means for performing the arithmetic operation for the refrigerant amount or the refrigerant leakage amount within the refrigerating cycle, or its equivalent arithmetic value, and the output means for outputting the abnormality of the refrigerating cycle as an electric signal or communicating it as a communication code with another apparatus, near the refrigerating cycle apparatus or remotely via the network or the public line, the measured data or arithmetic values being transmitted via the network or the public line, and when the refrigerant leakage is detected, it is outputted prior to other abnormalities of the refrigerating cycle.

Also, the invention comprises means for storing the instrumentation amounts or the arithmetic values from the instrumentation amounts when the equipment is normally operated, means for inferring the instrumentation amounts or the arithmetic values from the instrumentation amounts in the abnormal condition where the equipment is abnormal or means for regenerating the abnormal condition of the equipment, means for making the arithmetic operation for the distance between the normal condition and abnormal condition and the current operating condition of the equipment, and means for estimating the normal condition or abnormal condition of the equipment, the degree of abnormality or the cause of abnormality from the distance between the current operating condition of the equipment and the normal condition, and a change in the distance from the abnormal condition near the refrigerating cycle apparatus or remotely via the network or the public line, in which the measured data or arithmetic values are transmitted via the network or the public line.

Also, the invention comprises a plurality of means for storing the instrumentation amounts or the arithmetic values from the instrumentation amounts when the equipment is normally operated, means for inferring the instrumentation amounts or the arithmetic values from the instrumentation amounts in the abnormal condition where the equipment is abnormal or means for regenerating the abnormal condition of the equipment, means for making the arithmetic operation for the distance between the normal condition and abnormal condition and the current operating condition of the equipment, and means for estimating the normal condition or abnormal condition of the equipment, the degree of abnormality or the cause of abnormality from the distance between the current operating condition of the equipment and the normal condition or a change in the distance from the abnormal condition, near the refrigerating cycle apparatus or remotely via the network or the public line, in which the measured data or arithmetic values are transmitted via the network or the public line.

The refrigerating cycle apparatus according to the invention comprises the high pressure measurement means for measuring the high pressure of the refrigeration unit or the condensation temperature measurement means for measuring the saturation temperature at the high pressure, the low pressure measurement means for measuring the low pressure or the evaporation temperature measurement means for measuring the saturation temperature at the low pressure, and the liquid temperature measurement means, the discharge temperature measurement means or the suction temperature measurement means, in which there are provided arithmetic means for performing the arithmetic operation on the composite variables from the measured values, the storage means for storing the measured values of each measurement means or the arithmetic values such as composite variables calculated from the measured values, the comparison means for comparing the value stored in the past in the storage means with the current measured value or arithmetic value, and the judgement means for judging the refrigerant leakage based on the comparison result, whereby the refrigerating cycle abnormality such as refrigerant leakage can be detected precisely.

Also, the degree of abnormality such as the refrigerant leakage amount within the refrigerating cycle is calculated by the arithmetic means, and the time at which the abnormality limit capable of keeping the predetermined cooling power is reached is foreseen from the degree of abnormality, whereby the refrigerating cycle abnormality can be found in the early stage. Also, the arithmetic means 22, the storage means 23, the comparison means 24, the judgement means 25 and the output means 26 may be integrated, whereby when the remote monitoring is performed employing a general-purpose computer such as a personal computer, all the functions may be implemented by computer software, and in this case, the output is made on the display or an external storage medium such as a hard disk.

Also, the unit space is composed of the mean value and the standard deviation of each feature amount and the correlation coefficients, but other conditions maybe added. In the remote monitoring system, they are stored in a memory on the board in the refrigerating cycle apparatus, or a personal computer installed at the remote site. When all or a part of them are learned on the real machine, the data unnecessary to learn may be stored in either the memory on the board in the refrigerating cycle apparatus or the personal computer, but the data necessary to learn is stored in the hard disk of the personal computer.

The invention has the compressor, the condenser, the expansion means and the evaporator that are connected via the pipeline, through which the refrigerant is circulated to constitute a refrigerating cycle, and comprises the high pressure measurement means for measuring the pressure of refrigerant or the high pressure at any position on the flow passage from the discharge side of the compressor to the expansion means or the condensation temperature measurement means for measuring the saturation temperature at the high pressure, the low pressure measurement means for measuring the pressure of refrigerant or the low pressure at any position on the flow passage from the expansion means to the suction side of the compressor or the evaporation temperature measurement means for measuring the saturation temperature at the low pressure, and the liquid temperature measurement means for measuring the temperature at any position on the flow passage from the condenser to the expansion means, the discharge temperature measurement means for measuring the temperature at any position on the flow passage from the compressor to the condenser, or the suction temperature measurement means for measuring the temperature at any position on the flow passage from the evaporator to the compressor, in which there are provided the arithmetic means for performing the arithmetic operation on the composite variables from the measured values of the high pressure measurement means or the condensation temperature measurement means, the low pressure measurement means or the evaporation temperature measurement means, the liquid temperature measurement means, the discharge temperature measurement means or the suction temperature measurement means, the storage means for storing the measured values of each measurement means or the arithmetic values such as composite variables calculated from the measured values, the comparison means for comparing the value stored in the past in the storage means with the current measured value or the arithmetic value, and the judgement means for judging the abnormality of the refrigerating cycle based on the comparison result.

Moreover, if the output means for outputting the time at which the foreseen abnormality limit is reached by an electric signal with the magnitude of voltage or current is provided, the found abnormality such as deterioration or leakage can be conveyed in the early stage. Also, if the refrigerant contains not a little combustible component, and the output means is connected to an alarm unit that raises the alarm by sound or light, the found abnormality can be conveyed in the early stage. Also, if the data is monitored and judged remotely, the abnormality can be found in the early stage.

The invention claimed is:

1. A refrigerating cycle apparatus comprising:

a refrigerating cycle formed by fluidly connecting a compressor having a suction side and a discharge side, a condenser, an expansion unit and an evaporator via a pipeline, and flowing a refrigerant through the inside thereof;

a high pressure side measurement unit that is at least one of a high pressure measurement unit for measuring a high pressure corresponding to a refrigerant pressure at any position on a flow passage leading from the discharge side of the compressor to the expansion unit or a condensation temperature measurement unit for measuring the saturation temperature at the high pressure;

a low pressure side measurement unit that is at least one of a low pressure measurement unit for measuring a low pressure corresponding to a pressure of refrigerant at any position on a flow passage leading from the expansion unit to the suction side of the compressor or an evaporation temperature measurement unit for measuring the saturation temperature at the low pressure;

a refrigerant temperature measurement unit that is at least one of a liquid temperature measurement unit for measuring the temperature at any position on a flow passage leading from the condenser to the expansion unit, a discharge temperature measurement unit for measuring the temperature at any position on a flow passage leading from the compressor to the condenser, or a suction temperature measurement unit for measuring the temperature at any position on a flow passage leading from the evaporator to the compressor;

an arithmetic unit for performing an arithmetic operation on composite variables from measured values of the high pressure side measurement unit, the low pressure side measurement unit and the refrigerant temperature measurement unit; and a judgement unit for judging an operating condition of the refrigerating cycle based on a comparison result by comparing values stored in the past and current measured values or arithmetic values, as well as storing each of the measured values or the arithmetic values, wherein the judgement unit for judging the operating condition of the refrigerating cycle acquires a threshold for distinguishing between a normal operating condition and an abnormal operating condition by converting at least one of the measured values or the arithmetic values into another value and making the arithmetic operation on a plurality of variables including the value after conversion.

2. The refrigerating cycle apparatus according to claim 1, wherein the arithmetic values comprise a value obtained by the arithmetic operation on the measured values.

3. A refrigerating cycle apparatus comprising:

a refrigerating cycle formed by fluidly connecting a compressor, a condenser, an expansion unit and an evaporator via a pipeline and flowing a refrigerant through the inside thereof;

a normal state quantity storage unit for storing, as a plurality of normal state quantities corresponding to a normal operating condition, state quantities including at least a state quantity obtained by making an arithmetic operation on a correlation between a plurality of measured values as a plurality of variables when the refrigerating cycle is normally operating;

an abnormal state quantity storage unit for storing, as a plurality of abnormal state quantities corresponding to an abnormal operating condition, state quantities including at least a state quantity obtained by making the arithmetic operation on the correlation between the plurality of measured values as the plurality of variables when there is an abnormality in the refrigerating cycle;

a comparison unit for comparing the distances between current operating state quantities including at least a state quantity obtained by making the arithmetic operation on the correlation between the plurality of measured values in a current operating condition of the refrigerating cycle as the plurality of variables and the plurality of normal state quantities stored in the normal state quantity storage unit or the plurality of abnormal state quantities stored in the abnormal state quantity unit; and a judgement unit for judging a degree of normality, a degree of abnormality or a cause of abnormality of the refrigerating cycle from the distances compared by the comparison unit or a change in a distance.

4. The refrigerating cycle apparatus according to claim 1 wherein the judgement unit for judging the operating condition of the refrigerating cycle discriminates abnormalities comprising at least one of a refrigerant leakage from the refrigerating cycle, a refrigerant liquid back-flow to the compressor, a deterioration due to the lifetime of the compressor, a blemish or rupture on a surface of heat exchange for the condenser or the evaporator, a deterioration or failure of a blower unit of the condenser or the evaporator, clogging of a strainer for removing contaminant inside the pipeline through which the refrigerant is circulated, clogging of a dryer for preventing humidity of refrigerant, a bend, rupture or clogging of the pipeline, or a deterioration of a refrigerator oil useful for the compressor, or discriminates whether or not any of the abnormalities is involved.

5. The refrigerating cycle apparatus according to claim 3, further comprising a learning unit having at least one state quantity of a numerical value representing the correlation of making the arithmetic operation on the plurality of measured values, a plurality of arithmetic values from the measured values, or the plurality of measured values or arithmetic values as the plurality of variables, and learning at least the numerical value representing the correlation calculated as the plurality of variables in learning the state quantities of a state where the refrigerating cycle is normally operating.

6. The refrigerating cycle apparatus according to claim 5, wherein an arithmetic value from the measured values, the numerical value representing the correlation the plurality of variables, a value obtained by making the arithmetic operation on an aggregate in which the plurality of variables are combined and associated with each other and calculating the arithmetic operation result, or the distance is the Mahalanobis distance or the numerical value calculated from the Mahalanobis distance.

7. The refrigerating cycle apparatus according to claim 3, wherein the abnormal state quantities used by the judgement unit are obtained by converting any one of the measured values or arithmetic values obtained by making the arithmetic operation on the measured values into an other value, the values converted into the other value including the measured value by a refrigerant temperature measurement unit that is a liquid temperature measurement unit for measuring the temperature at any position on a flow passage leading from the condenser to the expansion unit, a discharge temperature measurement unit for measuring the temperature at any position on a flow passage leading from the compressor to the condenser, or a suction temperature measurement unit for measuring the temperature at any position on a flow passage leading from the evaporator to the compressor, or the arithmetic value obtained by making the arithmetic operation on the measured value.

8. The refrigerating cycle apparatus according to claim 3, wherein the judging the degree of abnormality of the refrigerating cycle is obtained by making the arithmetic operation on an aggregate in which the plurality of variables are combined and associated with each other, and calculating the arithmetic operation result, and predicting a critical time at which the refrigerating cycle can not continue a stable operation.

9. The refrigerating cycle apparatus according to claim 3, wherein in comparing the distances between the current operating state quantities including at least the state quantity of correlation of making the arithmetic operation on the plurality of measured values from the current operating condition of the refrigerating cycle as the plurality of variables, and the plurality of normal state quantities stored or the plurality of abnormal state quantities stored, a comparison is made between a refrigerant leakage amount that is an operated state quantity in a current operation or its equivalent arithmetic value and a preset refrigerant amount within the refrigerating cycle, a permissible refrigerant leakage amount or its equivalent state quantity, to predict a time to lead to a critical refrigerant amount capable of keeping the cooling power of the refrigerating cycle from the comparison.

10. A refrigerating cycle apparatus comprising:

a refrigerating cycle formed by fluidly connecting a compressor having a suction side and a discharge side, a condenser, an expansion unit and an evaporator via a pipeline and flowing a refrigerant through the inside thereof;

a high pressure side measurement unit that is at least one of a high pressure measurement unit for measuring a high pressure corresponding to a refrigerant pressure at any position on a flow passage leading from the discharge side of the compressor to the expansion unit or a condensation temperature measurement unit for measuring the saturation temperature at the high pressure;

a low pressure side measurement unit that is at least one of a low pressure measurement unit for measuring a low pressure corresponding to a pressure of refrigerant at any position on a flow passage leading from the expansion unit to the suction side of the compressor or an evaporation temperature measurement unit for measuring the saturation temperature at the low pressure;

a refrigerant temperature measurement unit that is at least one of a liquid temperature measurement unit for measuring the temperature at any position on a flow passage leading from the condenser to the expansion unit, a discharge temperature measurement unit for measuring the temperature at any position on a flow passage leading from the compressor to the condenser, or a suction temperature measurement unit for measuring the temperature at any position on a flow passage leading from the evaporator to the compressor;

a judgement unit for judging an operating condition of the refrigerating cycle including a refrigerant leakage by storing measured values of each measurement unit or arithmetic values calculated from the measured values, and comparing the stored values and the current measured values or arithmetic values; and an output unit for outputting refrigerant leakage information in preference to other abnormalities of the refrigerating cycle, when the refrigerant leakage is judged.

11. The refrigerating cycle apparatus according to claim 10, further comprising an arithmetic unit for performing an arithmetic operation on an aggregate in which a plurality of parameters obtained from three or more measured values measured by each measurement unit are combined as a plurality of variables and associated with each other to calculate the arithmetic value, a normal stats quantity storage unit for storing the measured values or the arithmetic values when the refrigerating cycle is normally operating, a comparison unit for comparing distances between the arithmetic value obtained from the measured values in a current operating condition of the refrigerating cycle and the arithmetic value stored in the normal state quantity storage unit or the arithmetic value obtained by making the arithmetic operation on the stored measured values, and the judgement unit judges a degree of normality, a degree of abnormality or a cause of abnormality for the refrigerating cycle from the distances or a change in the distances compared by the comparison unit.

12. The refrigerating cycle apparatus according to claim 10, further comprising an output unit for outputting an extent of abnormality of the refrigerant leakage in the refrigerating cycle as an electric signal or communicating it as a communication code with the outside, in which a plurality of thresholds are set halfway in the distance between the arithmetic values at a normal operating time and an abnormal operating time, and a refrigerant amount or a refrigerant leakage amount within the refrigerating cycle, or its equivalent arithmetic value, is set according to the plurality of thresholds.

13. A refrigerating cycle monitoring system comprising a remote monitoring apparatus for monitoring the operating condition of a refrigerating cycle apparatus, wherein at least one of measured values measured by the refrigerating cycle apparatus, arithmetic values obtained by arithmetic operation, and a judgement result as to whether or not the refrigerating cycle apparatus is in a normal operating condition by comparing the arithmetic values are within a set threshold is transmitted via a communication line or a radio communication, the refrigerating cycle apparatus comprising:

a refrigerating cycle formed by fluidly connecting a compressor having a suction side and a discharge side, a condenser, an expansion unit and an evaporator via a pipeline, and flowing a refrigerant through the inside thereof;

a high pressure side measurement unit that is at least one of a high pressure measurement unit for measuring a high pressure corresponding to a refrigerant pressure at any position on a flow passage leading from the discharge side of the compressor to the expansion unit or a condensation temperature measurement unit for measuring the saturation temperature at the high pressure;

a low pressure side measurement unit that is at least one of a low pressure measurement unit for measuring a low pressure corresponding to a pressure of refrigerant at any position on a flow passage leading from the expansion unit to the suction side of the compressor or an evaporation temperature measurement unit for measuring the saturation temperature at the low pressure;

a refrigerant temperature measurement unit that is at least one of a liquid temperature measurement unit for measuring the temperature at any position on a flow passage leading from the condenser to the expansion unit, a discharge temperature measurement unit for measuring the temperature at any position on a flow passage leading from the compressor to the condenser, or a suction temperature measurement unit for measuring the temperature at any position on a flow passage leading from the evaporator to the compressor;

an arithmetic unit for performing an arithmetic operation on composite variables from measured values of the high pressure side measurement unit, the low pressure side measurement unit and the refrigerant temperature measurement unit; and a judgement unit for judging an operating condition of the refrigerating cycle based on a comparison result by comparing values stored in the past and current measured values or arithmetic values, as well as storing each of the measured values or the arithmetic values, wherein the judgement unit for judging the operating condition of the refrigerating cycle acquires a threshold for distinguishing between a normal operating condition and an abnormal operating condition by converting at least one of the measured values or the arithmetic values into another value and making the arithmetic operation on a plurality of variables including the value after conversion.

14. A refrigerating cycle monitoring system comprising:

a high pressure side measurement unit that is at least one of a high pressure measurement unit for measuring a high pressure corresponding to a refrigerant pressure at any position on a flow passage leading from a discharge side of a compressor to an expansion unit or a condensation temperature measurement unit for measuring the saturation temperature at the high pressure in a refrigerating cycle apparatus that constitutes a refrigerating cycle by fluidly connecting the compressor, a condenser, the expansion unit and an evaporator via a pipeline and flowing a refrigerant through the inside thereof;

a low pressure side measurement unit that is at least one of a low pressure measurement unit for measuring a low pressure corresponding to a pressure of refrigerant at any position on a flow passage leading from the expansion unit to a suction side of the compressor or an evaporation temperature measurement unit for measuring the saturation temperature at the low pressure;

a refrigerant temperature measurement unit that is at least one of a liquid temperature measurement unit for measuring the temperature at any position on a flow passage leading from the condenser to the expansion unit, a discharge temperature measurement unit for measuring the temperature at any position on a flow passage leading from the compressor to the condenser, or a suction temperature measurement unit for measuring the temperature at any position on a flow passage leading from the evaporator to the compressor;

an arithmetic unit for acquiring composite variables from measured values of the high pressure side measurement unit, the low pressure side measurement unit and the refrigerant temperature measurement unit;

a storage unit for storing the measured values and arithmetic values comprising the composite variables by making an arithmetic operation on the measured values;

a judgement unit for judging an abnormality of the refrigerating cycle based on a comparison result by comparing values stored in the past by the storage unit and current measured values or arithmetic values;

a transmission unit, formed by wire or radio, for transmitting the measured values or the arithmetic values or a judgement result of the judgement unit to a remote monitoring apparatus provided at a site away from the refrigerating cycle apparatus; and a normal state storage unit for learning and storing an arithmetic operation result of the arithmetic unit as a normal state in a condition where the refrigerating cycle is normally operating, an abnormal state storage unit for learning and storing the arithmetic operation result of the arithmetic unit as an abnormal state in a condition where the refrigerating cycle is abnormally operating, and a plurality of thresholds set halfway in a distance between arithmetic operation results of the normal state and the abnormal state that are stored, wherein a distance between the arithmetic operation result of a current operating condition and a threshold or a temporal change in the distance is displayed in the remote monitoring apparatus.

15. The refrigerating cycle monitoring system according to claim 14, wherein the condition where the refrigerating cycle is abnormally operating comprises a refrigerant leakage.

16. A refrigerating cycle monitoring system comprising:

a normal state storage unit for storing state quantities in a normal operating condition that are acquired or inferred by making an arithmetic operation on a correlation between a plurality of variables from measurement results when a refrigerating cycle formed by fluidly connecting a compressor, a condenser, an expansion unit and an evaporator via a pipeline and flowing a refrigerant through the inside thereof is normally operating;

an abnormal state storage unit for storing the state quantities in a plurality of abnormal states that are acquired by making the arithmetic operation on the correlation between a plurality of variables from the measurement results of an operation when there is an abnormality in circulation of the refrigerant in the refrigerating cycle, or storing a plurality of abnormal state quantities obtained by regenerating the plurality of abnormal states;

a comparison unit for comparing distances between current state quantities obtained from a current operating condition of the refrigerating cycle and the state quantities stored in the normal state storage unit or the state quantities stored in the abnormal state storage unit; and a judgement unit for judging a degree of normality, a degree of abnormality or a cause of abnormality in the refrigerating cycle from the distances compared by the comparison unit or a change in a distance;

wherein at least one of the current state quantities, the distances compared by the comparison unit or the change in the distance, and the degree of normality, the degree of abnormality or the cause of abnormality for the refrigerating cycle judged by the judgement unit is transmitted by a transmission unit formed by wire or radio.

17. A refrigerating cycle monitoring system comprising:

a high pressure side measurement unit that is at least one of a high pressure measurement unit for measuring a high pressure corresponding to a refrigerant pressure at any position on a flow passage leading from a discharge side of a compressor to an expansion unit or a condensation temperature measurement unit for measuring the saturation temperature at the high pressure in a refrigerating cycle apparatus that constitutes a refrigerating cycle by fluidly connecting the compressor, a condenser, the expansion unit and an evaporator via a pipeline and flowing a refrigerant through the inside thereof;

a low pressure side measurement unit that is at least one of a low pressure measurement unit for measuring a low pressure corresponding to a pressure of refrigerant at any position on a flow passage leading from the expansion unit to a suction side of the compressor or an evaporation temperature measurement unit for measuring the saturation temperature at the low pressure;

a refrigerant temperature measurement unit that is at least one of a liquid temperature measurement unit for measuring the temperature at any position on a flow passage leading from the condenser to the expansion unit, a discharge temperature measurement unit for measuring the temperature at any position on a flow passage leading from the compressor to the condenser, or a suction temperature measurement unit for measuring the temperature at any position on a flow passage leading from the evaporator to the compressor;

an arithmetic unit for acquiring composite variables from measured values of the high pressure side measurement unit, the low pressure side measurement unit and the refrigerant temperature measurement unit;

a storage unit for storing the measured values and arithmetic values comprising the composite variables by making an arithmetic operation on the measured values;

a judgement unit for judging an abnormality of the refrigerating cycle based on a comparison result by comparing values stored in the past by the storage unit and current measured values or arithmetic values; and a transmission unit, formed by wire or radio, for transmitting the measured values or the arithmetic values or a judgement result of the judgement unit to a remote monitoring apparatus provided at a site away from the refrigerating cycle apparatus, wherein information as to presumed time taken until a failure of equipment occurs based on the arithmetic values measured and calculated at a normal operating time and an operating time elapsed of the refrigerating cycle, the arithmetic values being measured and calculated in a current operating condition, is transmitted and displayed to the remote monitoring apparatus via the transmission unit.

18. A refrigerating cycle monitoring system comprising:

a high pressure side measurement unit that is at least one of a high pressure measurement unit for measuring a high pressure corresponding to a refrigerant pressure at any position on a flow passage leading from a discharge side of a compressor to an expansion unit or a condensation temperature measurement unit for measuring the saturation temperature at the high pressure in a refrigerating cycle apparatus that constitutes a refrigerating cycle by fluidly connecting the compressor, a condenser, the expansion unit and an evaporator via a pipeline and flowing a refrigerant through the inside thereof;

a low pressure side measurement unit that is at least one of a low pressure measurement unit for measuring a low pressure corresponding to a pressure of refrigerant at any position on a flow passage leading from the expansion unit to a suction side of the compressor or an evaporation temperature measurement unit for measuring the saturation temperature at the low pressure;

a refrigerant temperature measurement unit that is at least one of a liquid temperature measurement unit for measuring the temperature at any position on a flow passage leading from the condenser to the expansion unit, a discharge temperature measurement unit for measuring the temperature at any position on a flow passage leading from the compressor to the condenser, or a suction temperature measurement unit for measuring the temperature at any position on a flow passage leading from the evaporator to the compressor;

an arithmetic unit for acquiring composite variables from measured values of the high pressure side measurement unit, the low pressure side measurement unit and the refrigerant temperature measurement unit;

a storage unit for storing the measured values and arithmetic values comprising the composite variables by making an arithmetic operation on the measured values;

a judgement unit for judging an abnormality of the refrigerating cycle based on a comparison result by comparing values stored in the past by the storage unit and current measured values or arithmetic values;

a transmission unit, formed by wire or radio, for transmitting the measured values or the arithmetic values or a judgement result of the judgement unit to a remote monitoring apparatus provided at a site away from the refrigerating cycle apparatus; and an output unit for setting a refrigerant amount or refrigerant leakage amount within the refrigerating cycle as the arithmetic value equivalent to each amount and outputting the abnormality of the refrigerating cycle as an electric signal or communicating it as a communication code, wherein a refrigerant leakage, if detected, is outputted to the remote monitoring apparatus prior to other judgement results of the judgement unit.

19. A refrigerating cycle monitoring system comprising:

a normal state storage unit for storing an arithmetic operation result of making an arithmetic operation on a correlation between physical quantities of a refrigerant in a condition where the refrigerant flowing through a refrigerating cycle is normal, as a normal condition, an abnormal state storage unit for storing the arithmetic operation result of making the arithmetic operation on the correlation between the physical quantities of the refrigerant in an abnormal condition where the refrigerant leaks out of the refrigerating cycle, and a refrigerant leakage foreseeing unit for foreseeing a time when the refrigerant leaks out of the refrigerating cycle by comparing distances between the arithmetic operation result of making the arithmetic operation on the correlation between the physical quantities of the refrigerant in a current operating condition and at least one of the normal condition and the abnormal condition that are stored, wherein a foreseen result of the refrigerant leakage foreseeing unit is transmitted to a remote monitoring apparatus.

* * * * *